US011634651B2

(12) United States Patent
Woods et al.

(10) Patent No.: US 11,634,651 B2
(45) Date of Patent: Apr. 25, 2023

(54) SYSTEM AND METHOD FOR BIOGASIFICATION

(71) Applicant: Waste to Energy Systems, LLC, Tickfaw, LA (US)

(72) Inventors: Richard Woods, Tickfaw, LA (US); Frank Larmon, Amite, LA (US); Alejandro Martinez, Hammond, LA (US); Alissa Woods Mahoney, Concord, NC (US); David McBurnett, Coconut Grove, FL (US)

(73) Assignee: Waste to Energy Systems, LLC, Hammond, LA (US)

( * ) Notice: Subject to any disclaimer, the term of this patent is extended or adjusted under 35 U.S.C. 154(b) by 55 days.

(21) Appl. No.: 15/699,829

(22) Filed: Sep. 8, 2017

(65) Prior Publication Data

US 2019/0127649 A1 May 2, 2019

Related U.S. Application Data

(60) Provisional application No. 62/385,199, filed on Sep. 8, 2016.

(51) Int. Cl.
*C10J 3/40* (2006.01)
*C10J 3/72* (2006.01)
(Continued)

(52) U.S. Cl.
CPC . *C10J 3/40* (2013.01); *C10J 3/26* (2013.01); *C10J 3/723* (2013.01); *C10J 3/74* (2013.01);
(Continued)

(58) Field of Classification Search
CPC ..... C10J 2300/0946; C10J 2300/0956; C10J 2200/09; C10J 2300/093; C10J 2300/1238; C10J 2300/0916; C10J 2300/1634; C10J 2300/165; C10J 3/82; C10J 2300/0959; C10J 2300/0973; C10J 3/26;
(Continued)

(56) References Cited

U.S. PATENT DOCUMENTS 4,139,339 A * 2/1979 Straitz, III ..... F23G 5/50 422/168
9,267,686 B1 * 2/2016 Little ..... F23G 7/085
(Continued)

FOREIGN PATENT DOCUMENTS

CN 1032812 * 5/1989
CN 1032812 A * 5/1989 ..... C10J 3/26
(Continued)

*Primary Examiner* — Kaity V Chandler
(74) *Attorney, Agent, or Firm* — Zachary Christiansen

(57) ABSTRACT

Embodiments of the invention improve the performance, safety, and efficiency of the gasification process. Embodiments of the invention improve downdraft gasification by improving upon the systems and methods for fuel preparation and by addressing gasifier bridging and channeling. Unique parts of the system include a unique hearth and grate design, a programmable logic controller and interface for managing the gasification process, an improved filtration system, a unique system for eliminating mist, a unique system for cooling gas, a unique combined flare, an integrated auger system, and a new system and method for sampling gas.

15 Claims, 89 Drawing Sheets

(51) Int. Cl.

| | |
|---|---|
| ***C10J 3/84*** | (2006.01) |
| ***C10J 3/74*** | (2006.01) |
| ***C10K 1/20*** | (2006.01) |
| ***C10J 3/26*** | (2006.01) |
| ***C10K 1/02*** | (2006.01) |
| ***C10K 1/06*** | (2006.01) |

(52) U.S. Cl.
CPC ..... *C10J 3/84* (2013.01); *C10K 1/024* (2013.01); *C10K 1/026* (2013.01); *C10K 1/06* (2013.01); *C10K 1/20* (2013.01); *C10J 2300/092* (2013.01); *C10J 2300/0909* (2013.01); *C10J 2300/0946* (2013.01); *C10J 2300/1634* (2013.01)

(58) Field of Classification Search
CPC ..... C10J 2300/0983; C10J 3/723; C10J 2300/1671; C10J 2300/1869; C10J 3/66; C10J 3/84; C10J 2300/0969; C10J 3/20; C10J 2300/0903; C10J 2300/0943; C10J 2300/123; C10J 2300/1675; C10J 3/00; C10J 3/482; C10J 3/54; C10J 3/56; C10J 2200/158; C10J 2300/0909; C10J 2300/0976; C10J 2300/1659; C10J 2300/1884; C10J 3/34; C10J 3/64; C10J 3/721; C10J 2200/00; C10J 2200/31; C10J 2300/092; C10J 2300/1223; C10J 2300/1628; C10J 2300/1681; C10J 2300/1693; C10J 2300/1876; C10J 3/466; C10J 3/485; C10J 2300/0906; C10J 2300/1618; C10J 2300/1643; C10J 2300/1665; C10J 2300/1815; C10J 2300/1853; C10J 3/463; C10J 3/18; C10J 3/30; C10J 3/40; C10J 2200/152; C10J 2300/094; C10J 2300/0989; C10J 2300/1606; C10J 2300/1687; C10J 3/08; C10J 3/32; C10J 3/42; C10J 3/523; C10J 3/86; C10J 2200/15; C10J 2200/154; C10J 2200/156; C10J 2300/0923; C10J 2300/1253; C10J 2300/1603; C10J 2300/1807; C10J 2300/1892; C10J 3/002; C10J 3/06; C10J 3/14; C10J 3/48; C10J 3/52; C10J 3/72; C10J 3/726
See application file for complete search history.

(56) References Cited

U.S. PATENT DOCUMENTS

| | | | | |
|---|---|---|---|---|
| 9,677,762 | B2 * | 6/2017 | Tullos | F23G 7/085 |
| 2001/0025704 | A1 * | 10/2001 | Jainek | F28D 9/0012 165/119 |
| 2008/0209807 | A1 * | 9/2008 | Tsangaris | C10J 3/20 48/89 |
| 2012/0204599 | A1 * | 8/2012 | Northrop | C10L 3/10 62/617 |

FOREIGN PATENT DOCUMENTS

| | | | | |
|---|---|---|---|---|
| CN | 101565764 | * | 10/2009 | |
| CN | 101565764 | A * | 10/2009 | |
| CN | 101564633 | * | 3/2011 | |
| CN | 101564633 | B * | 3/2011 | |
| CN | 102057222 | * | 5/2011 | |
| CN | 102057222 | A * | 5/2011 | F23G 5/50 |
| CN | 207857151 | U * | 9/2018 | |
| CN | 207857151 | U * | 9/2018 | |
| WO | WO-2012036845 | * | 3/2012 | |
| WO | WO-2012036845 | A1 * | 3/2012 | B04C 5/04 |

* cited by examiner

SECTION A-A
SCALE 1 : 2

SYSTEM AND METHOD FOR BIOGASIFICATION

CROSS REFERENCE TO RELATED APPLICATIONS

This application claims the benefit of U.S. Provisional Application No. 62/385,199, filed Sep. 8, 2017.

REFERENCE TO GOVERNMENT FUNDING SOURCES

Not applicable.

REFERENCE TO SEQUENCE LISTING

Not applicable.

BACKGROUND OF THE INVENTION

Fields of the Invention

The disclosure as detailed herein is in the technical field of energy production. More specifically, the present disclosure relates to the technical field of thermal energy production. Even more specifically, the present disclosure relates to the technical field of gasification.

Description of Related Art

Gasification has a long history of reducing atmospheric pollutants and providing a reduction in release of greenhouse gases to the atmosphere compared to incineration. Compared to other methods of disposal typical biomass feed, the environmental impact of this process is carbon dioxide, which is neutral for most gasification systems. Downdraft gasification designs have worked to the present day with improvements in the gasifier and downstream equipment. The advantages of downdraft gasification are lower particulates and tars in the producer gas, compared to other gasification methods.

GENERAL SUMMARY OF THE INVENTION

The invention encompasses improvements to downdraft gasification. The type of gasifier employed is a downdraft dry particulate and tar removal system. This has improvements to prevent bridging and channeling by improved controls, briquette feeding, automated grate shaking, outlet collection of gas design, equivalence ratio and temperature control. In some embodiments, the system handles difficult feedstock such as sawdust and landfill designated waste.

In some embodiments, an integrated fuel level sensor switch allows control of the amount of fuel delivered to the gasifier for efficient gas production. In some embodiments, the gasifier type is down draft (meaning gravity is used to move fuel from the top of the gasifier to the bottom). In some embodiments, the gasifier is of a linear design for easier up-scaling purposes. In some embodiments, an air tight system allows air into the system through air inlet nozzles. In some embodiments, the gasifier is insulated to reduce heat loss which improves cracking and reduction conversions.

In some embodiments, fuel is added to the hopper from the top. In some embodiments, the hopper comprises negative slopes to avoid fuel build up. In some embodiments, as the fuel dries, it enters the lower section of the hopper termed the pyrolysis zone.

In some embodiments, refractory surfaces are coated and exposed to high temperature (with no exposed steel). In some embodiments, the hearth box is first lined with ceramic, high temperature, high density fiber board then a refractory composed of silica and alumina is precast. In some embodiments, then refractory is coated with a phosphate bonded alumina coating set through baking and provides high abrasion and corrosive resistance and anti-slagging characteristics.

In some embodiments, the architecture of the refractory prevents bridging and allows smooth flow of fuel to the combustion zone. In some embodiments, the air ferrules are flanged to prevent movement during high temperatures. In some embodiments, the throat is ceramic and of a rectangular/linear design where the nozzles are on the sides.

In some embodiments, air ferrules are located on the longer sides of the refractory rectangle at even distances from side to side, to ensure that air build up will not occur in one section of the hearth. In some embodiments, the ferrules are made of a ceramic coating to avoid PVC decomposition from hydrochloric acid. In some embodiments, the restriction on the throat ensures complete combustion and the proper superficial velocity for reduction. It also ensures the fuel has combusted or been "cracked" as it reaches the combustion zone. In some embodiments, the automated operating system allows for a gradual heating and cooling of the system to prevent refractory decay.

In some embodiments, the ash module consists of multiple parts including; a grate, a gas collection system, an ash collection system and a mechanism to level the bed to prevent bridging. In some embodiments, gas collection occurs via a pipe with an opening on the top covered by a metal stainless steel shield. This allows the ash to efficiently fall to the ash removal collection point. In some embodiments, the ash collection portion of the ash module is of a "V" shape design to reduce any entrapment of particulates. In some embodiments, the ash is then moved by auger to designated ash barrels.

In some embodiments, the cooler allows the gases to be cooled through conduction and convection and further allows particles to drop out of the gas because of the unique architecture of baffles. In some embodiments, the cooler entrance temperature of the gas is 500 C and exit temperature is 130 C.

In some embodiments, within the packed bed filter, the gas feeds through the bottom of the filter and then through a shakable grate with a wood chip medium. In some embodiments, differential pressure is used to determine when the initial layer of filter medium becomes saturated. The grate then shakes through the saturated layer creating a new filter surface. In some embodiments, the filter is maintained by a customized fuel level sensor operated hopper that is airtight and continuously fills the filter bed. In some embodiments, the auger system then removes the waste.

In some embodiments, a chiller system drops gas temperature to below dew point to ensure maximum moisture is removed from the gas and creates putatively ideal engine temperatures. In some embodiments, the gas first flows through a water spray to capture particulates and then through a mesh impingement pad, in order to start the condensing process. In some embodiments, the gas may also interact with a condenser coated with a hydrophilic coating to prevent tars and particulate from depositing on the condenser. In some embodiments, captured water is filtered to remove any tars and particulates which may be reintroduced as fuel. In addition, The clean water may then be utilized as the water source for an integrated water scrubbing system.

In some embodiments, a mist elimination system removes any moisture that did not condense out through the chiller, via a two stage impingement system. In some embodiments, a first stage chevron pad forces the gas to change directions through the pad allowing moisture to condense. In some embodiments, a second stage mesh pad pulls out any remaining smaller droplets. The waste water from this system may be combined with waste water from the chiller for treatment.

In some embodiments, a polishing filter removes fine particles with a micron hydrophobic filter bag. The outside-in gas flow design allows the filter to self-clean using a shaker. This enables the filter to continuously run with minimal maintenance.

In some embodiments, there is a blower that pulls air through the system. In some embodiments, this blower is positioned before the outlet gas is received for use, and is positioned after the polishing filter. In some embodiments, the blower is operably connected to a PLC for operation maintenance, procedures, and emergency shutdown.

In some embodiments, during start up and shut down, gas is diverted directly to the flare by passing majority of equipment to prevent fouling of the filter system. Once proper temperatures are reached, the PLC automatically redirects the gas through the system and excess gas is redirected to the flare through a secondary channel downstream. In some embodiments, there is an automated, proprietary switching system that controls the flare and further an integrated, secondary fuel system for ignition.

In some embodiments, a programmable logic controller (PLC) controls the fuel flow, air/gas flow by using equivalence ratios. In some embodiments, the PLC controls the temperature inside of the gasifier (and downstream), in addition to a hearth grate shaker using PLC controls. In some embodiments, the PLC controls the fan speed, packed bed filter shaker and hopper.

In some embodiments, the PLC monitors, air and gas flows, temperatures, differential pressure, and oxygen levels. In some embodiments, the PLC can be remotely viewed and operated from a desktop or mobile device. The PLC allows safety, lower maintenance and efficiency.

In some embodiments, there is an integrated auger system that is an airtight waste removal system. It preferably cleans out ash, soot and carbon from the ash module, rectilinear cooler, packed bed filter. In some embodiments, waste is transferred to a receptacle outside of the plant to minimize personal contact for safety reasons and allows for minimal maintenance.

DETAILED DESCRIPTION OF THE INVENTION

Figure 1:
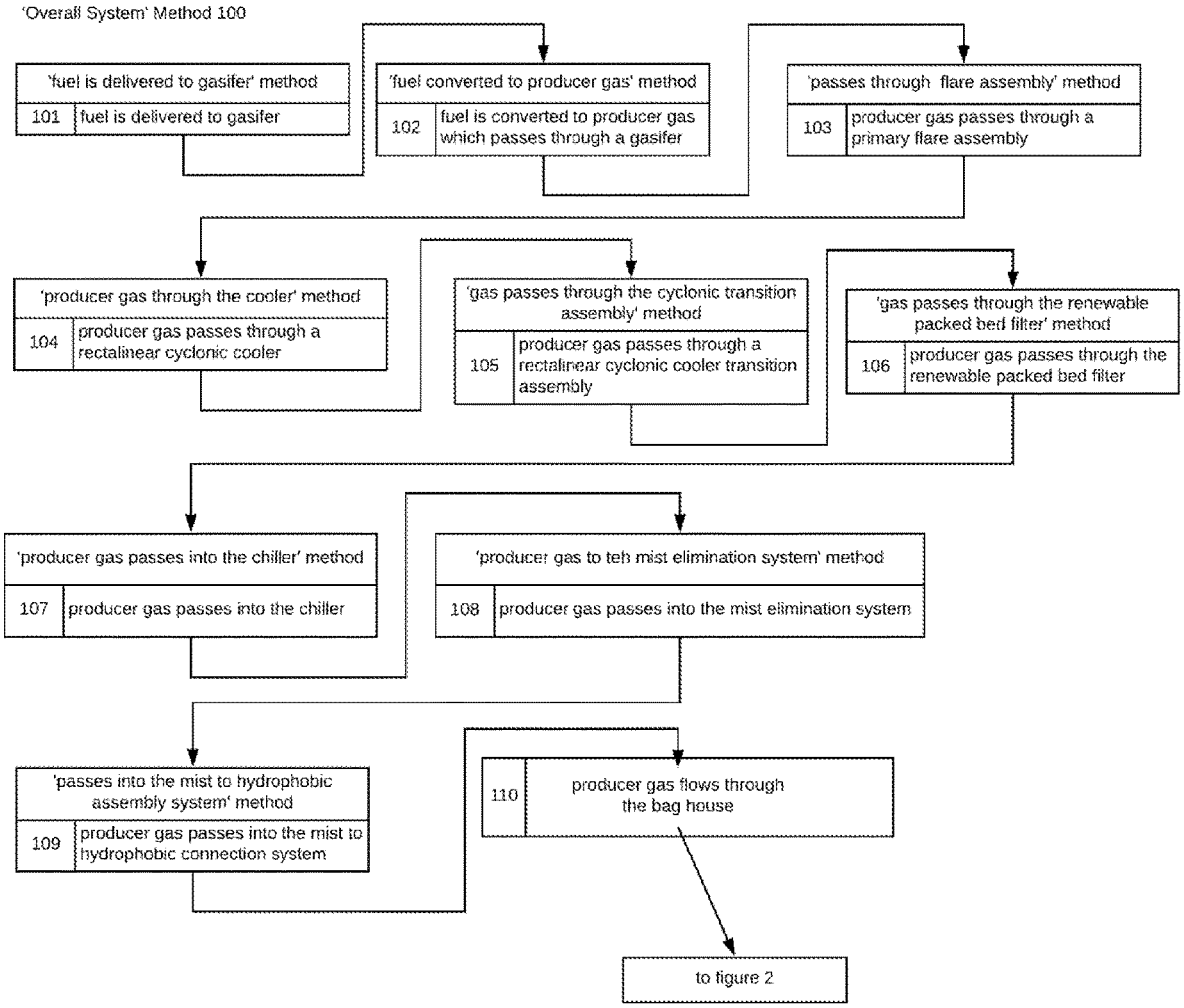
FIG. 1 is a diagram view which shows method of use of the overall system.
Figure 2:
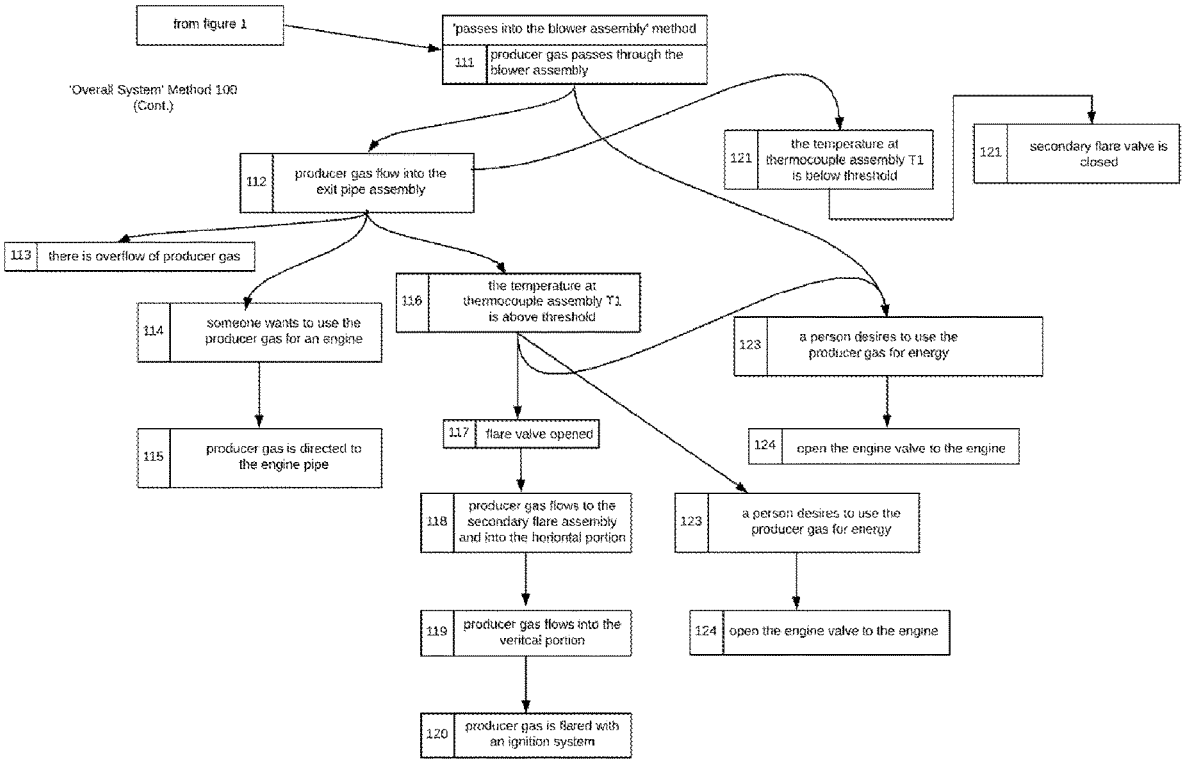
FIG. 2 is a diagram view which shows method of use of the overall system.
Figure 3:
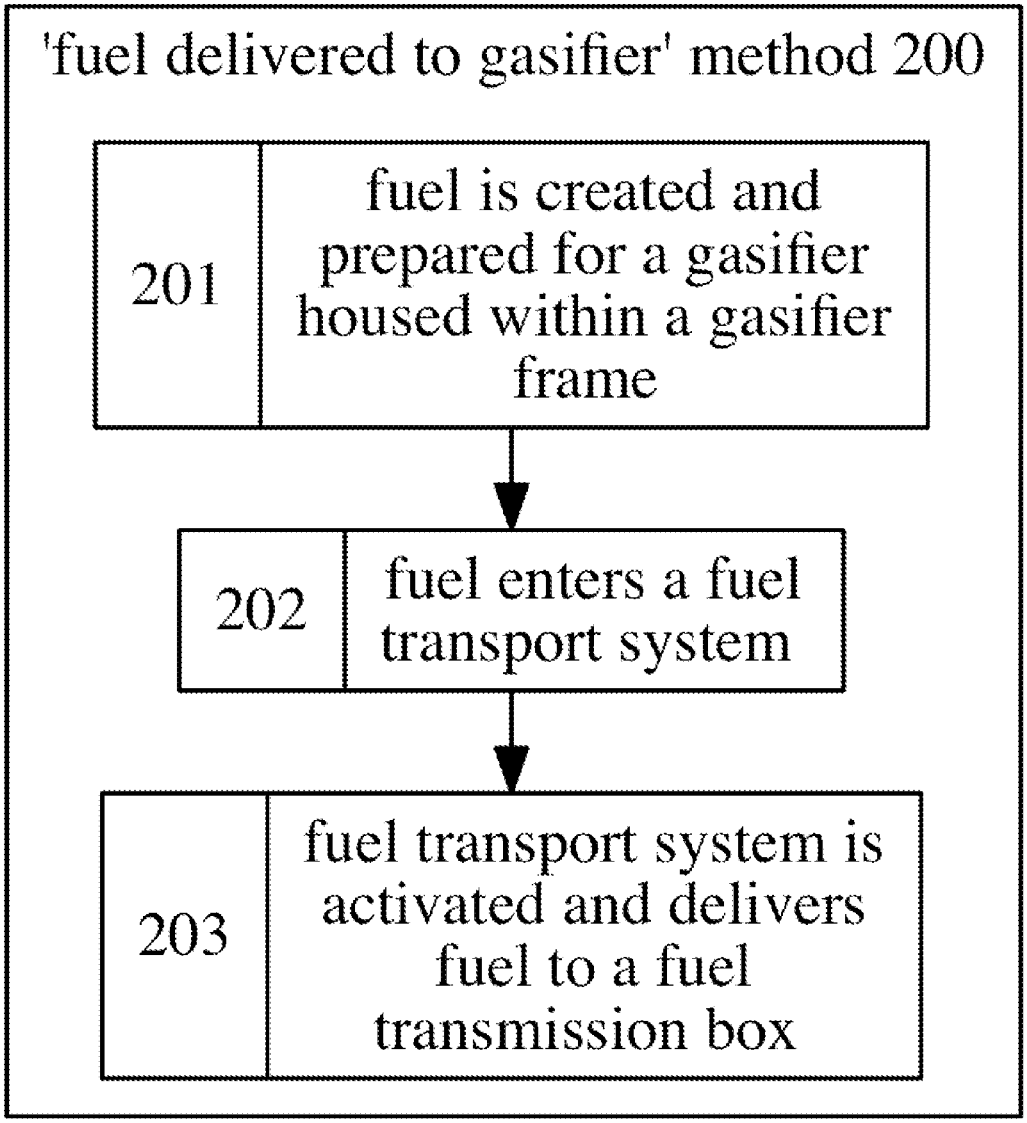
FIG. 3 is a diagram view which shows method of fuel being delivered to the gasifier.
Figure 4:
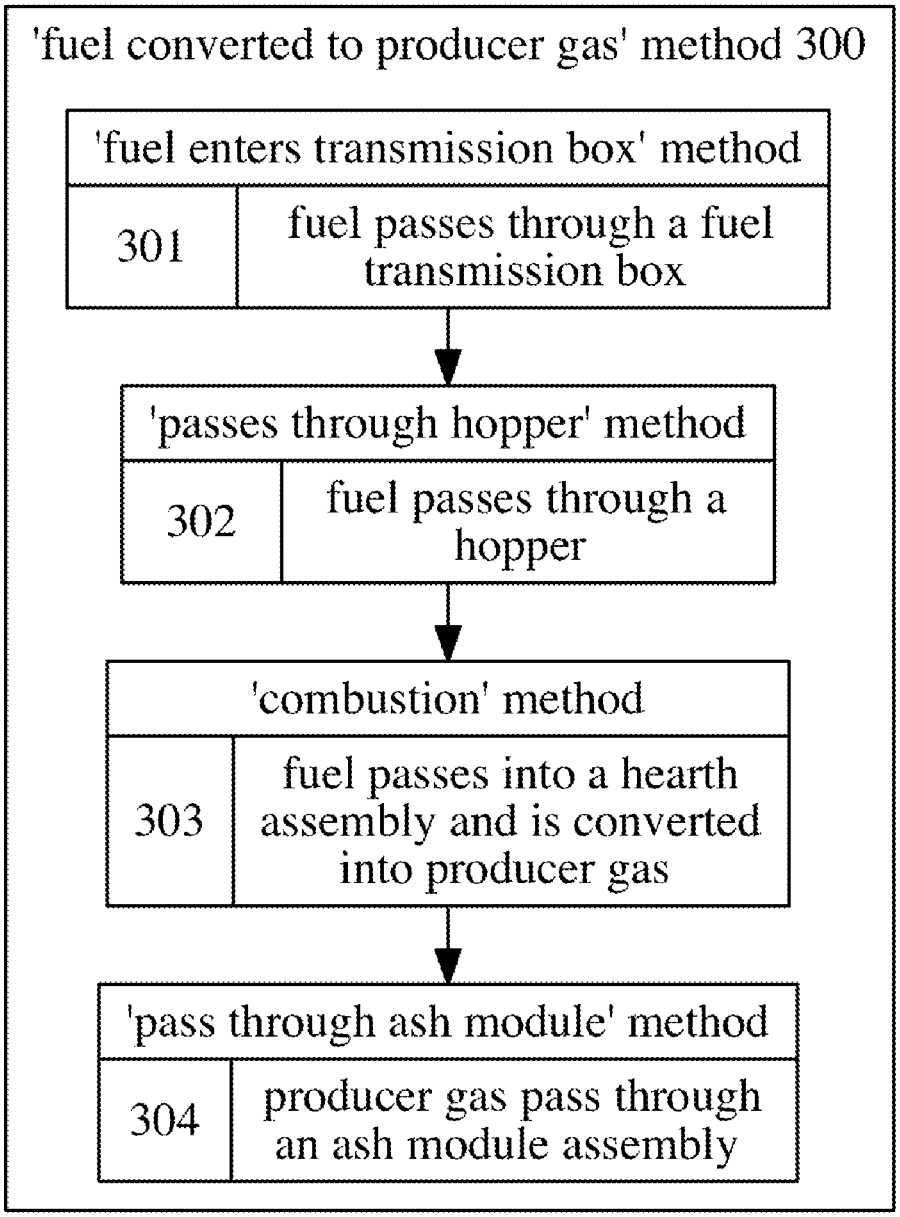
FIG. 4 is a diagram view which shows method of fuel being converted to produce gas.
Figure 5:
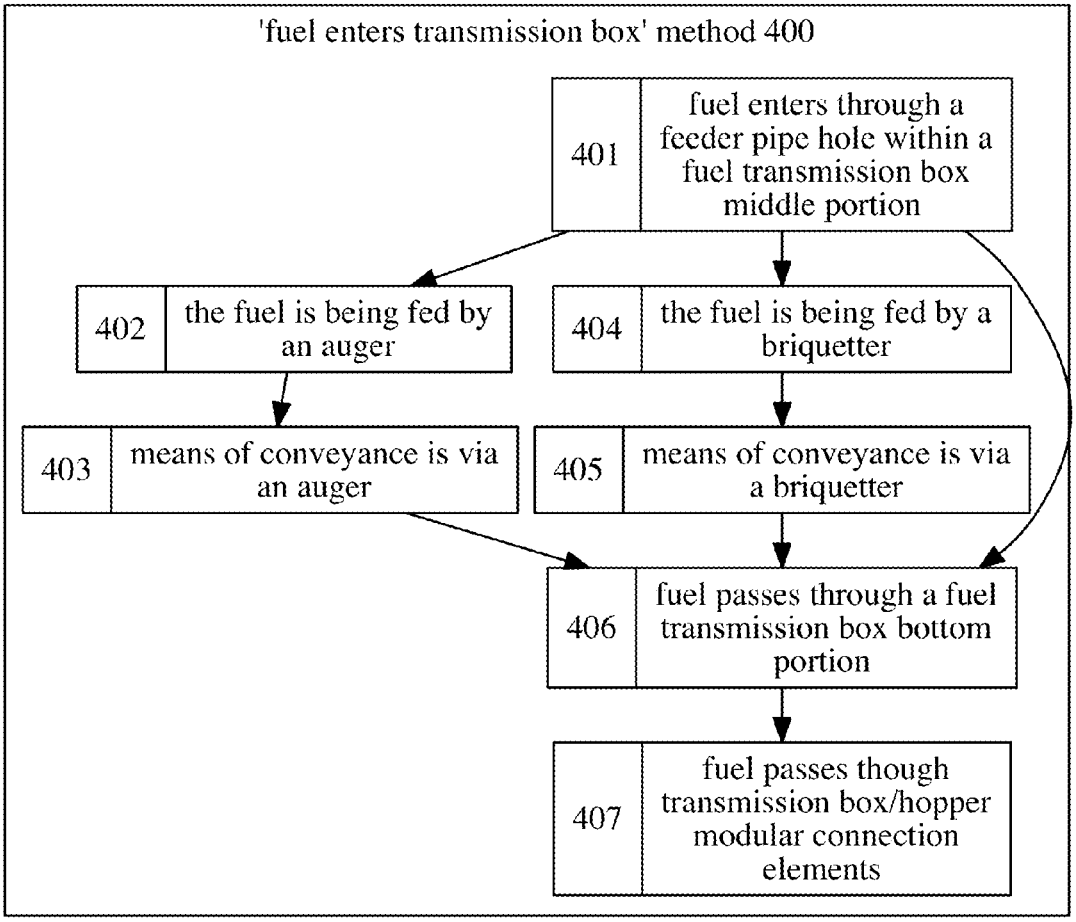
FIG. 5 is a diagram view which shows method of fuel entering the transition box.
Figure 6:
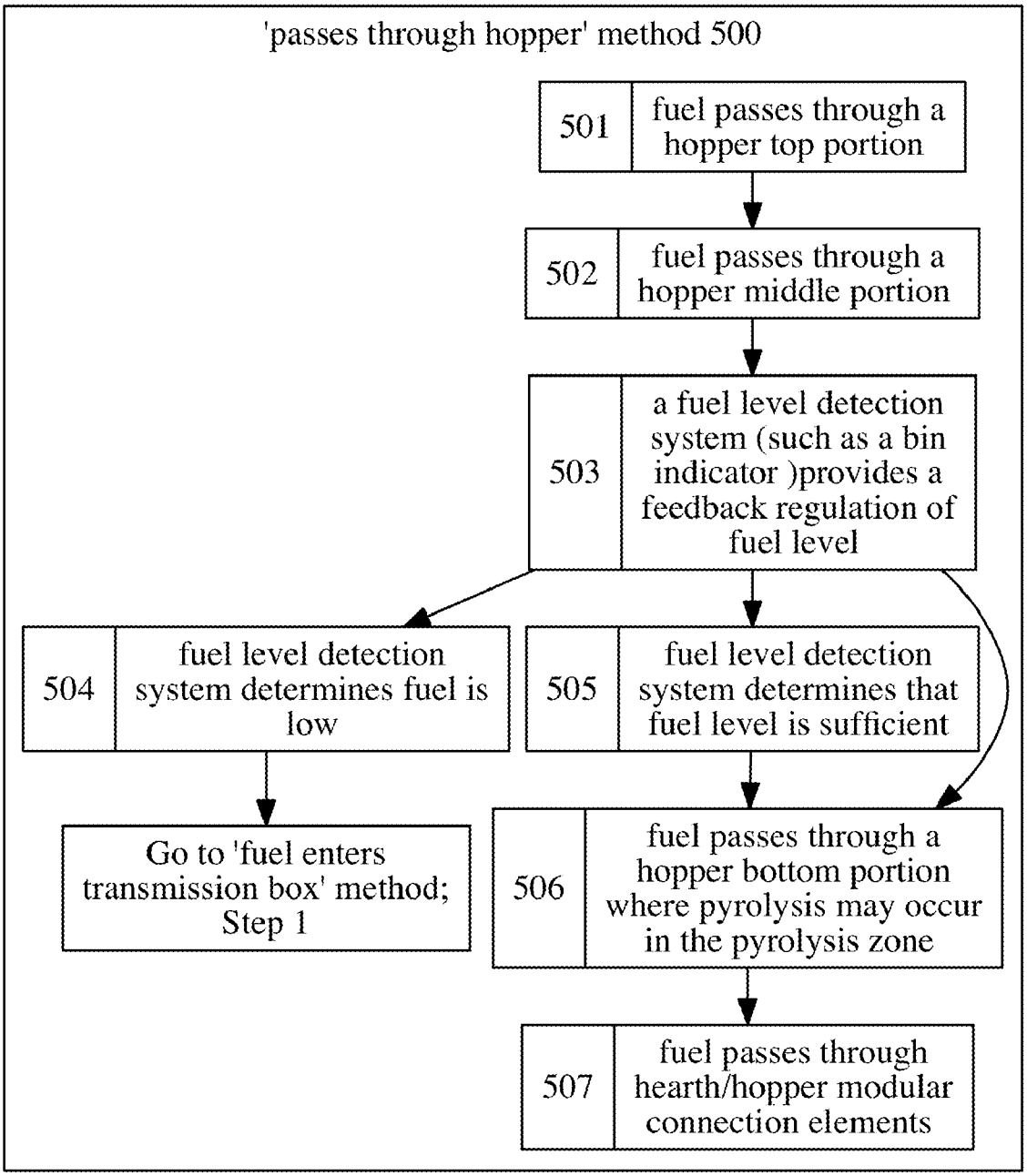
FIG. 6 is a diagram view which shows method of fuel passing through the hopper.
Figure 7:
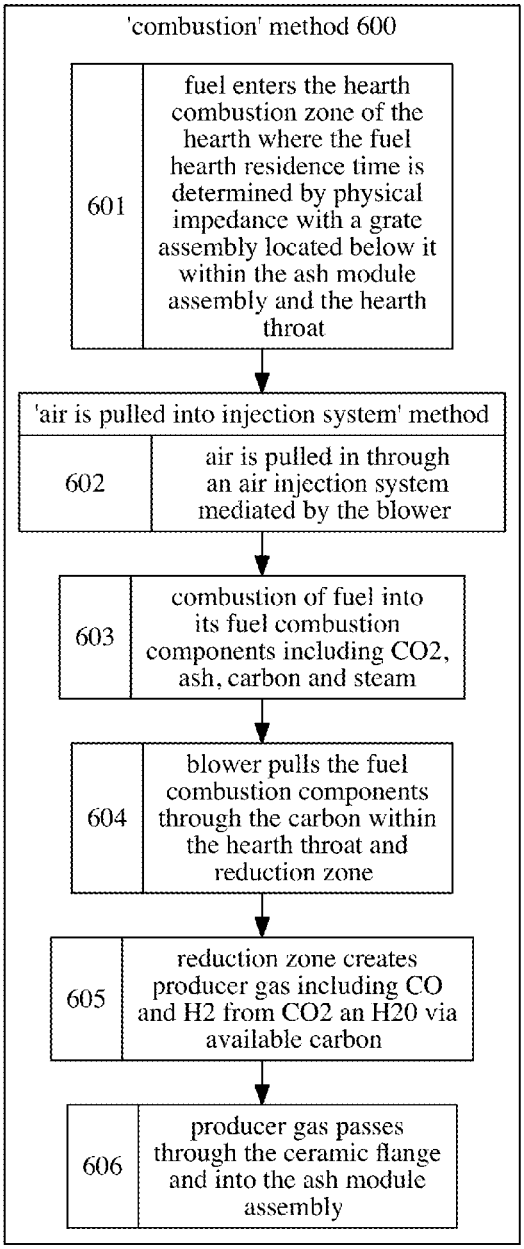
FIG. 7 is a diagram view which shows method for combustion.
Figure 8:
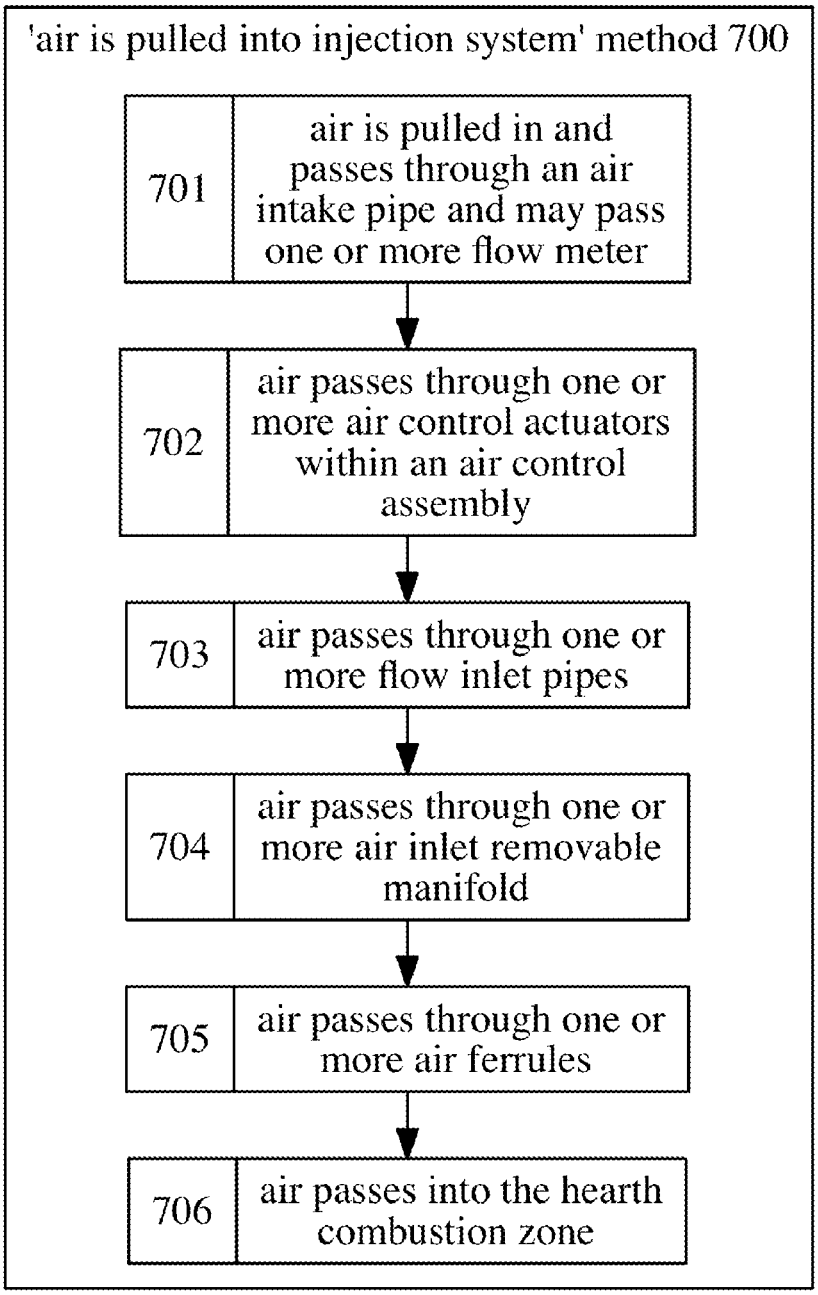
FIG. 8 is a diagram view which shows method for air being pulled into the injection system.
Figure 9:
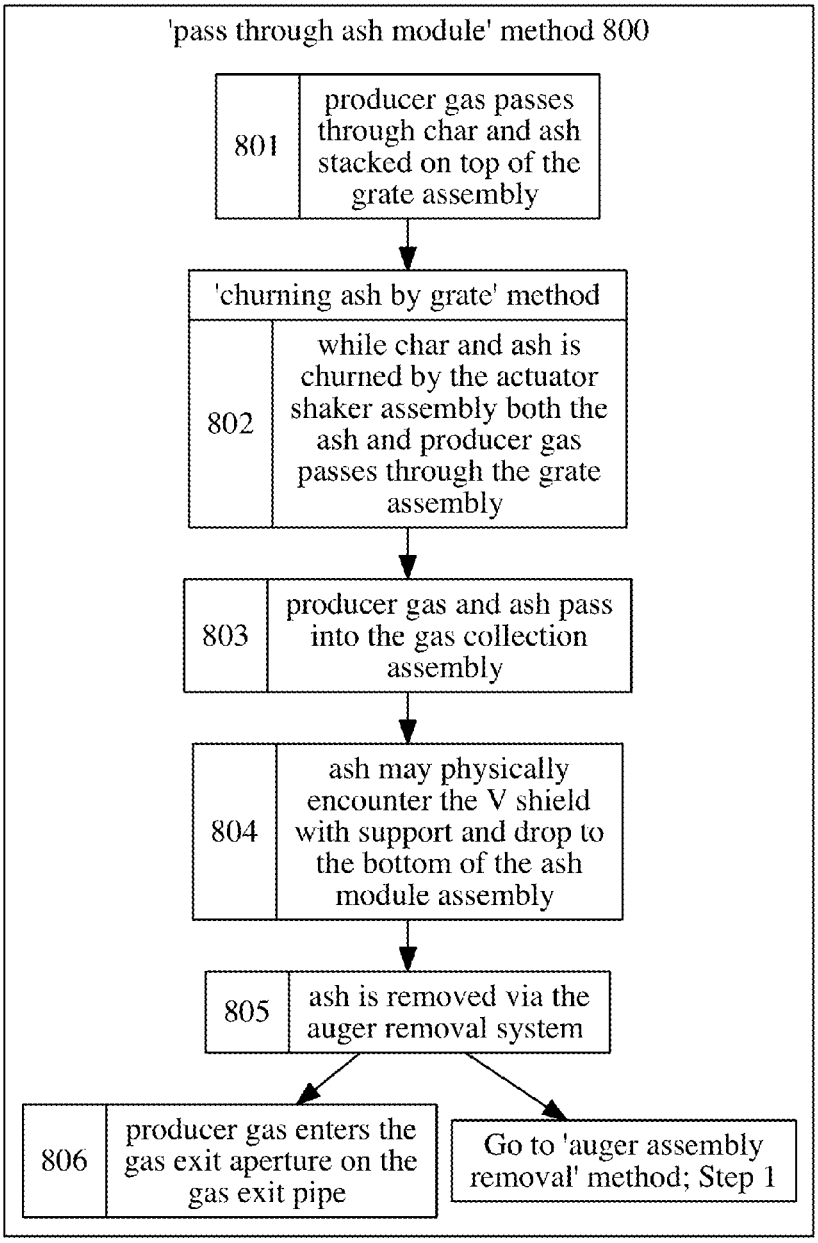
FIG. 9 is a diagram view which shows method for gas passing through the ash module.
Figure 10:
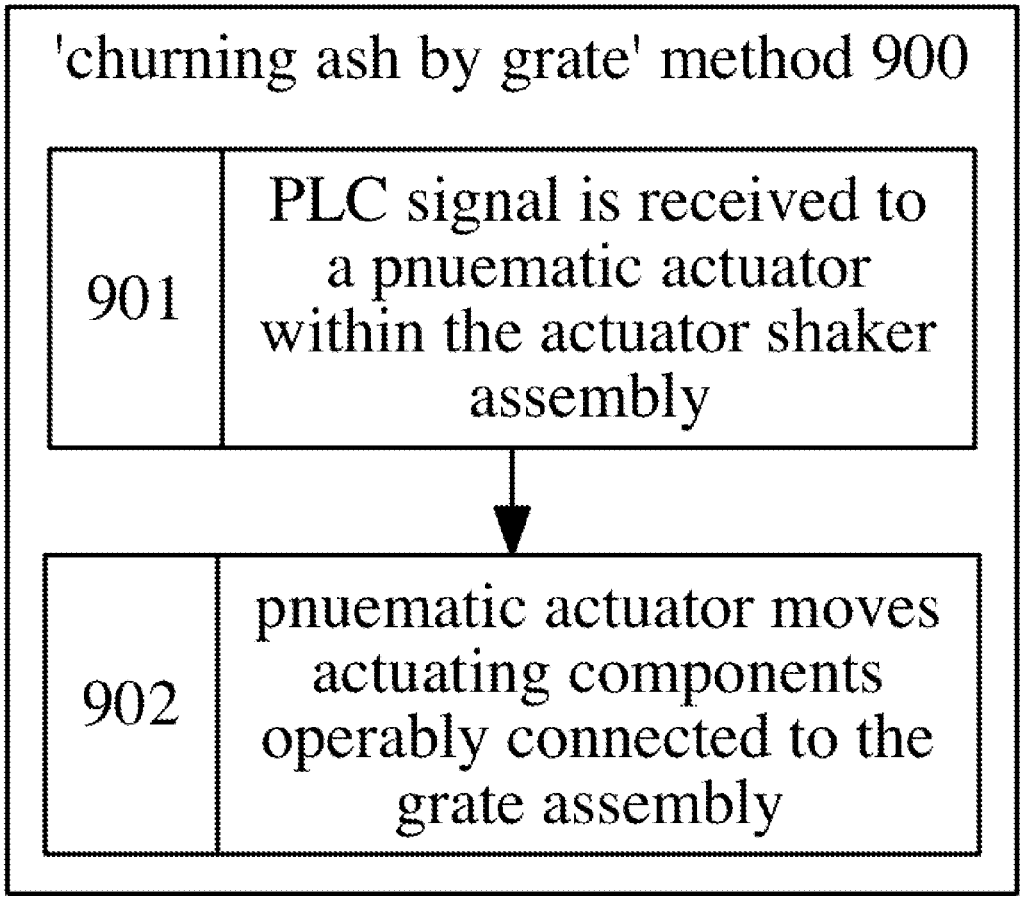
FIG. 10 is a diagram view which shows method for churning the ash by the grate.
Figure 11:
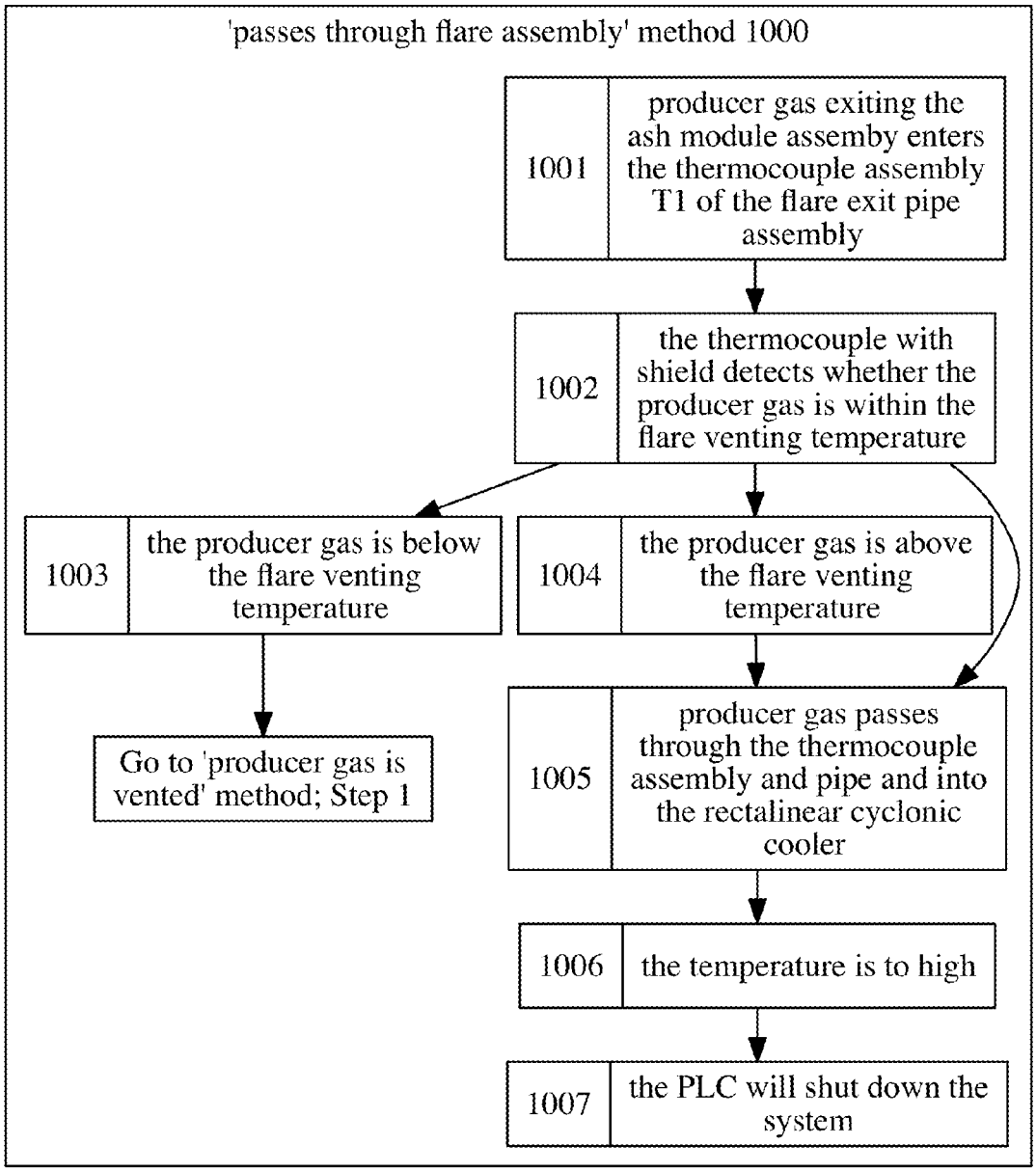
FIG. 11 is a diagram view which shows method for gas passing through the assembly.
Figure 12:
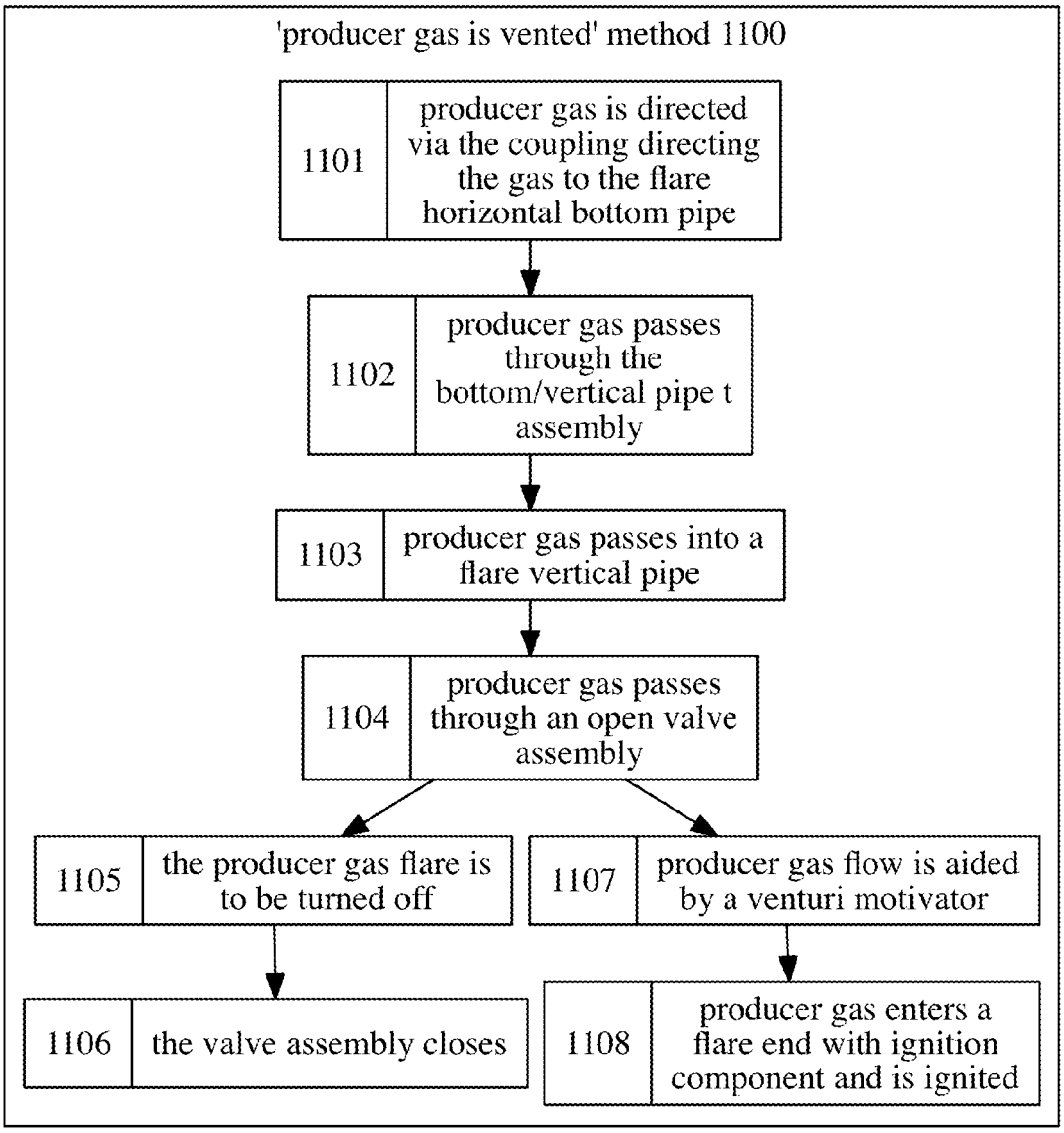
FIG. 12 is a diagram view which shows method for producer gas being vented.
Figure 13:
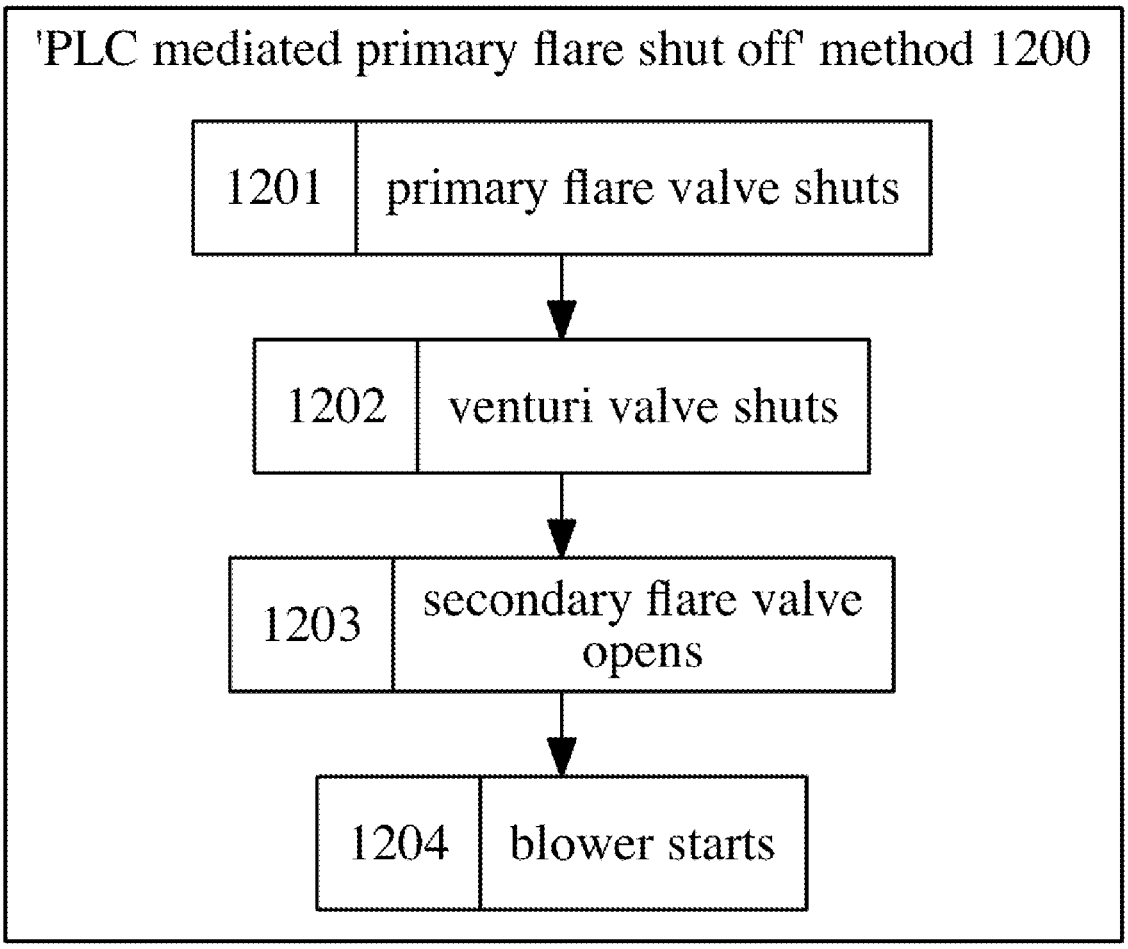
FIG. 13 is a diagram view which shows method for PLC-mediated primary flare shut off.
Figure 14:
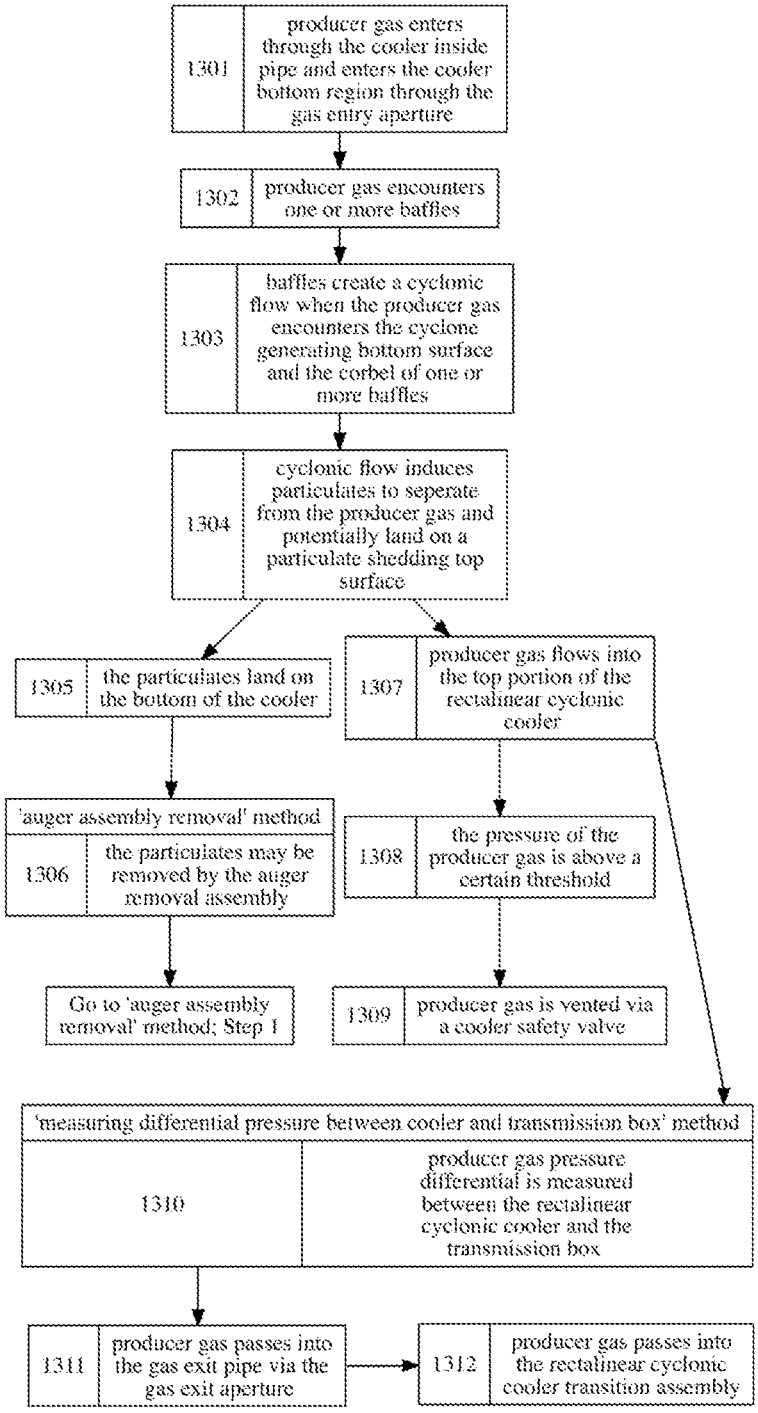
FIG. 14 is a diagram view which shows method for producer gas going through the cooler.
Figure 15:
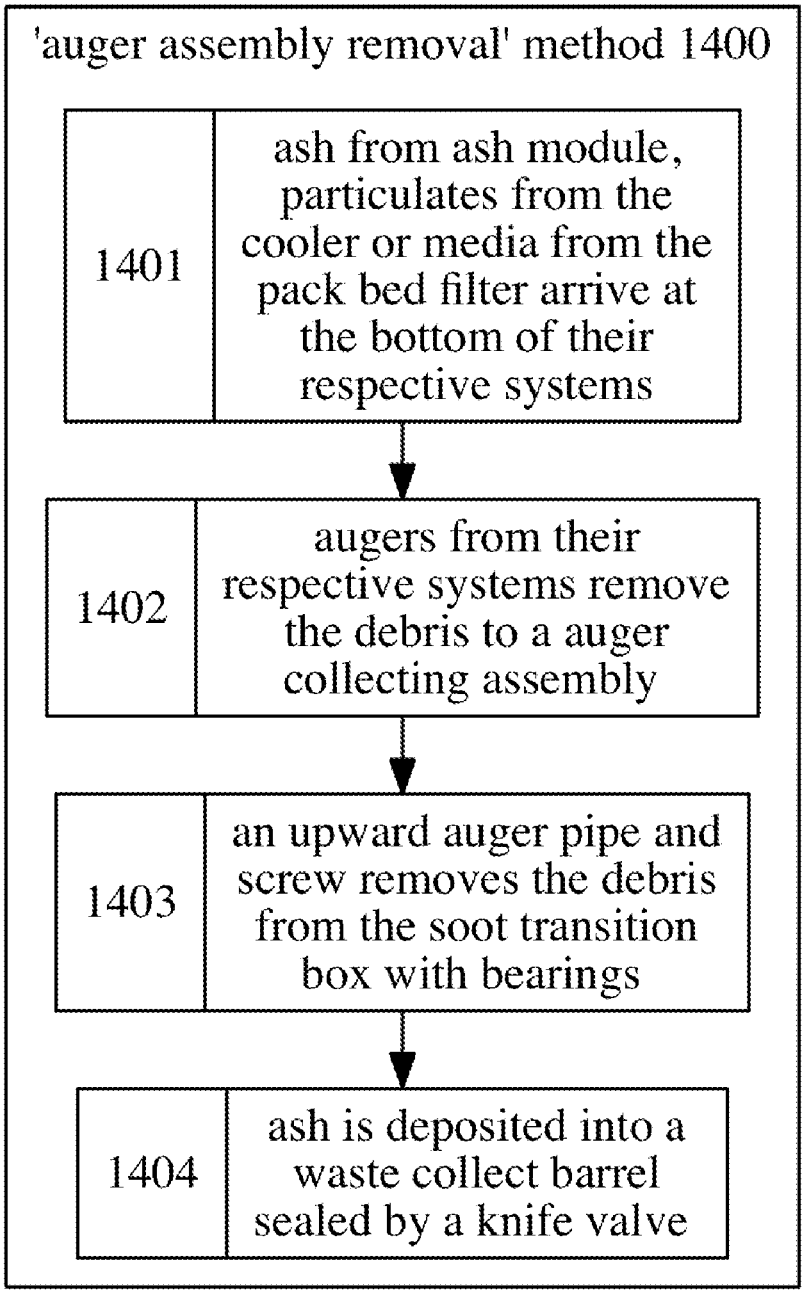
FIG. 15 is a diagram view which shows method for auger assembly removal.
Figure 16:
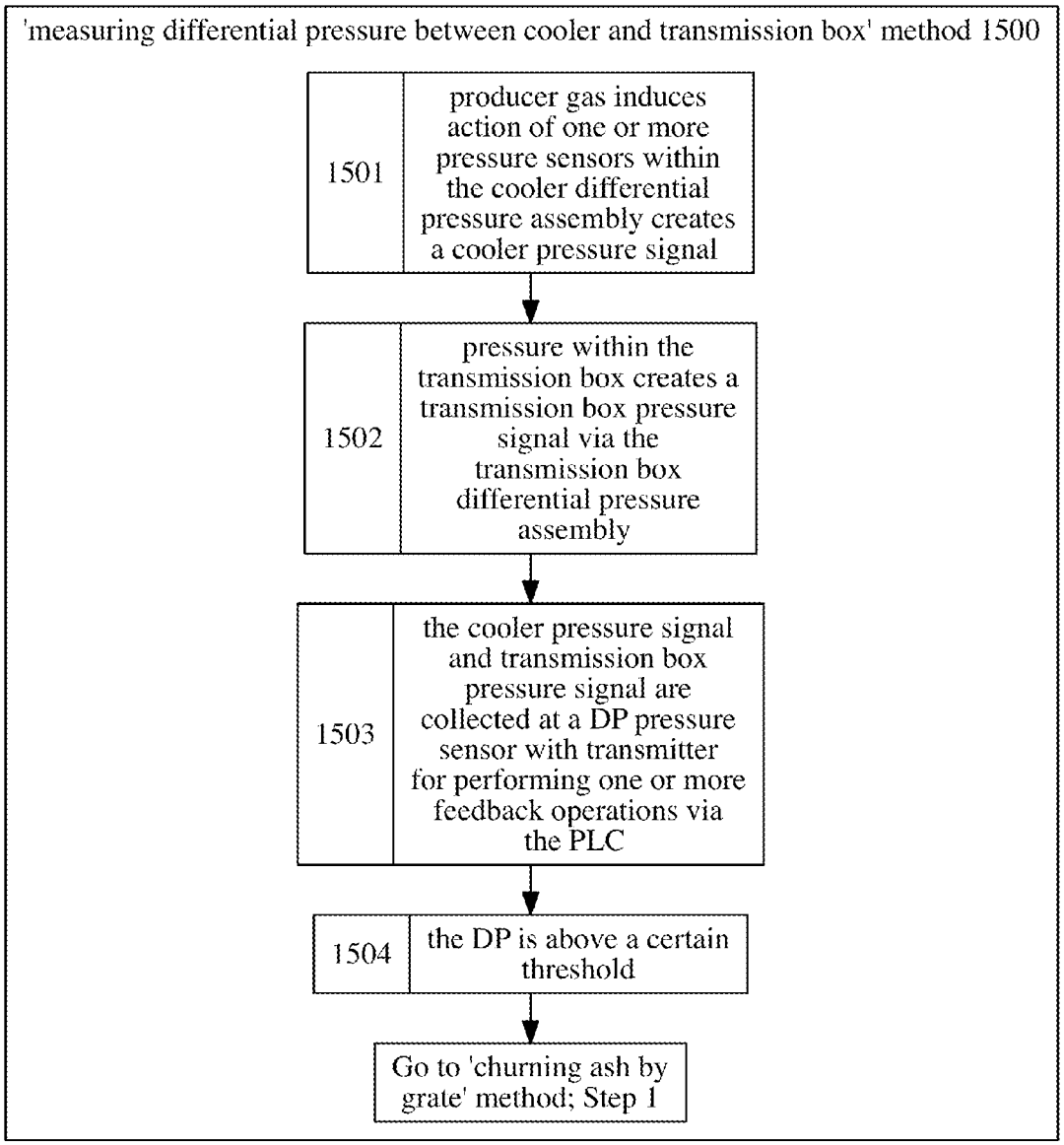
FIG. 16 is a diagram view which shows method for measuring differential pressure between the cooler and transition box.
Figure 17:
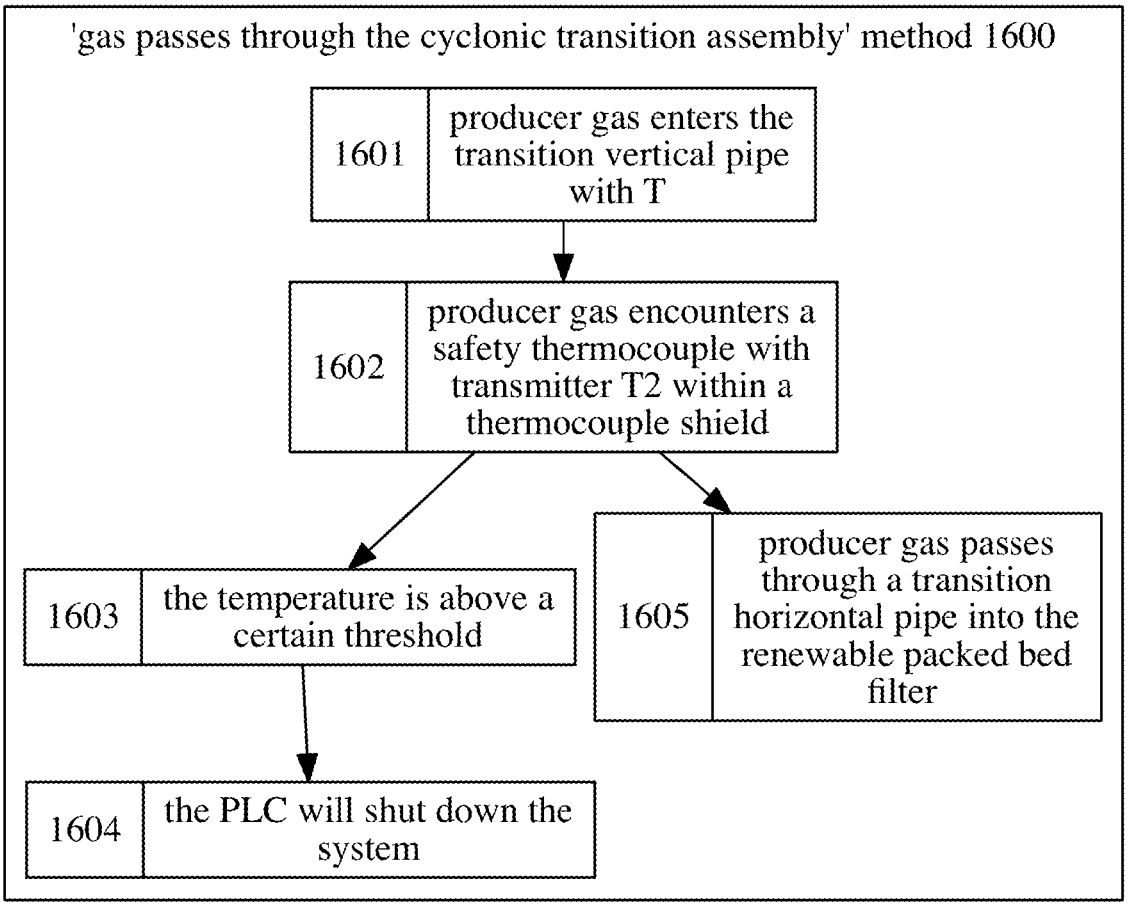
FIG. 17 is a diagram view which shows method for gas passing through the cyclonic transition assembly.
Figure 18:
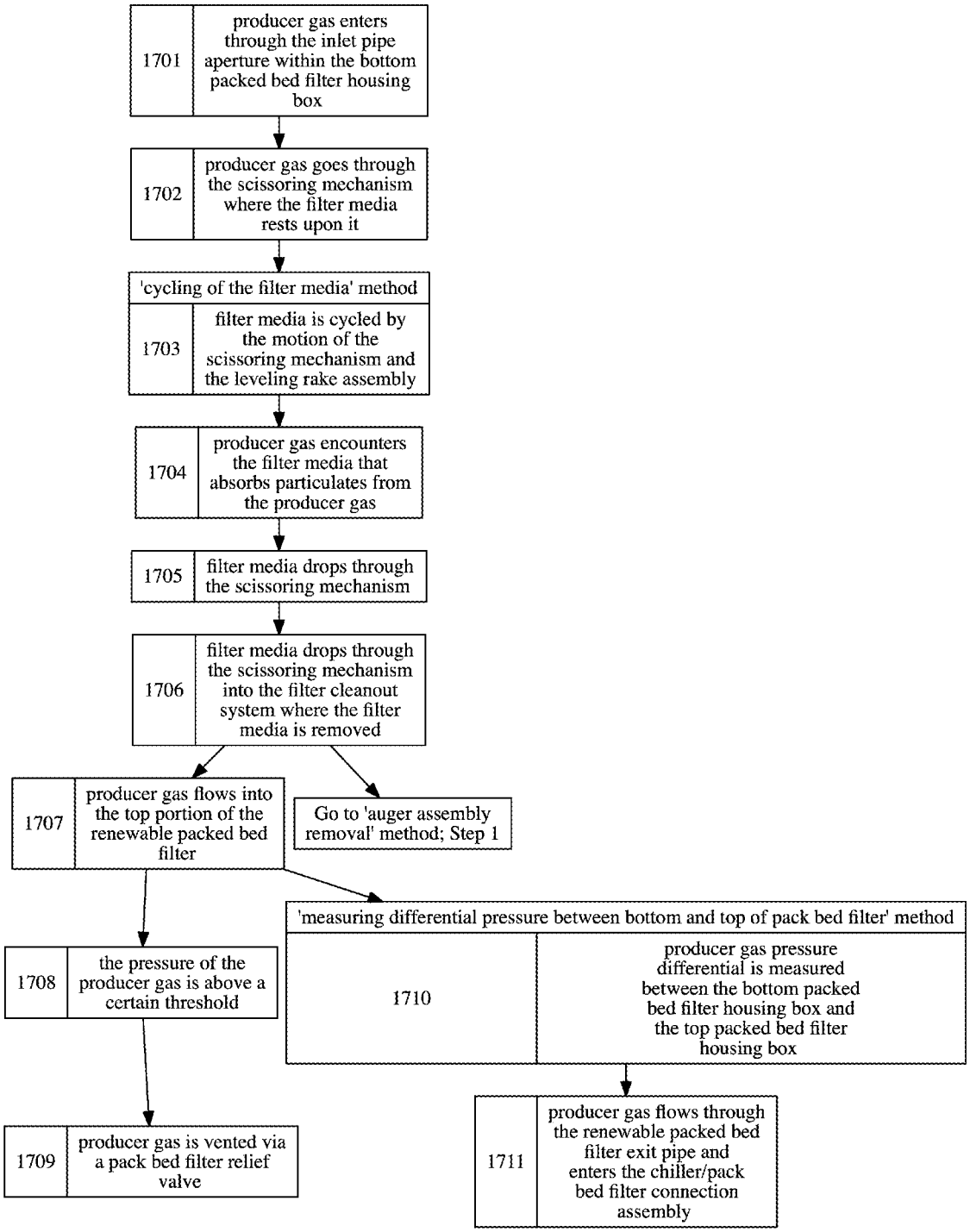
FIG. 18 is a diagram view which shows method for gas passing through the renewable packed bed filter.
Figure 19:
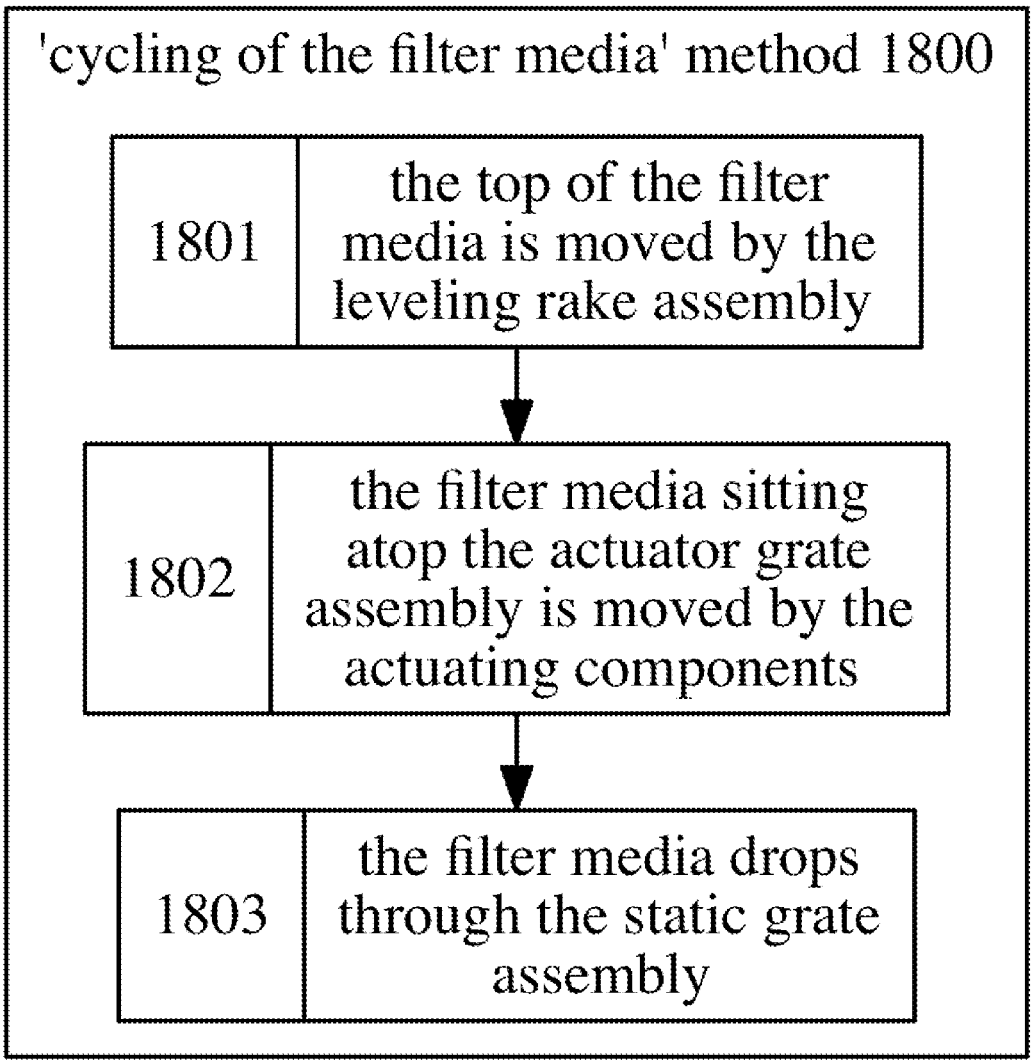
FIG. 19 is a diagram view which shows method for cycling of the filter media.
Figure 20:
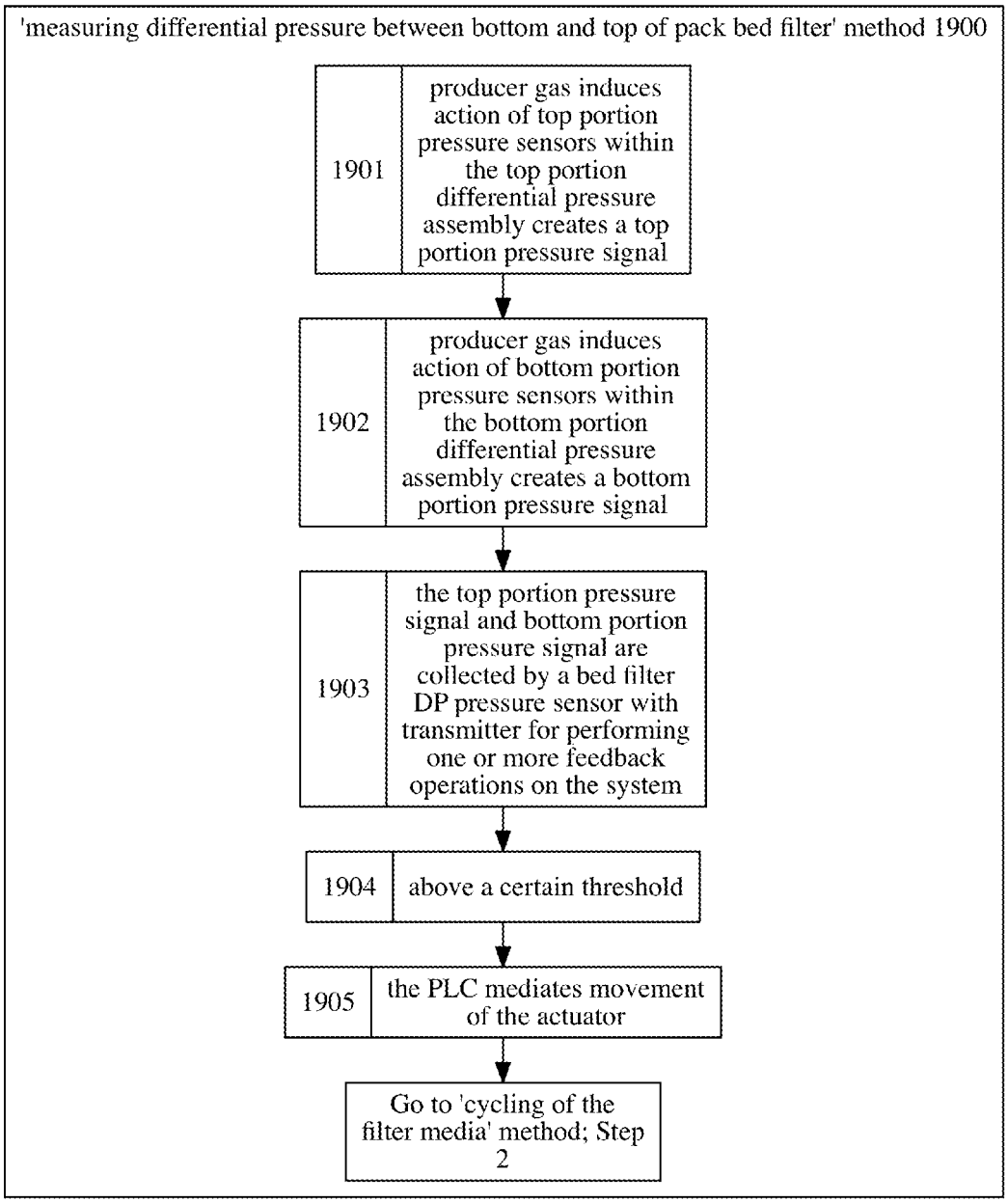
FIG. 20 is a diagram view which shows method for measuring differential pressure between the bottom and top of the packed bed filter.
Figure 21:
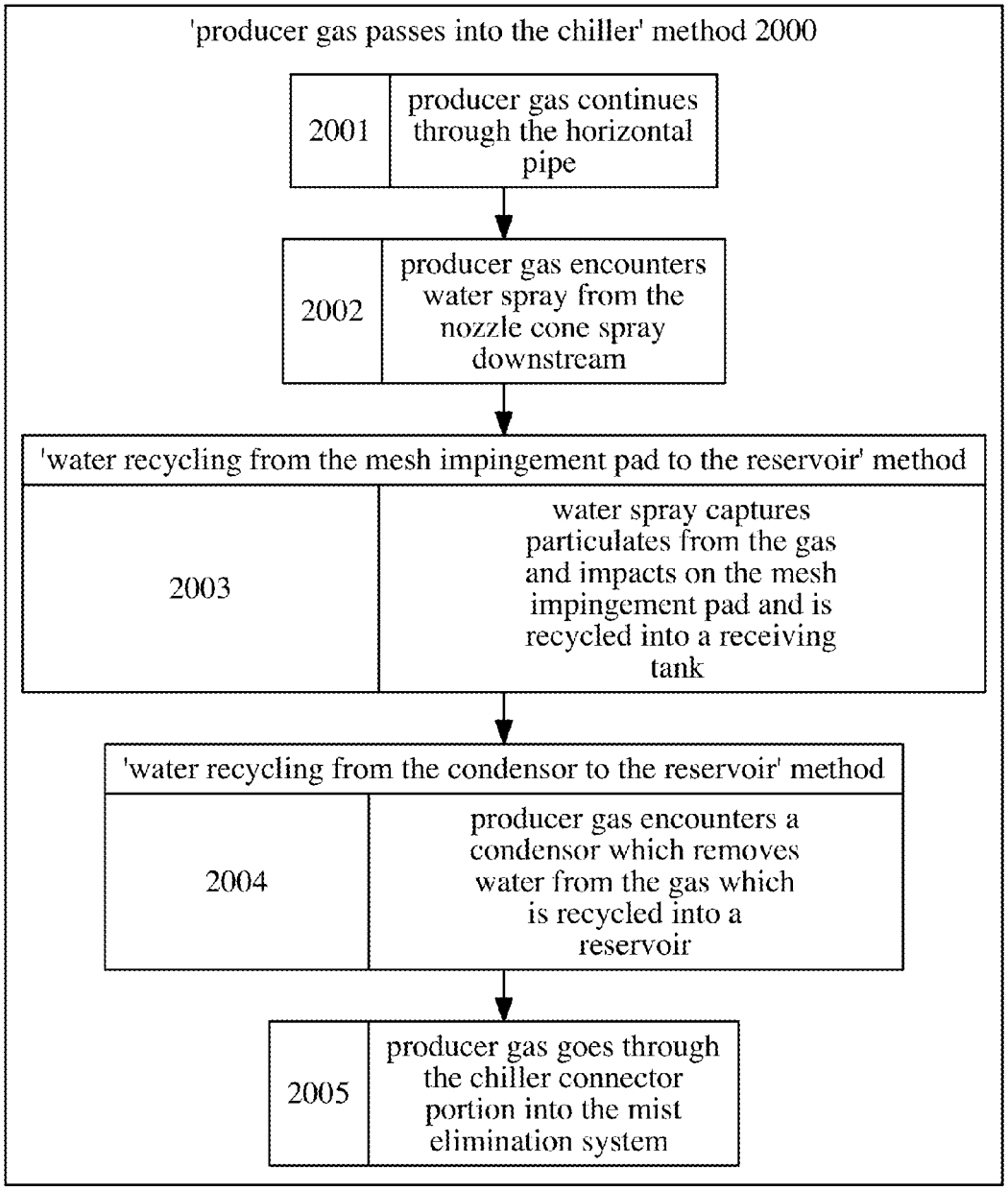
FIG. 21 is a diagram view which shows method for producer gas passing into the chiller.
Figure 22:
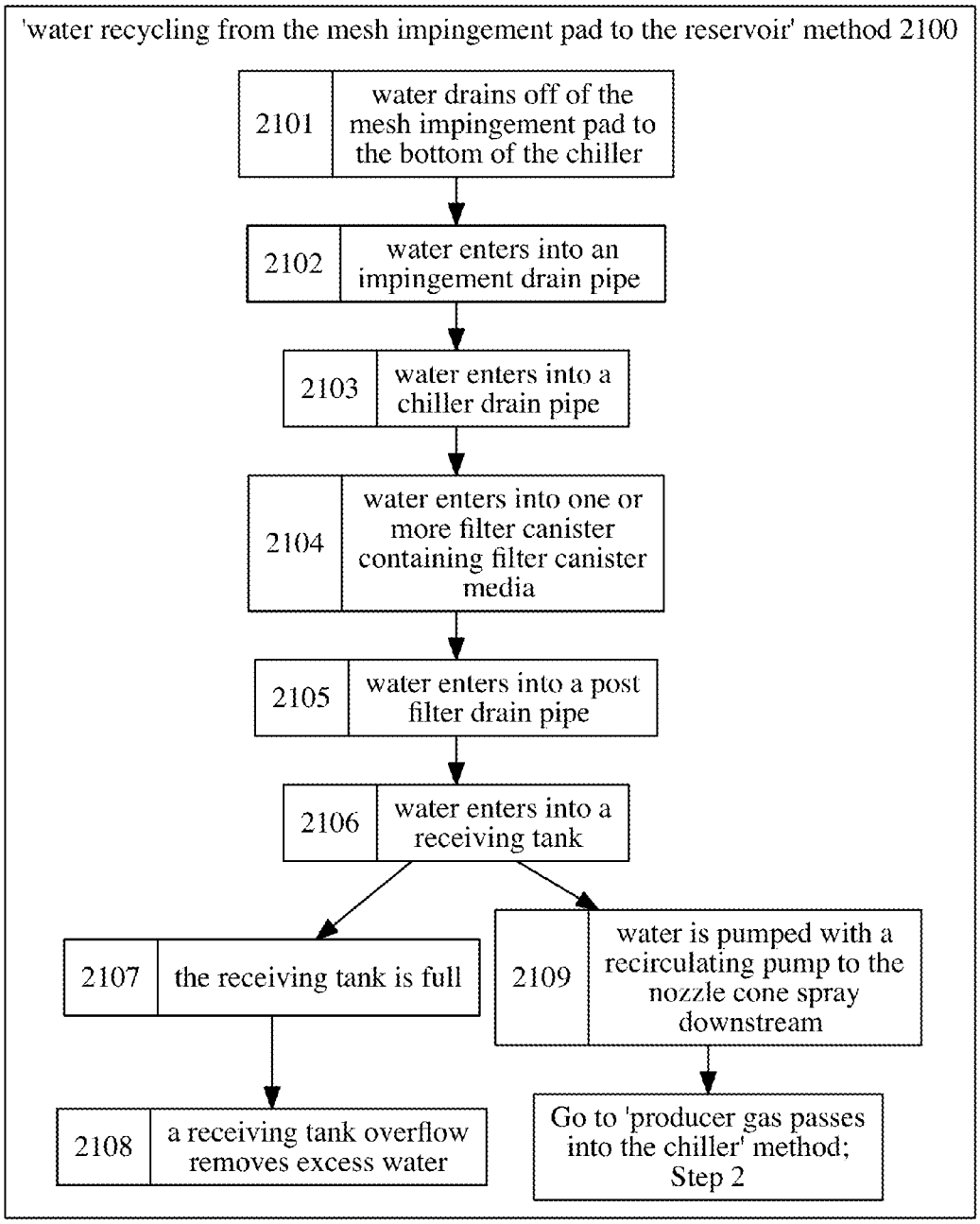
FIG. 22 is a diagram view which shows method for water recycling from the mesh impingement pad to the reservoir.
Figure 23:
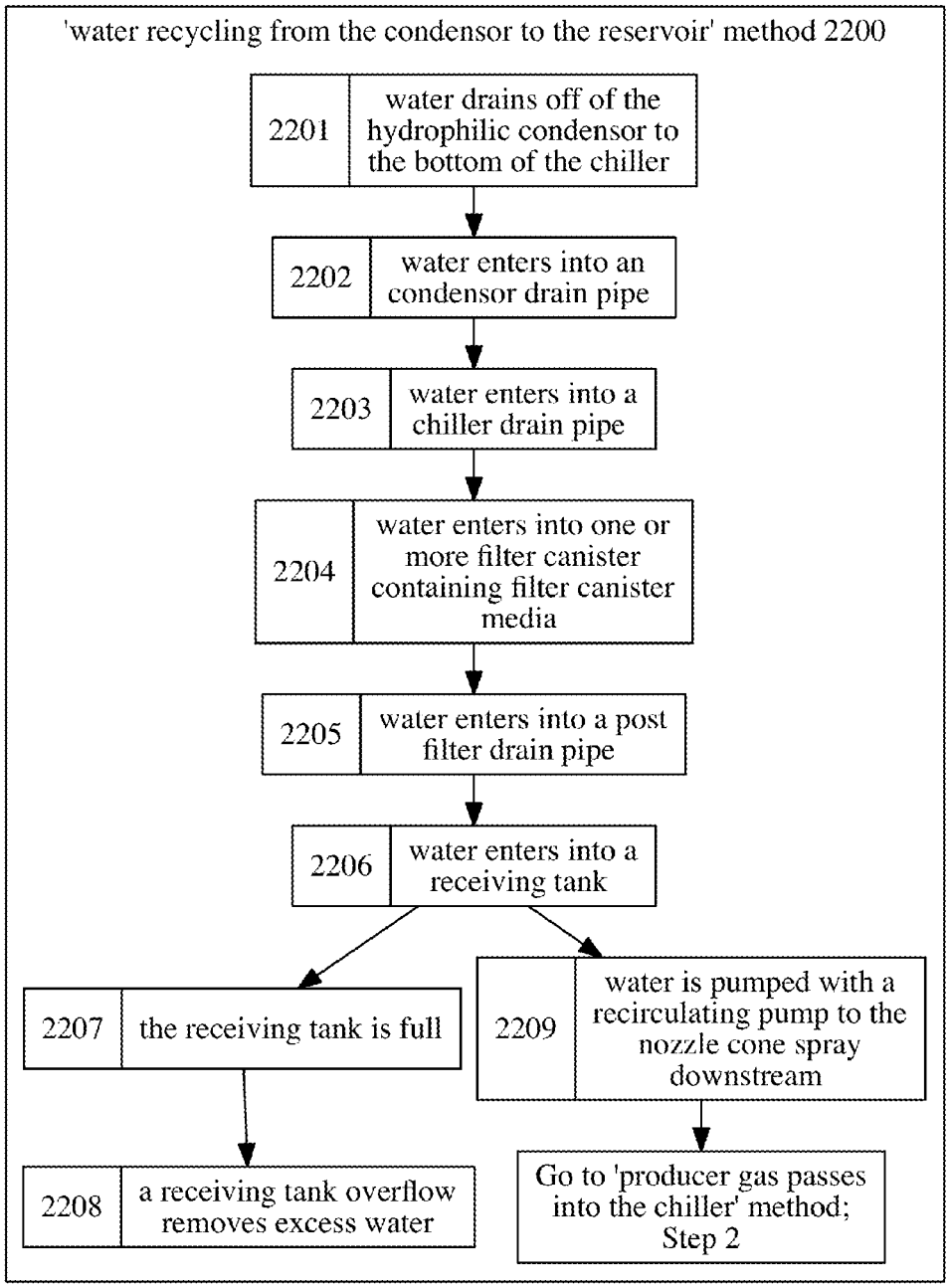
FIG. 23 is a diagram view which shows method for water recycling from the condenser to the reservoir.
Figure 24:
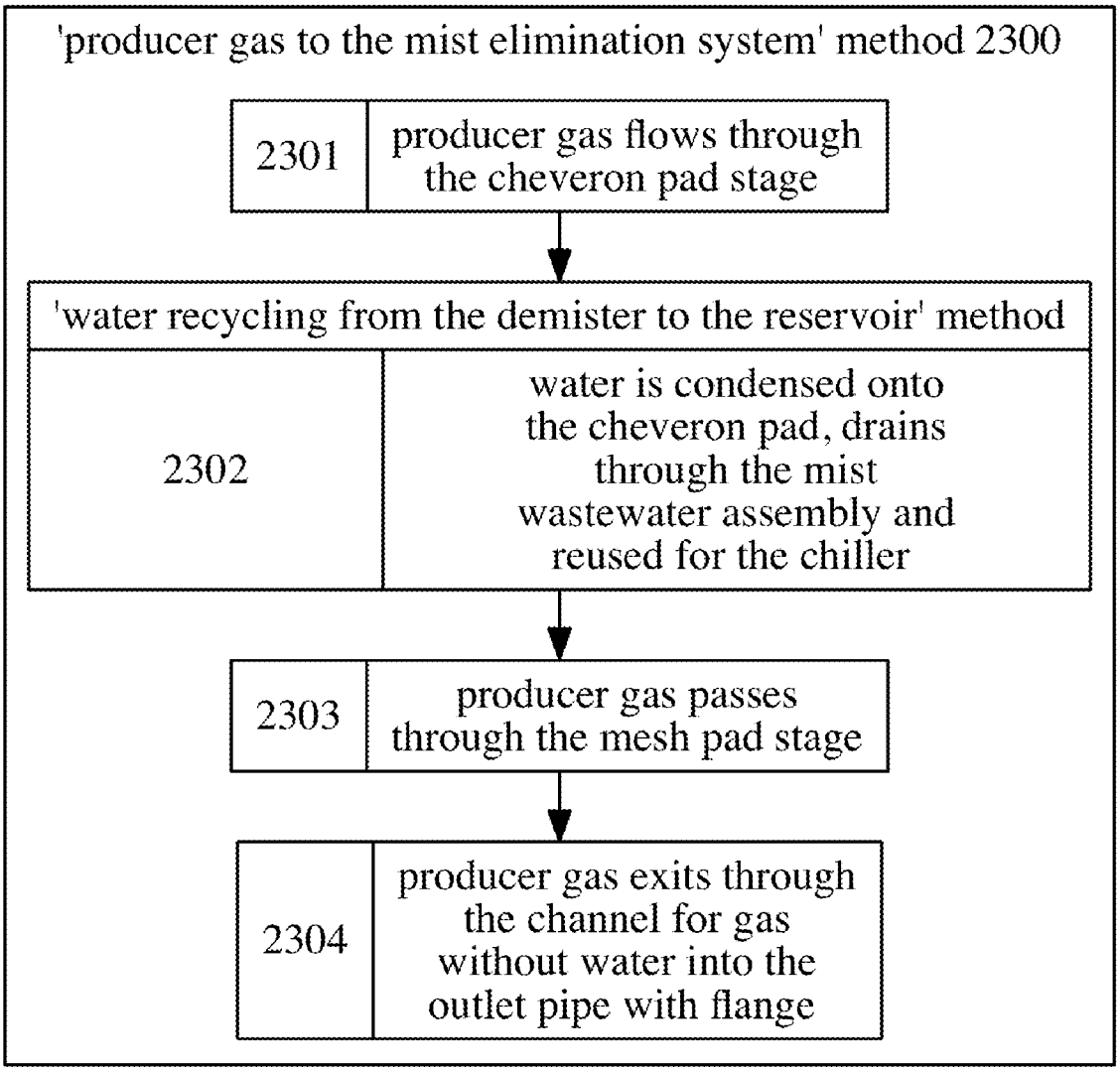
FIG. 24 is a diagram view which shows method for producer gas going through the elimination system.
Figure 25:
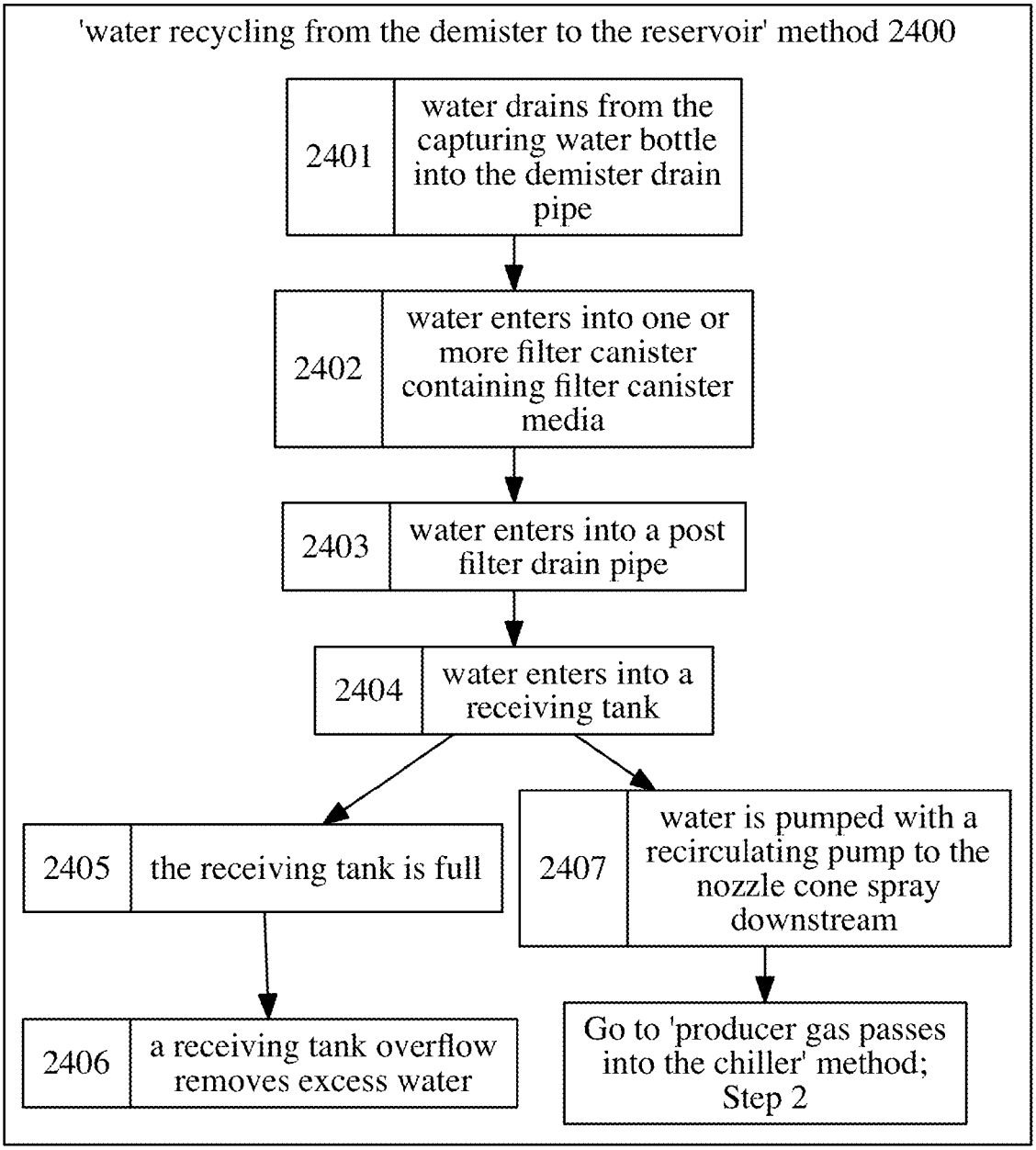
FIG. 25 is a diagram view which shows method for water recycling from the mist elimination system to the reservoir.
Figure 26:
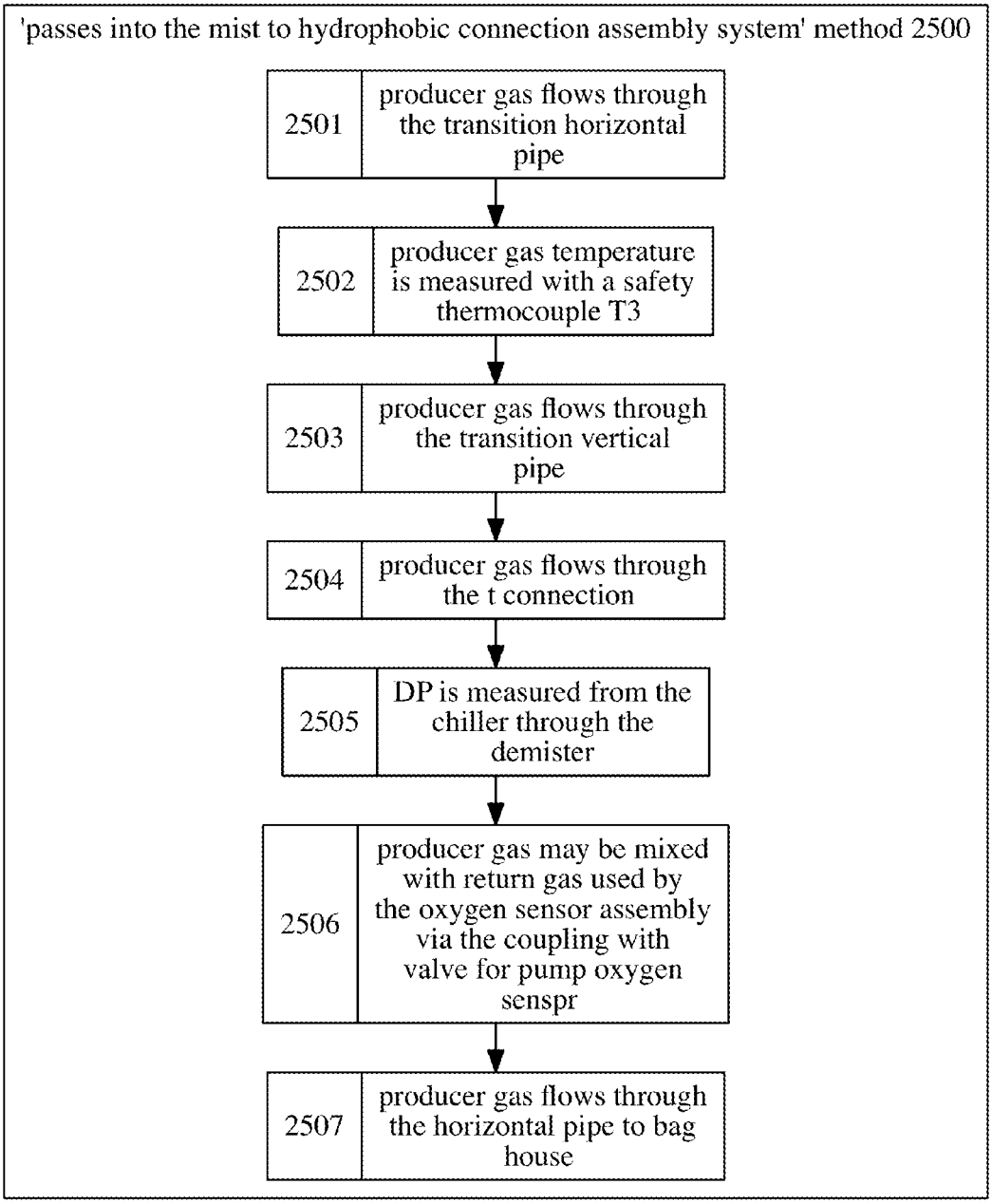
FIG. 26 is a diagram view which shows method for gas passing into the mist to hydrophobic connection assembly system.
Figure 27:
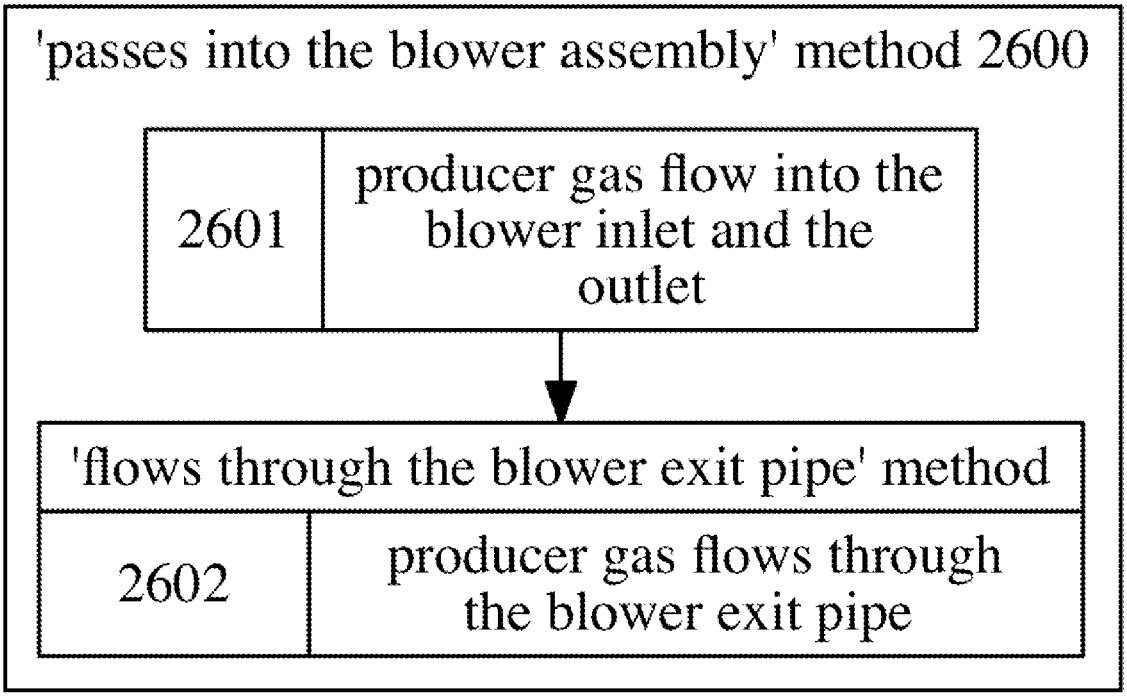
FIG. 27 is a diagram view which shows method for gas passing through the blower assembly.
Figure 28:
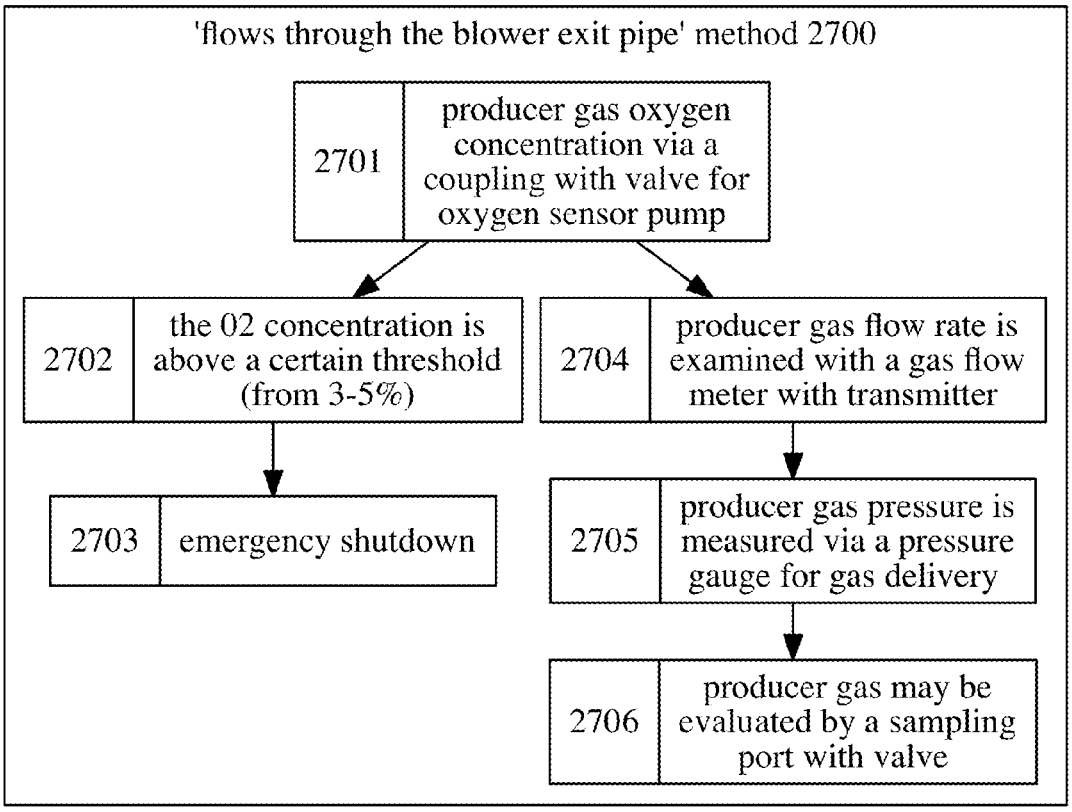
FIG. 28 is a diagram view which shows method for gas flowing through the exit pipe.
Figure 29:
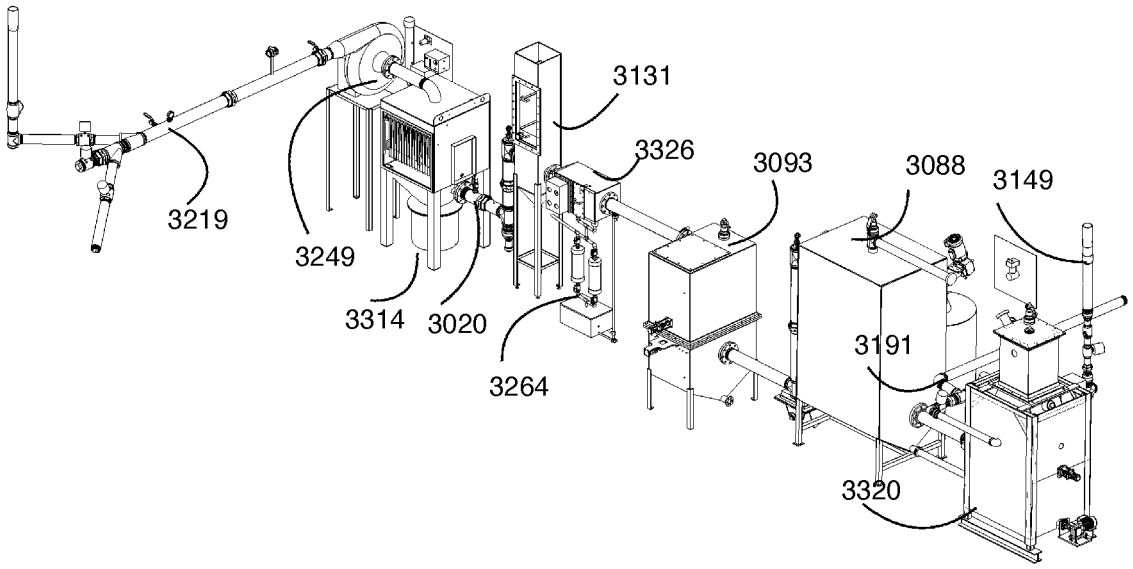
FIG. 29 is a perspective view which shows the gasifier system.
Figure 30:
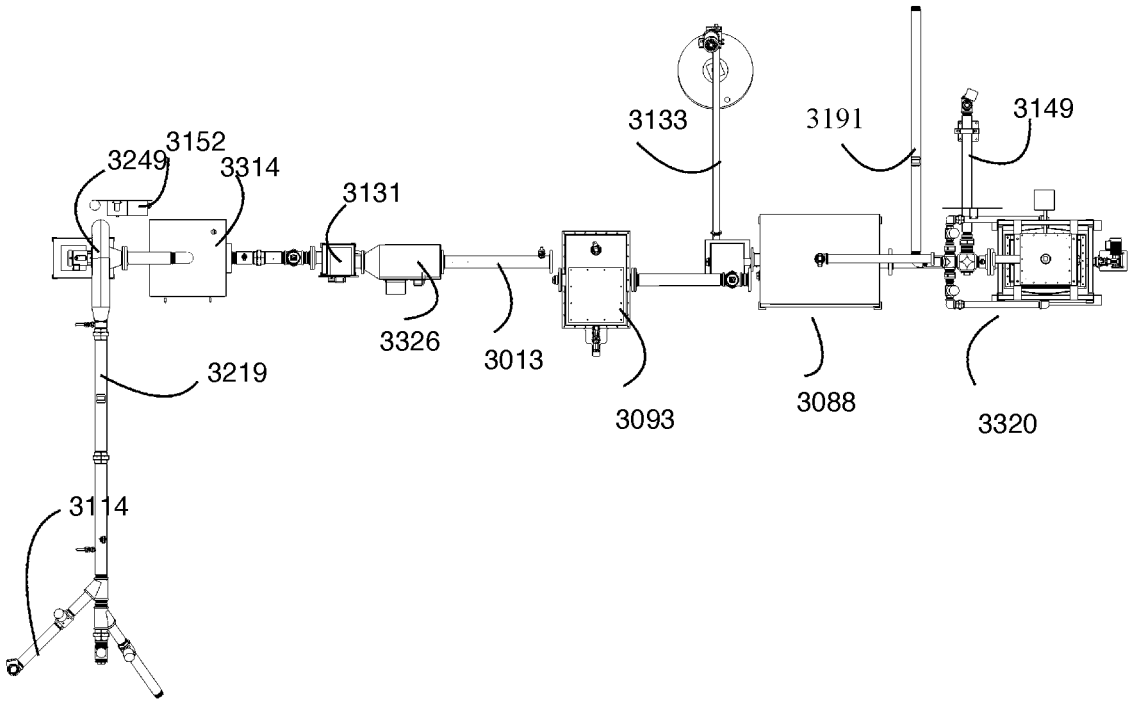
FIG. 30 is a birds eye view which shows the arrangement of the biogasifier system.
Figure 31:
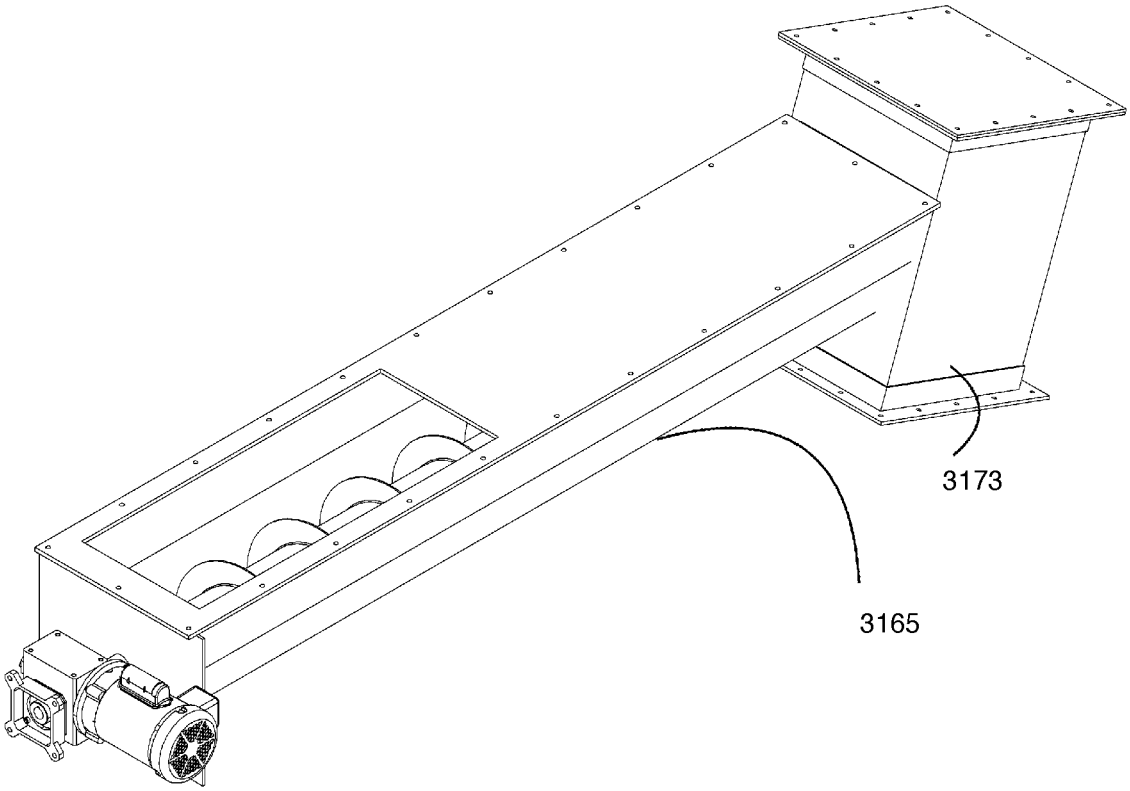
FIG. 31 is a perspective view which shows an embodiment of a fuel transport system.
Figure 32:
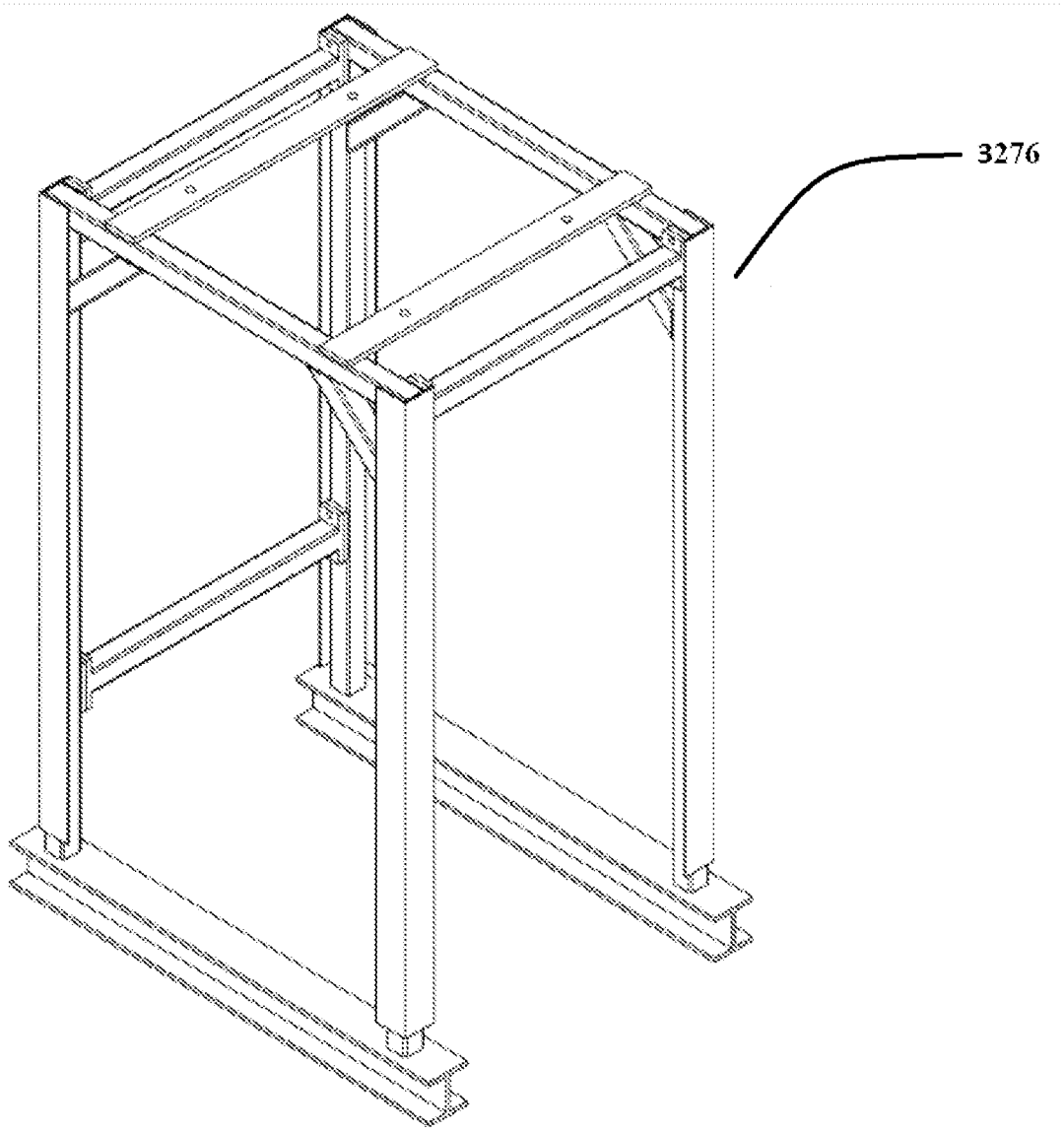
FIG. 32 is a perspective view which shows the gasifier frame.
Figure 33:
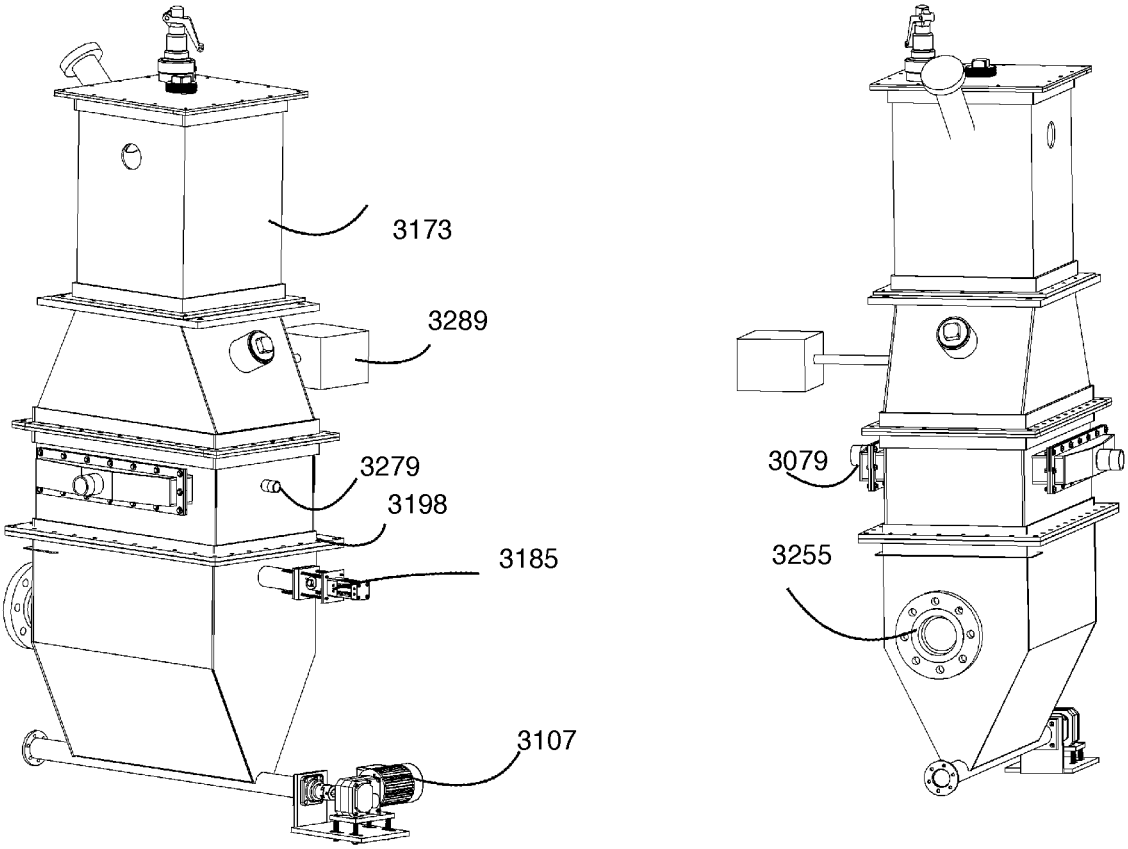
FIG. 33 is a perspective view which shows the gasifier.
Figure 34:
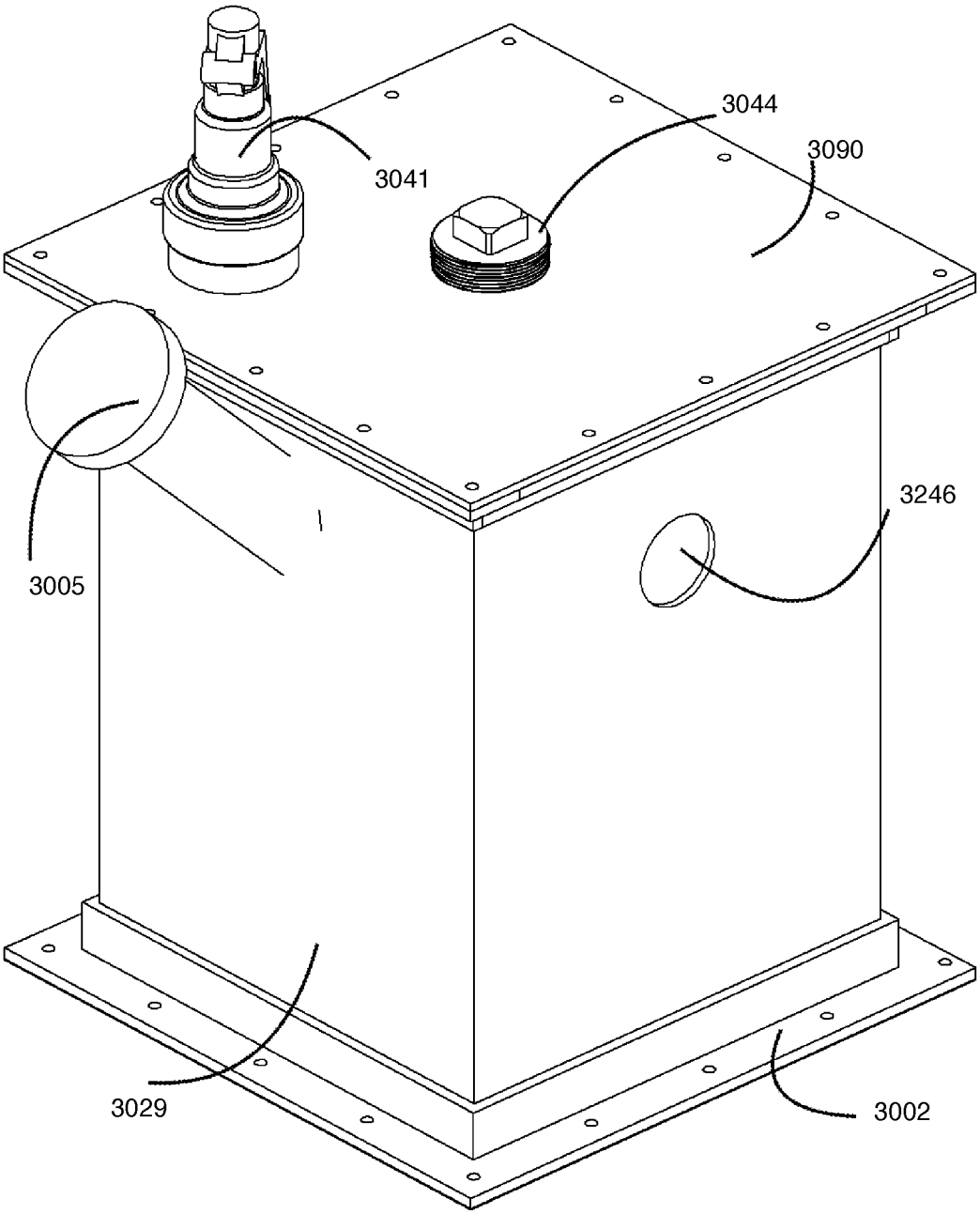
FIG. 34 is a perspective view which shows the transition box.
Figure 35:
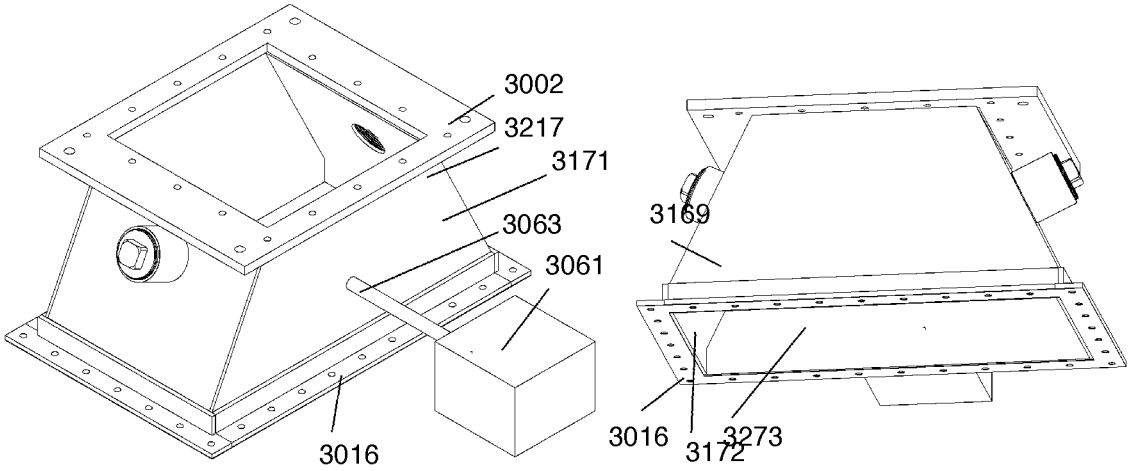
FIG. 35 is a perspective view which shows the fuel level sensor and hopper.
Figure 36:
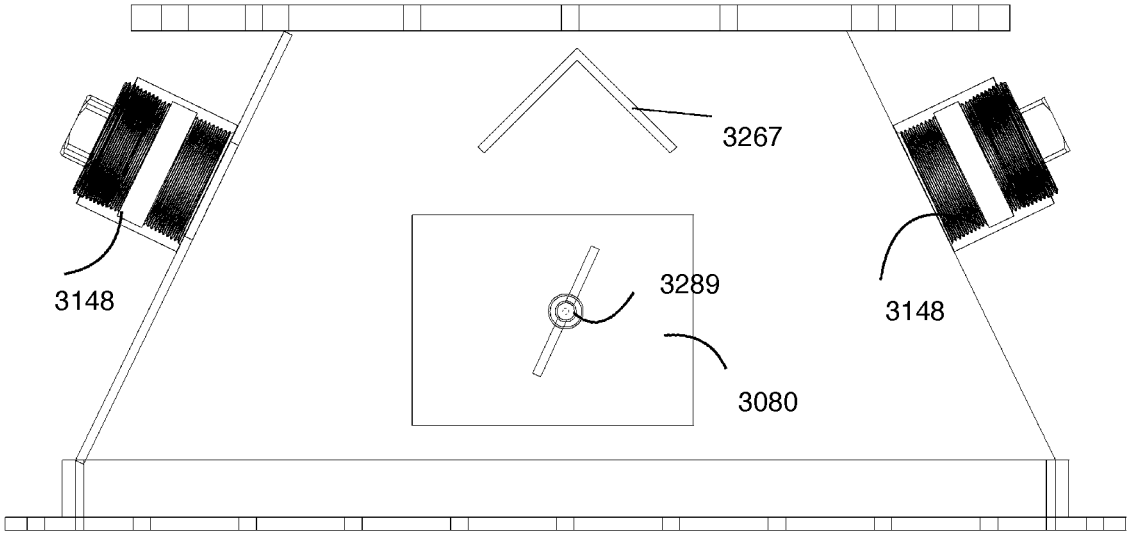
FIG. 36 is a cross section view which shows the fuel level sensor and hopper with baffles.
Figure 37:
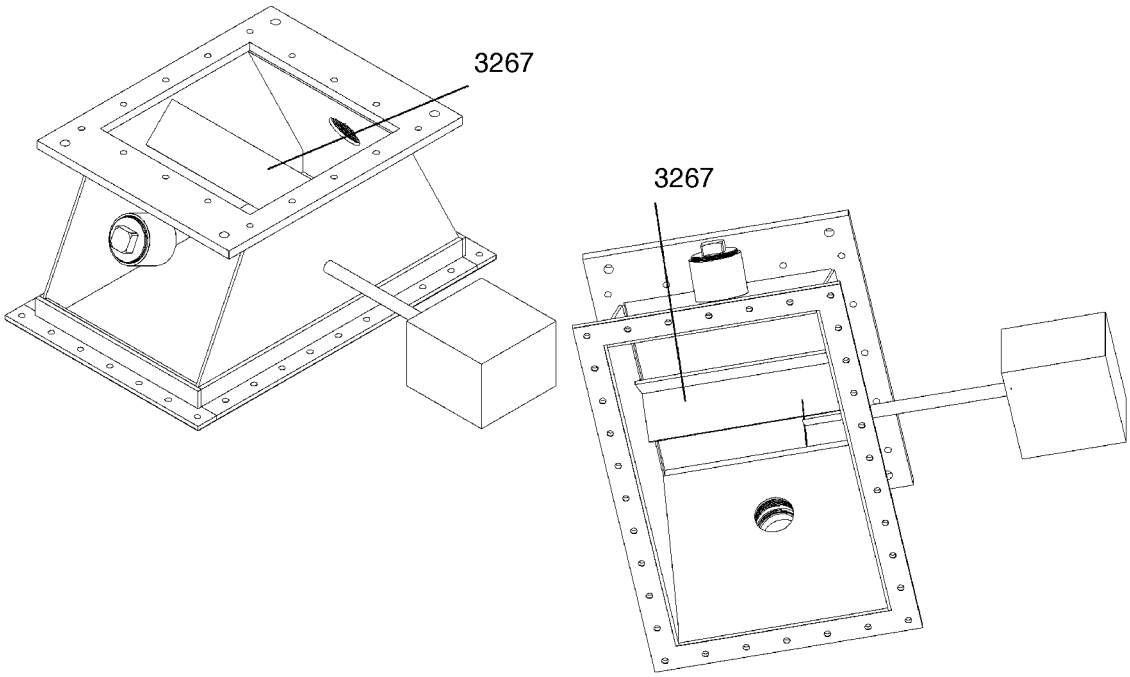
FIG. 37 is a perspective view which shows the fuel level sensor and hopper with baffles.
Figure 38:
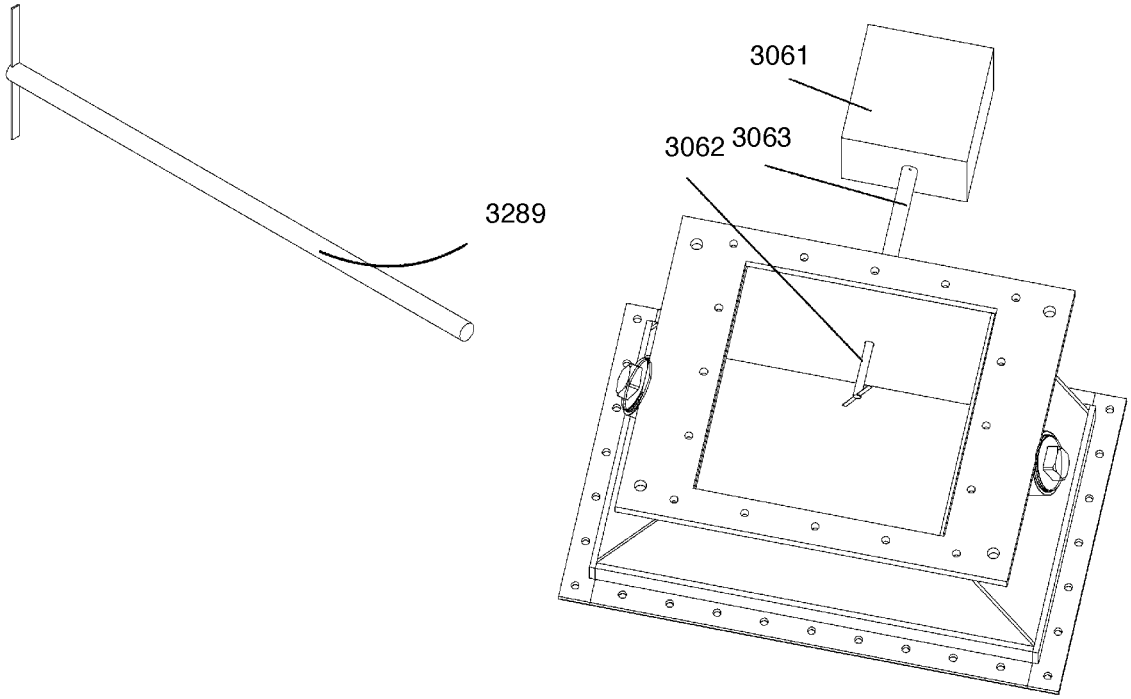
FIG. 38 is a perspective view which shows the fuel level sensor and hopper.
Figure 39:
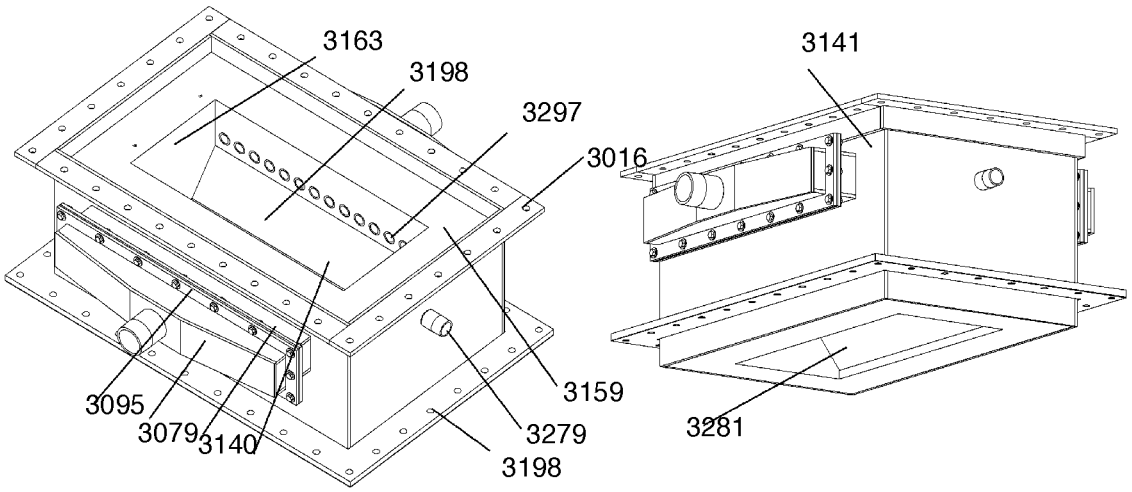
FIG. 39 is a perspective view which shows the hearth.
Figure 40:
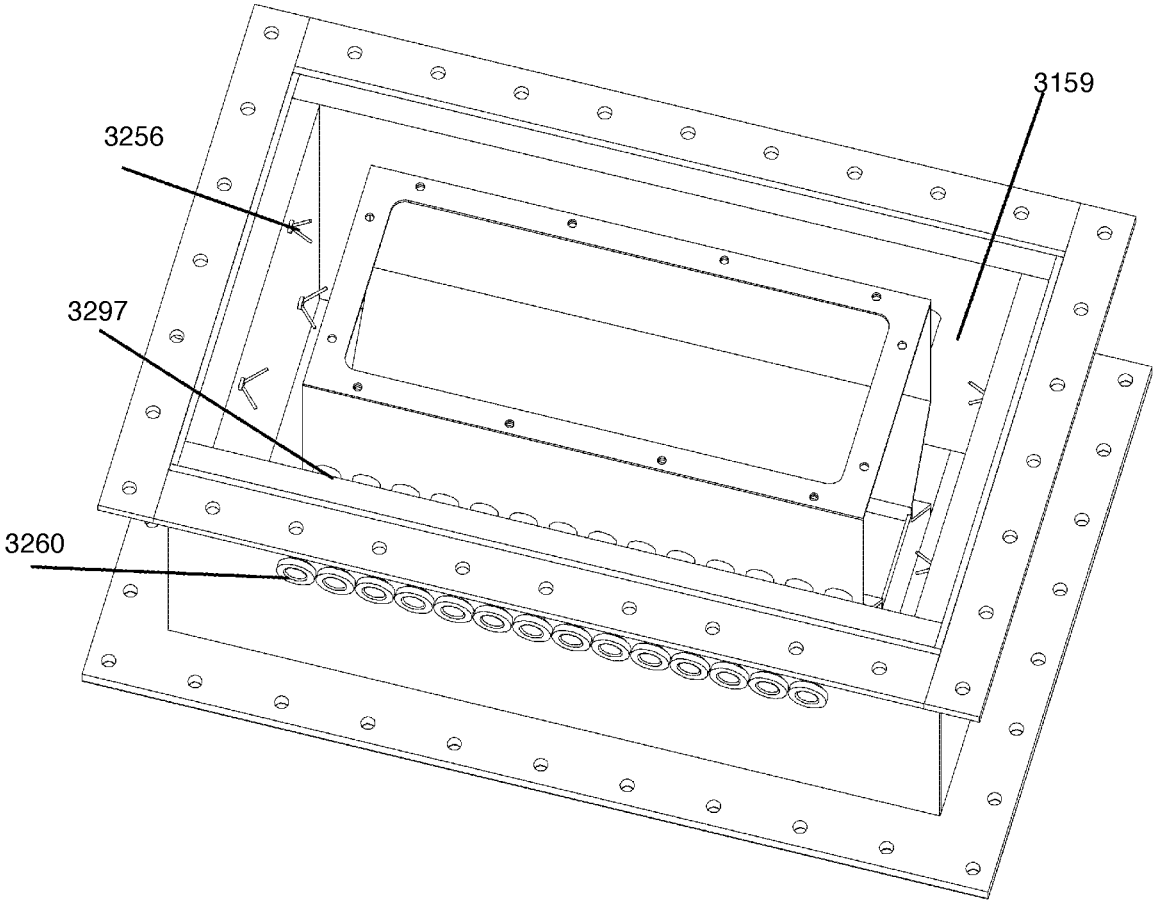
FIG. 40 is a perspective view which shows the hearth prior to pouring the ceramic.
Figure 41:
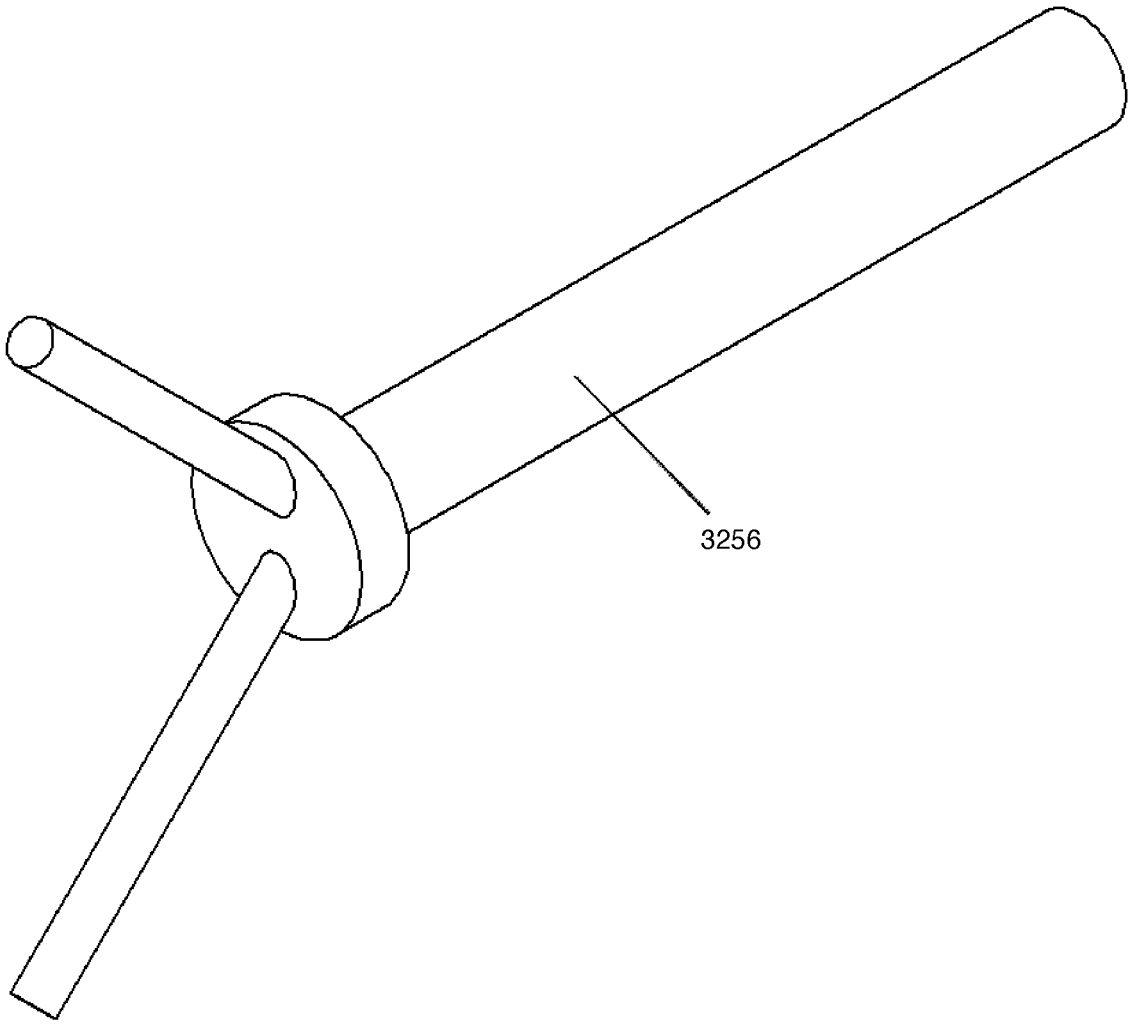
FIG. 41 is a perspective view which shows an Inconel anchor.
Figure 42:
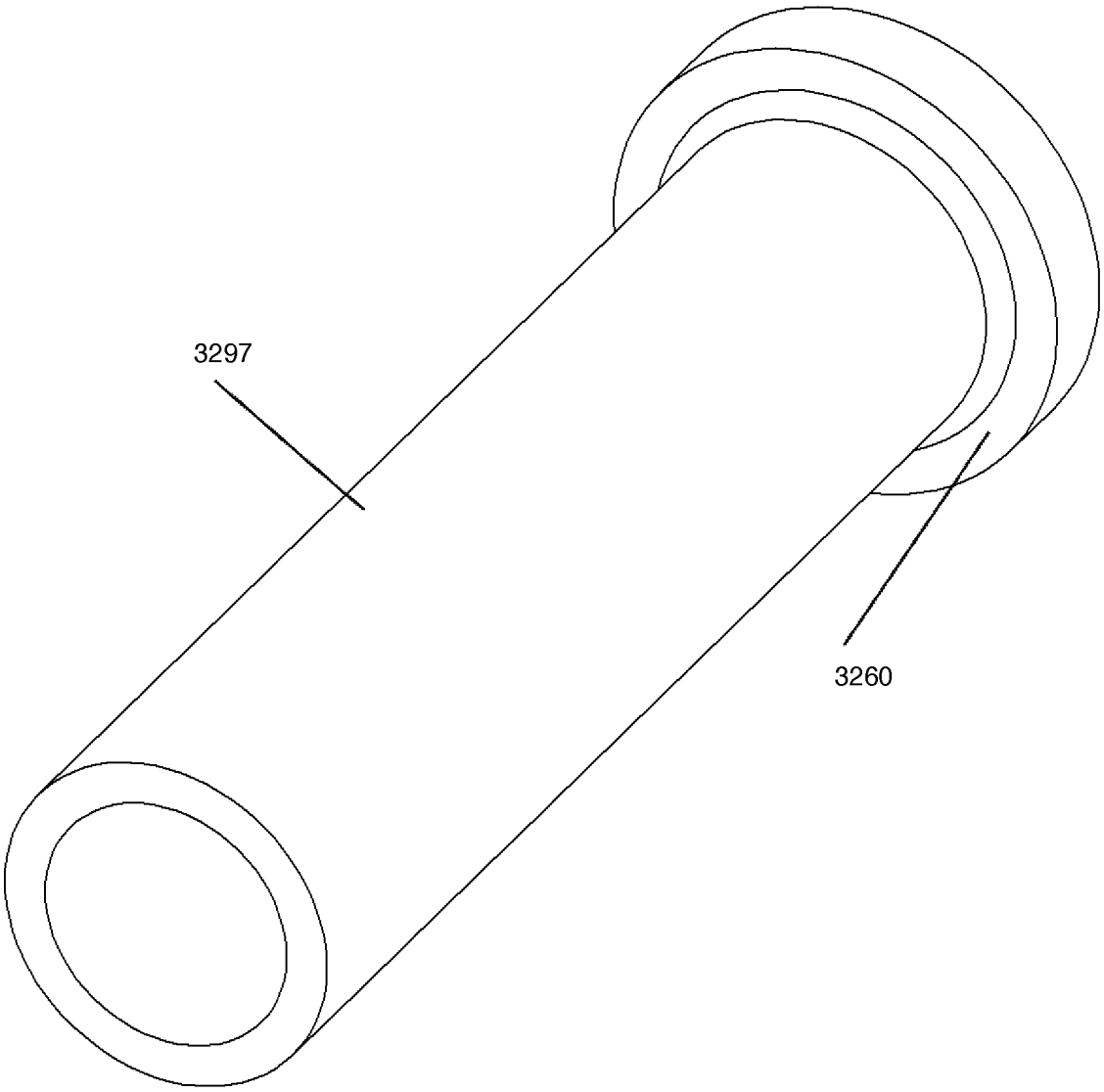
FIG. 42 is a perspective view which shows an air ferrule.
Figure 43:
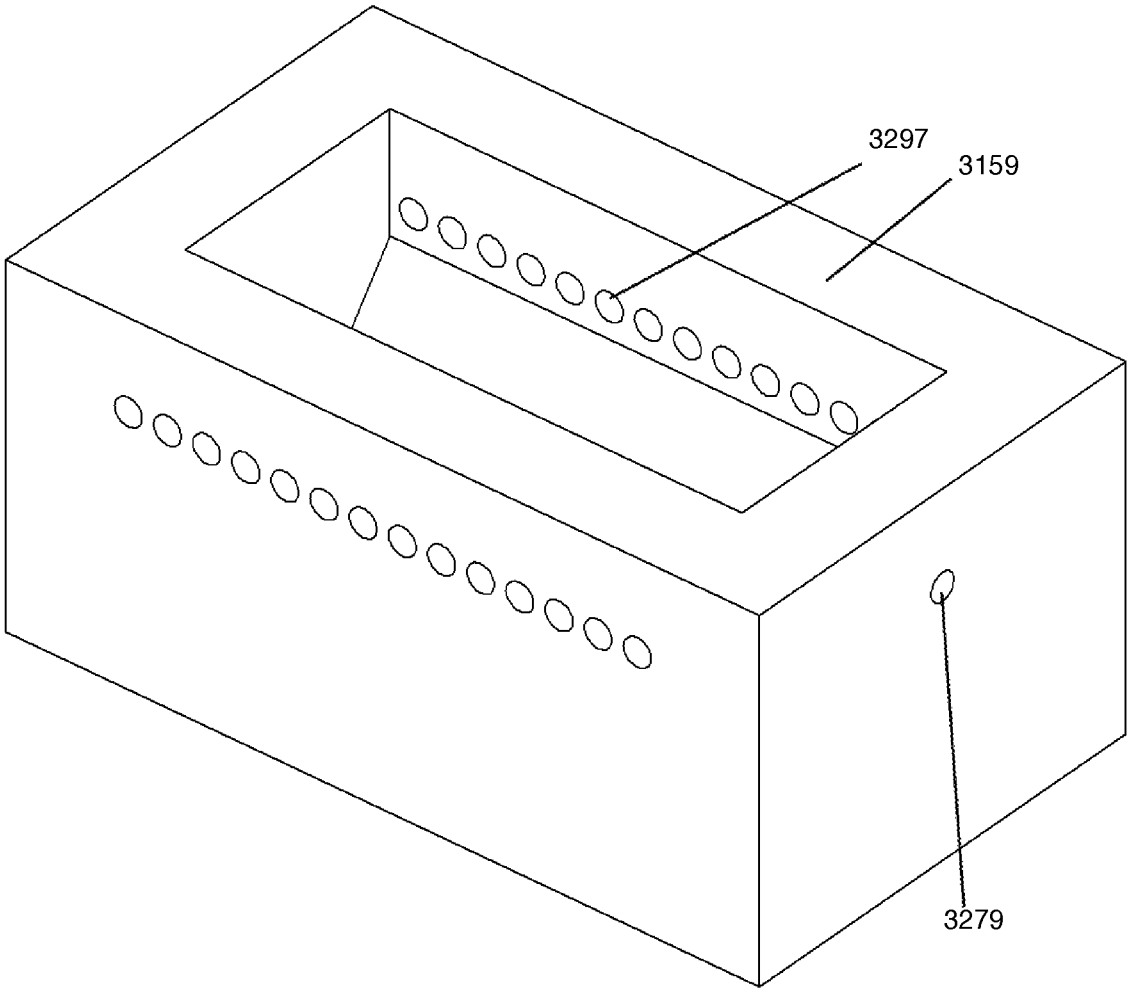
FIG. 43 is a perspective view which shows the refractory.
Figure 44:
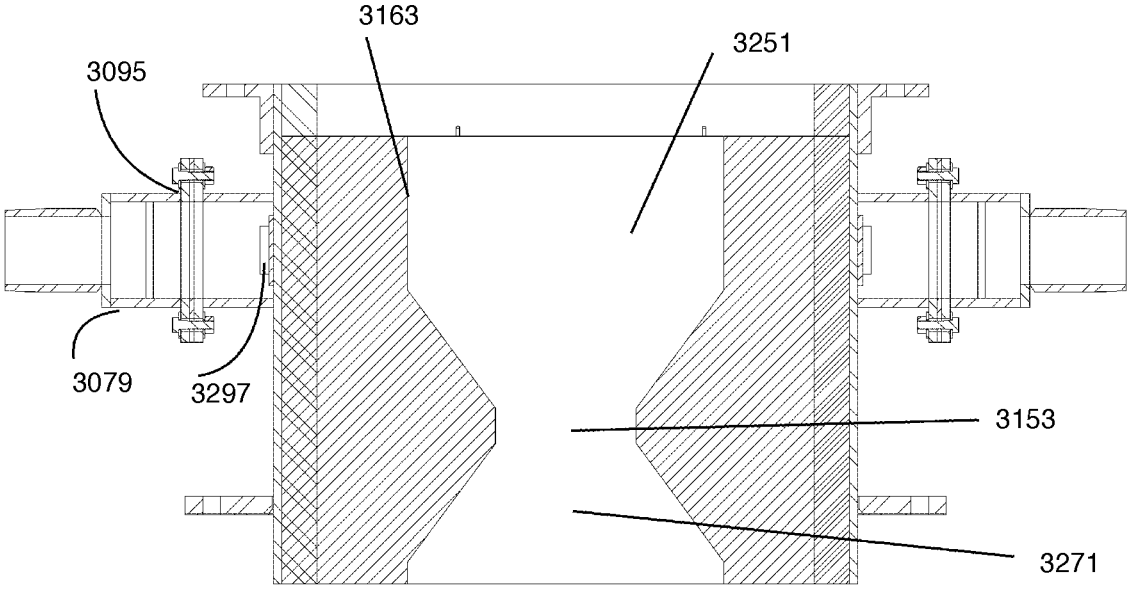
FIG. 44 is a cross-section view which shows the hearth throat 3281.
Figure 45:
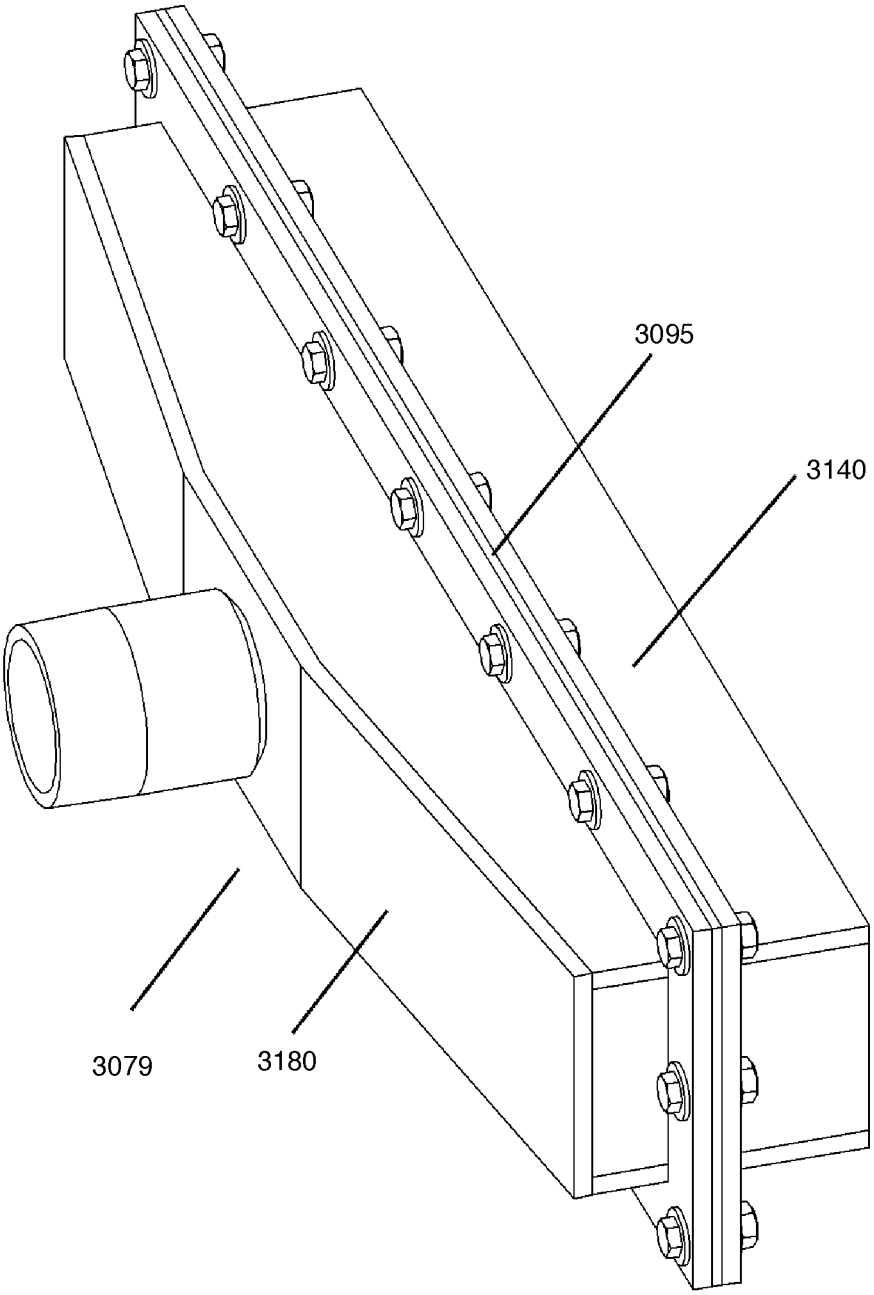
FIG. 45 is a perspective view which shows the air inlet removable manifold.
Figure 46:
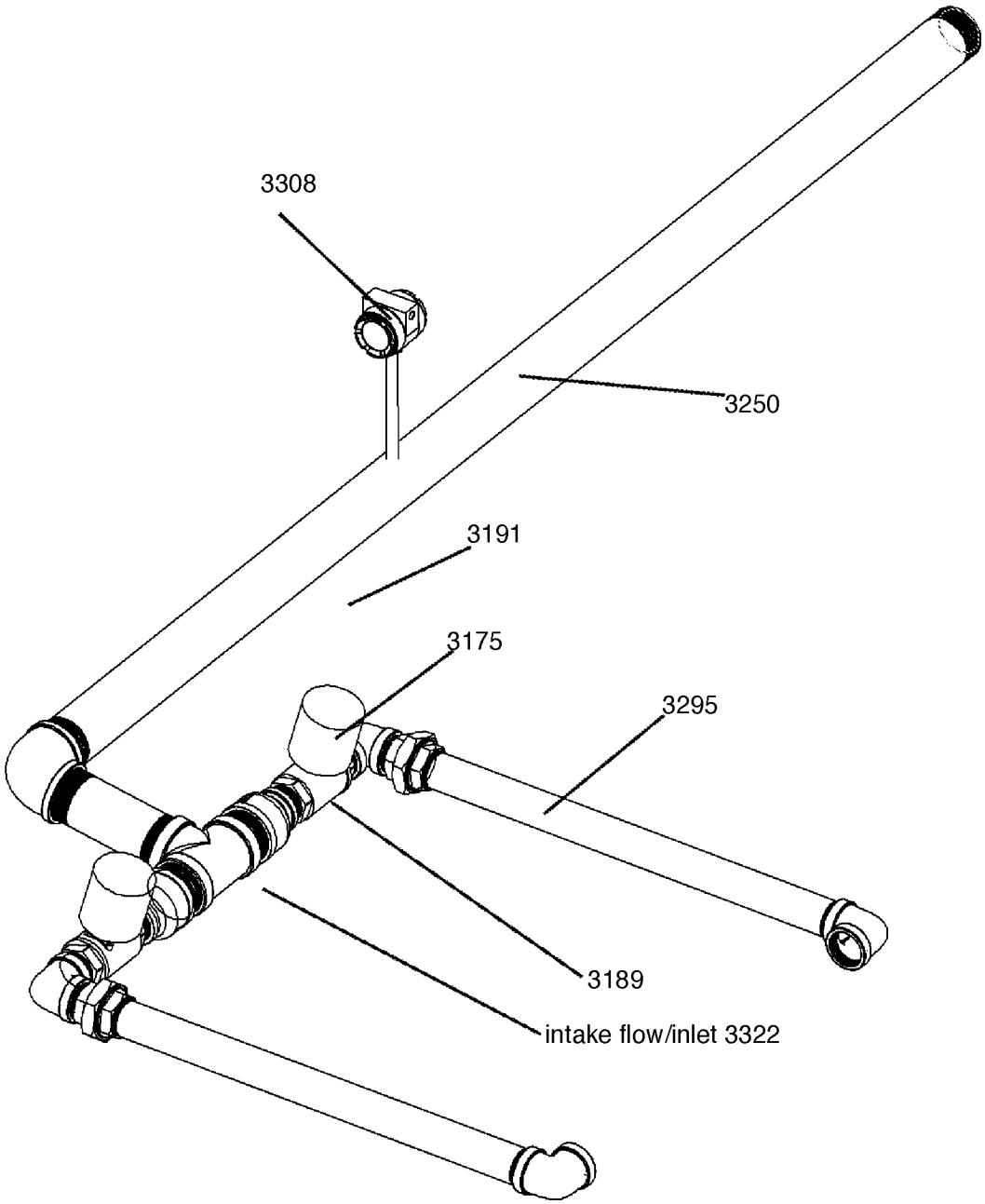
FIG. 46 is a perspective view which shows the air injection system.
Figure 47:
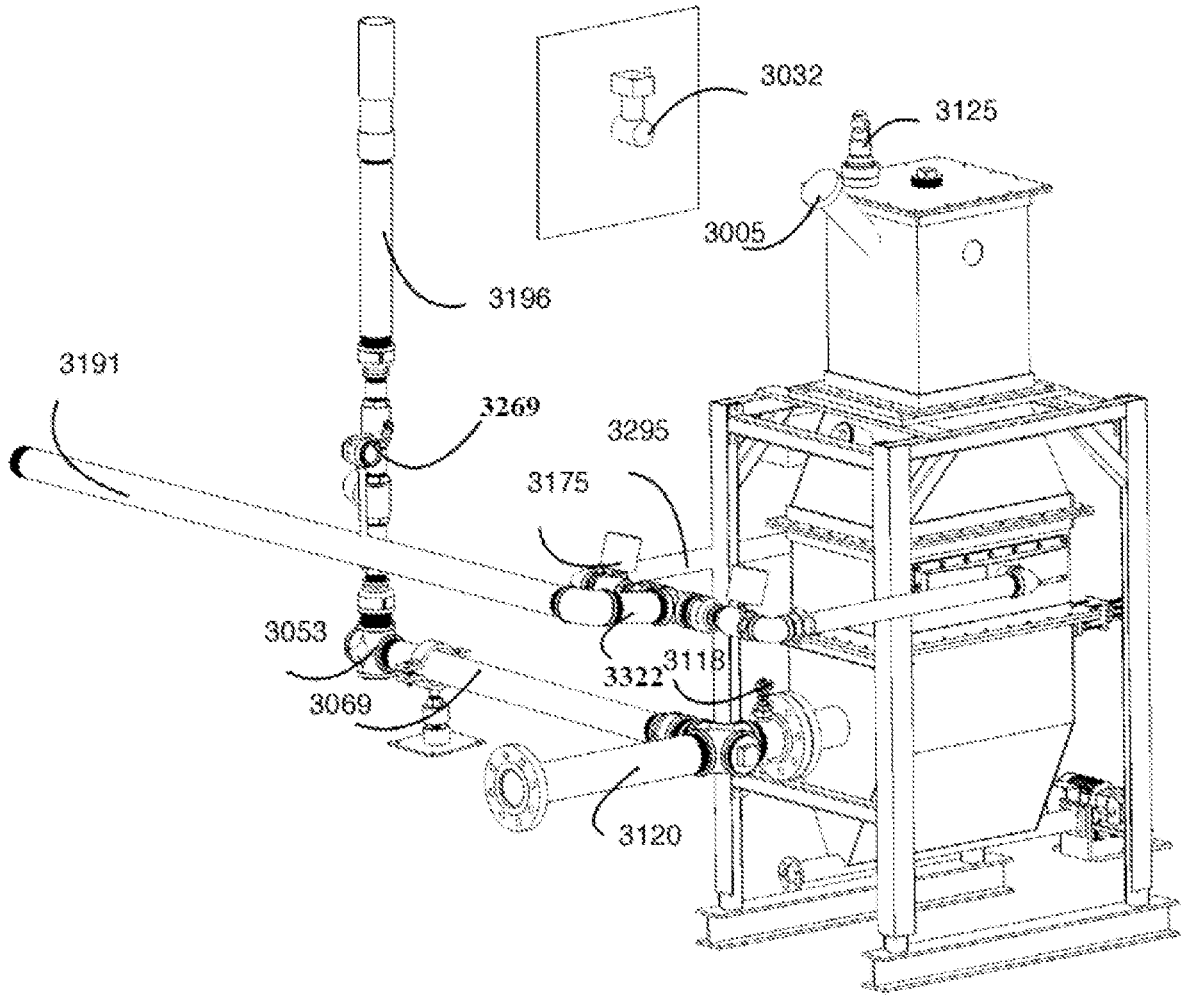
FIG. 47 is a perspective view which shows the flare assembly, air injection system and gasifier.
Figure 48:
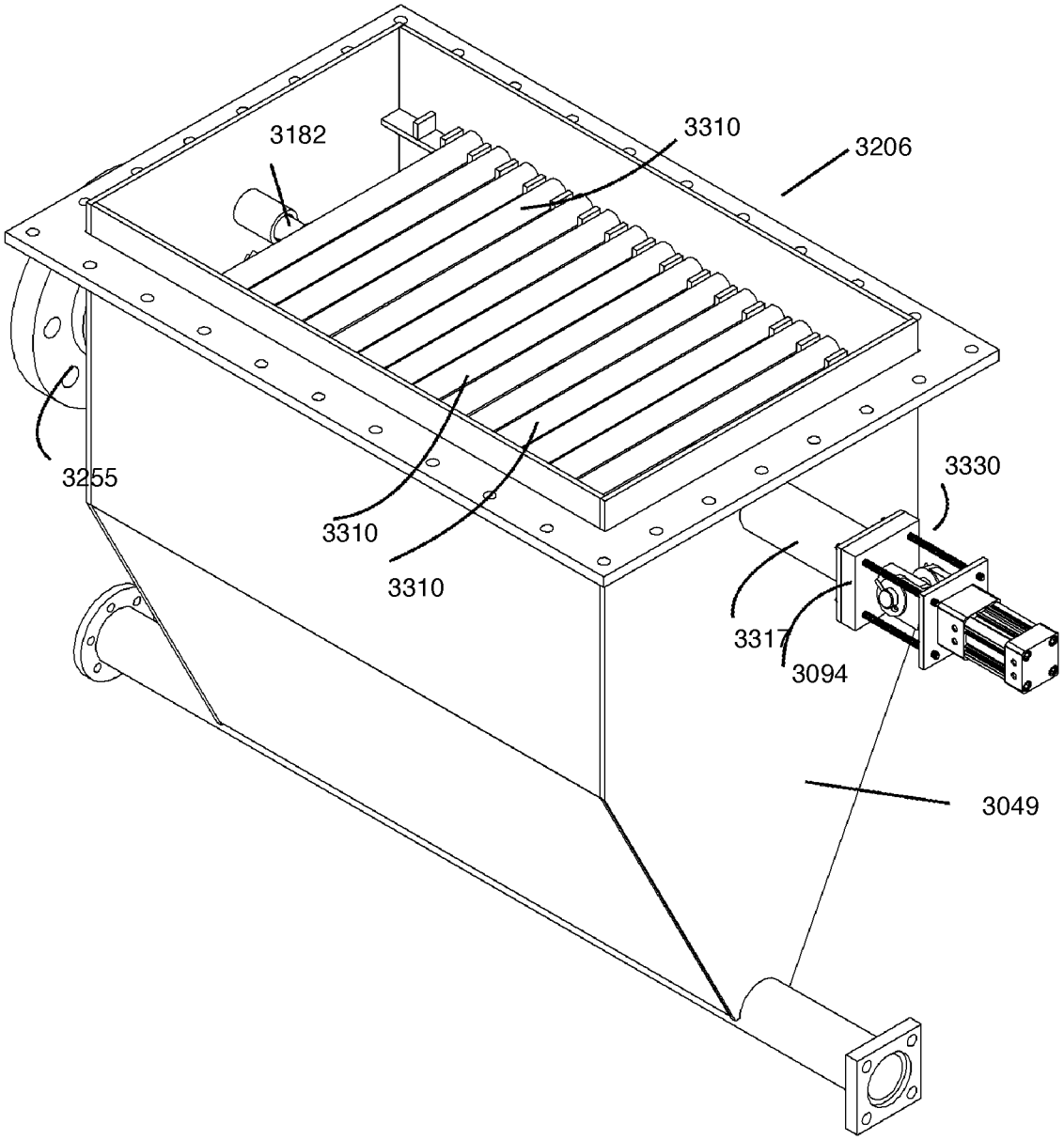
FIG. 48 is a perspective view which shows the ash module of the gasifier.
Figure 49:
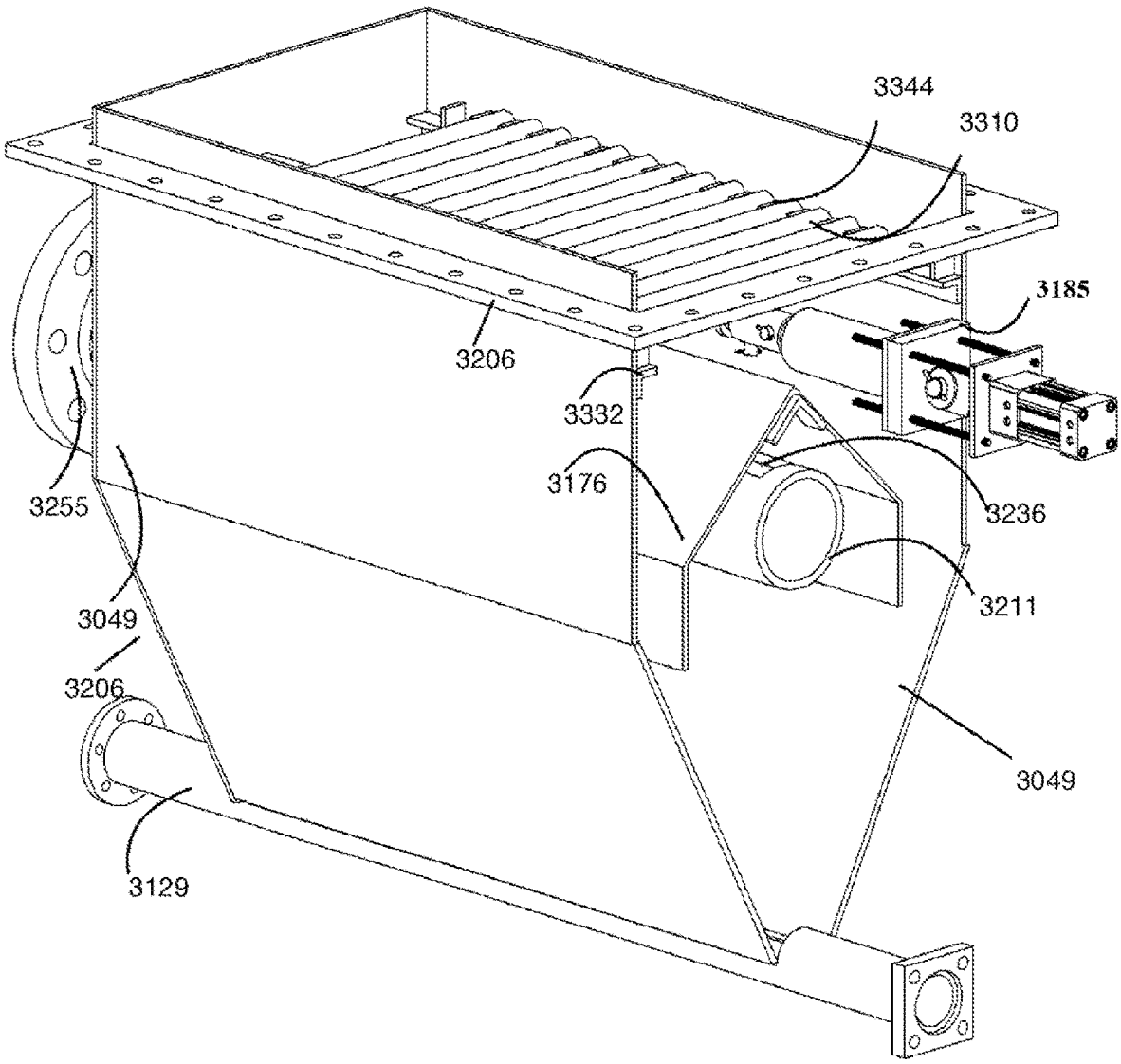
FIG. 49 is a perspective view which shows the ash module of the gasifier.
Figure 50:
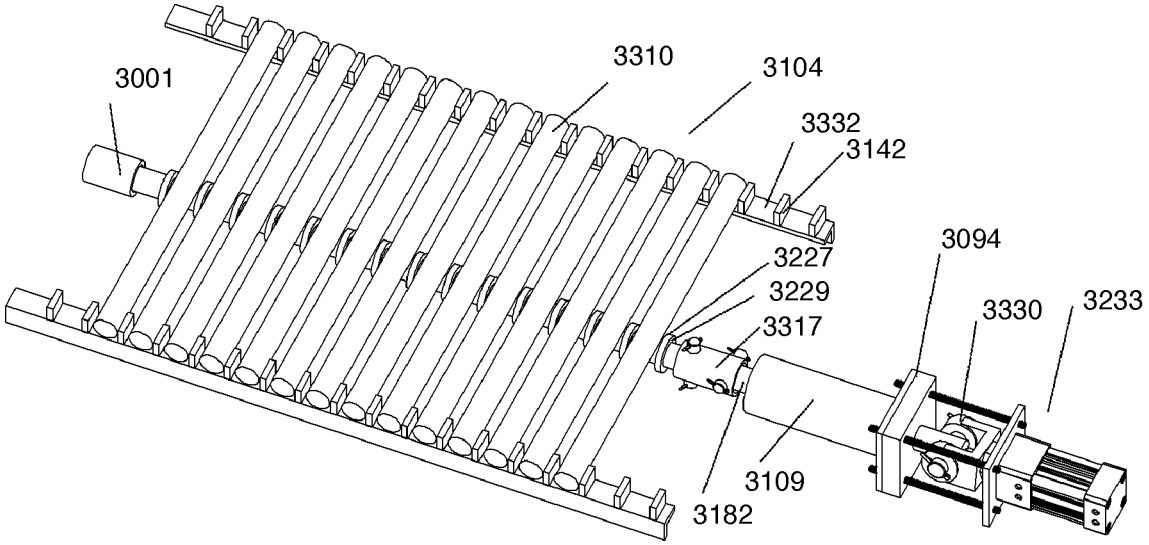
FIG. 50 is a perspective view which shows the grate and shaker assembly of the ash module.
Figure 51:
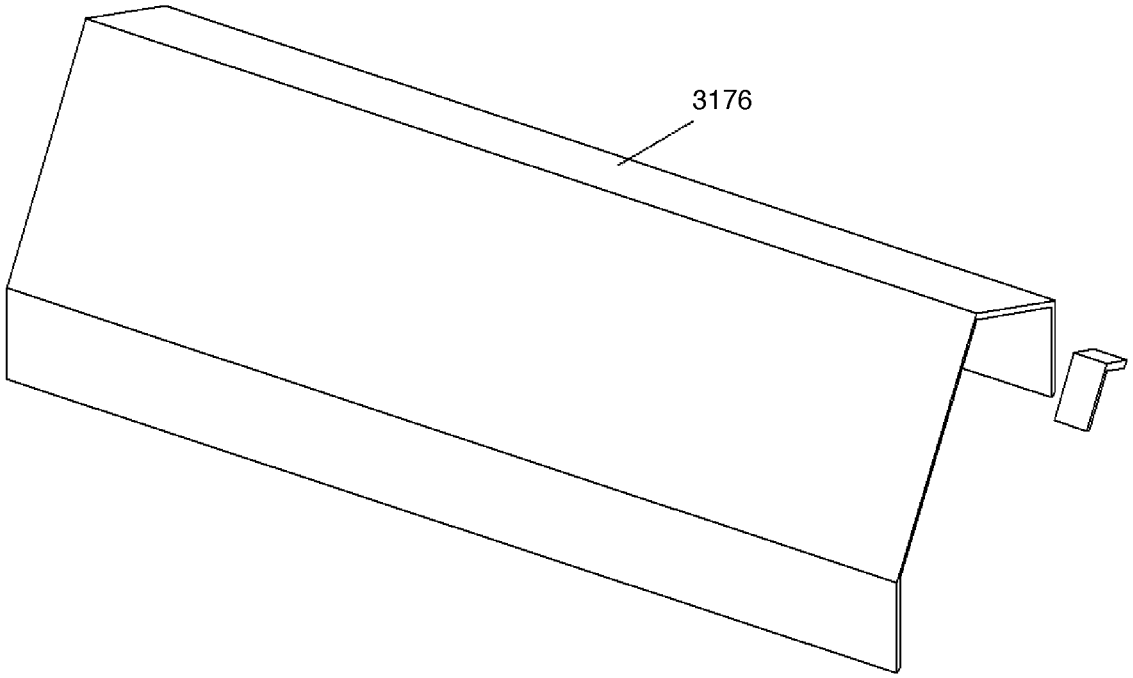
FIG. 51 is a perspective view which shows the V shield with support of the ash module.
Figure 52:
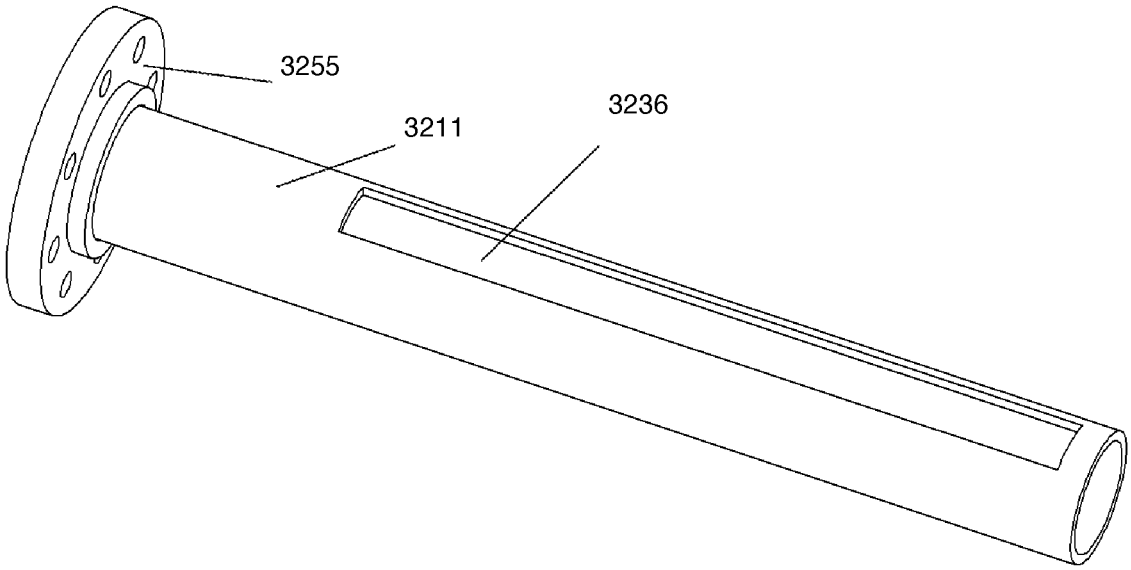
FIG. 52 is a perspective view which shows the gas collection pipe of the ash module.
Figure 53:
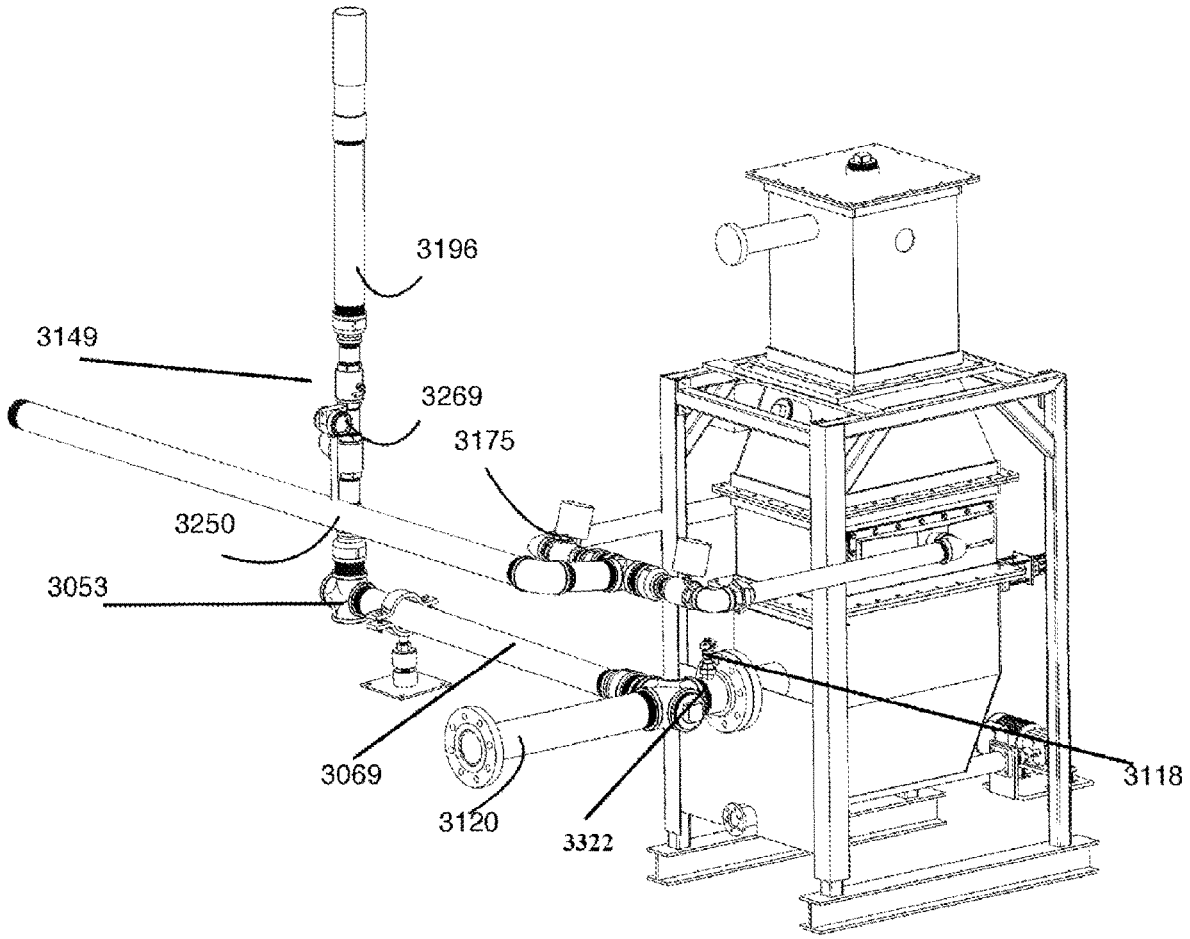
FIG. 53 is a perspective view which shows the flare assembly, air injection system and gasifier.
Figure 54:
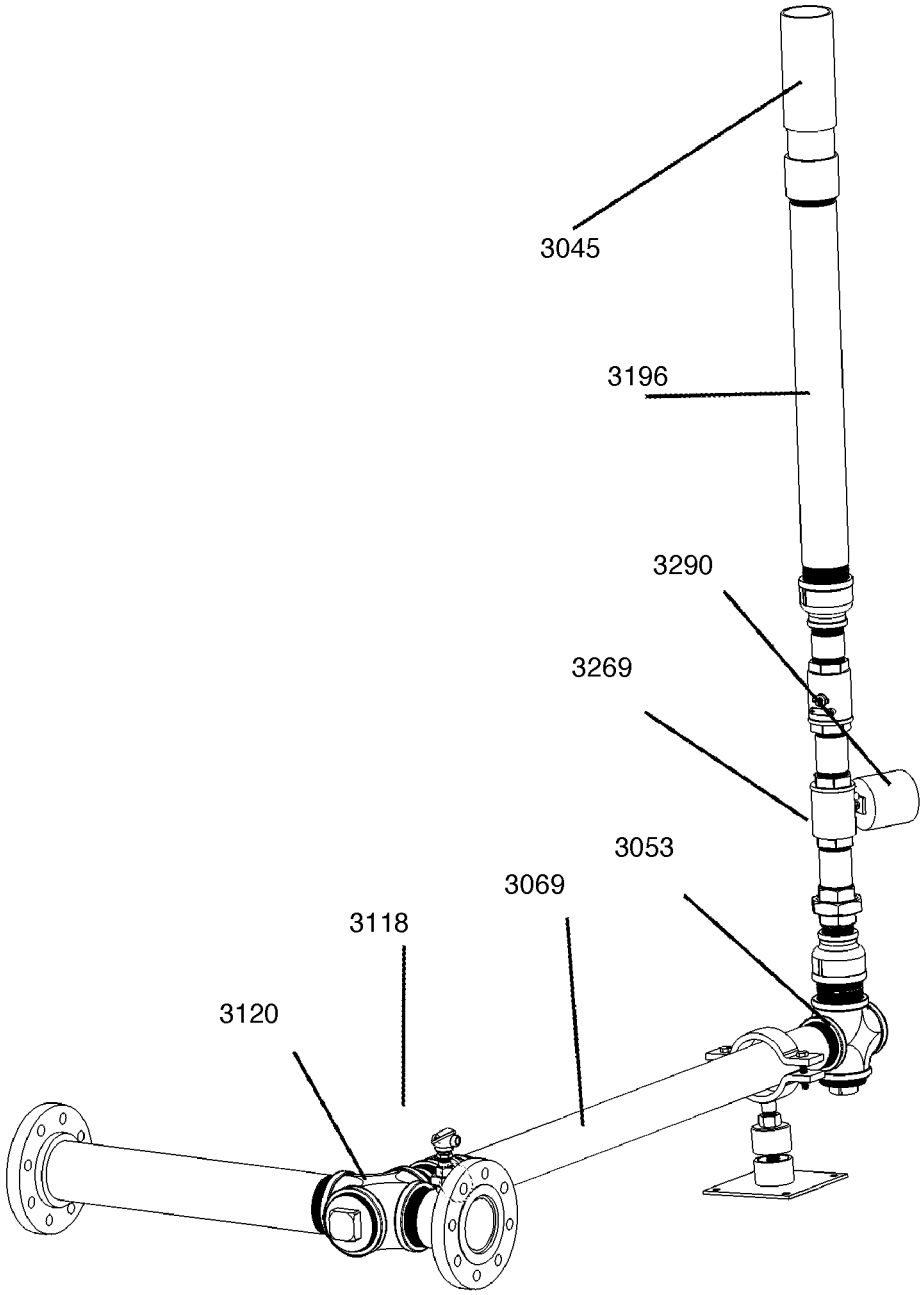
FIG. 54 is a perspective view which shows the flare assembly.
Figure 55:
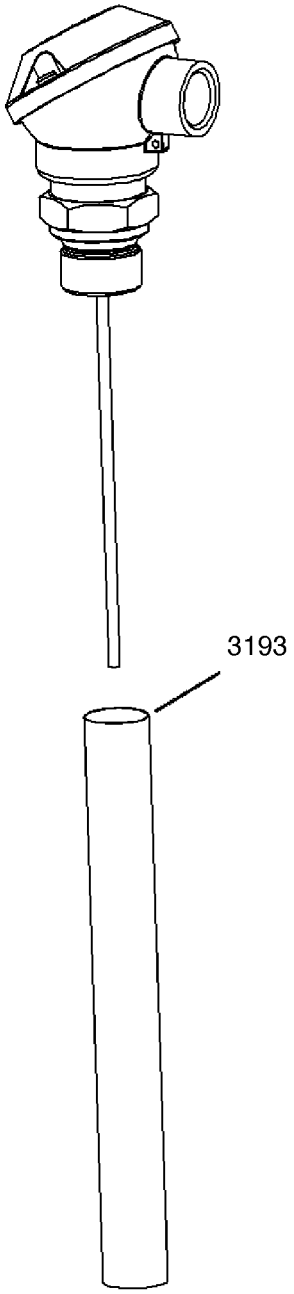
FIG. 55 is a perspective view which shows the thermocouple with shield 3352.
Figure 56:
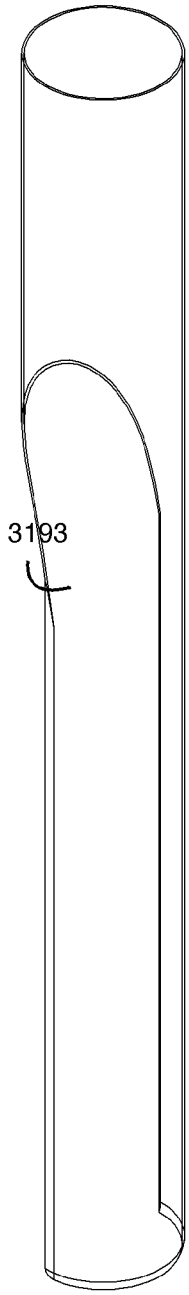
FIG. 56 is a perspective view which shows the thermocouple shield.
Figure 57:
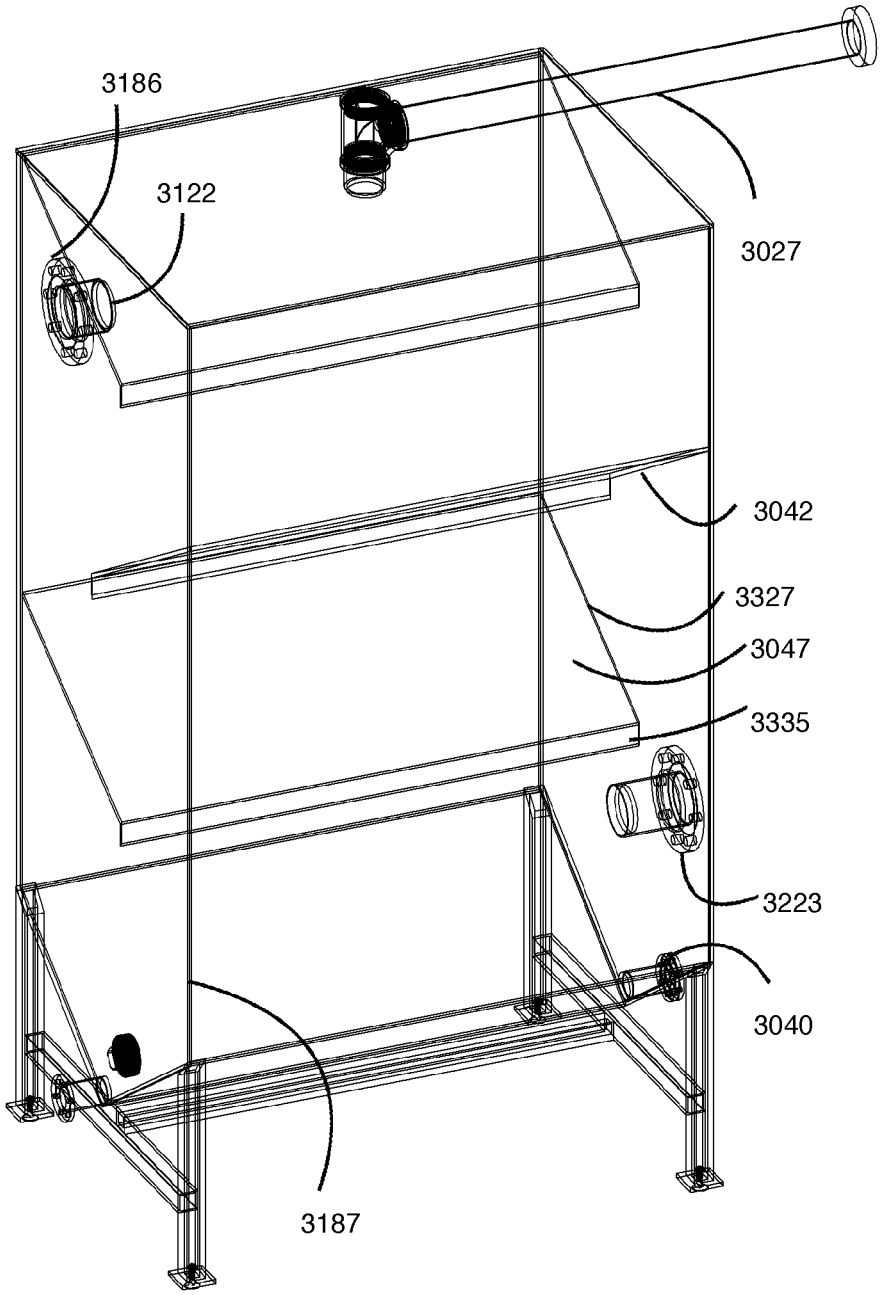
FIG. 57 is a x-ray view which shows the rectilinear cyclonic cooler.
Figure 58:
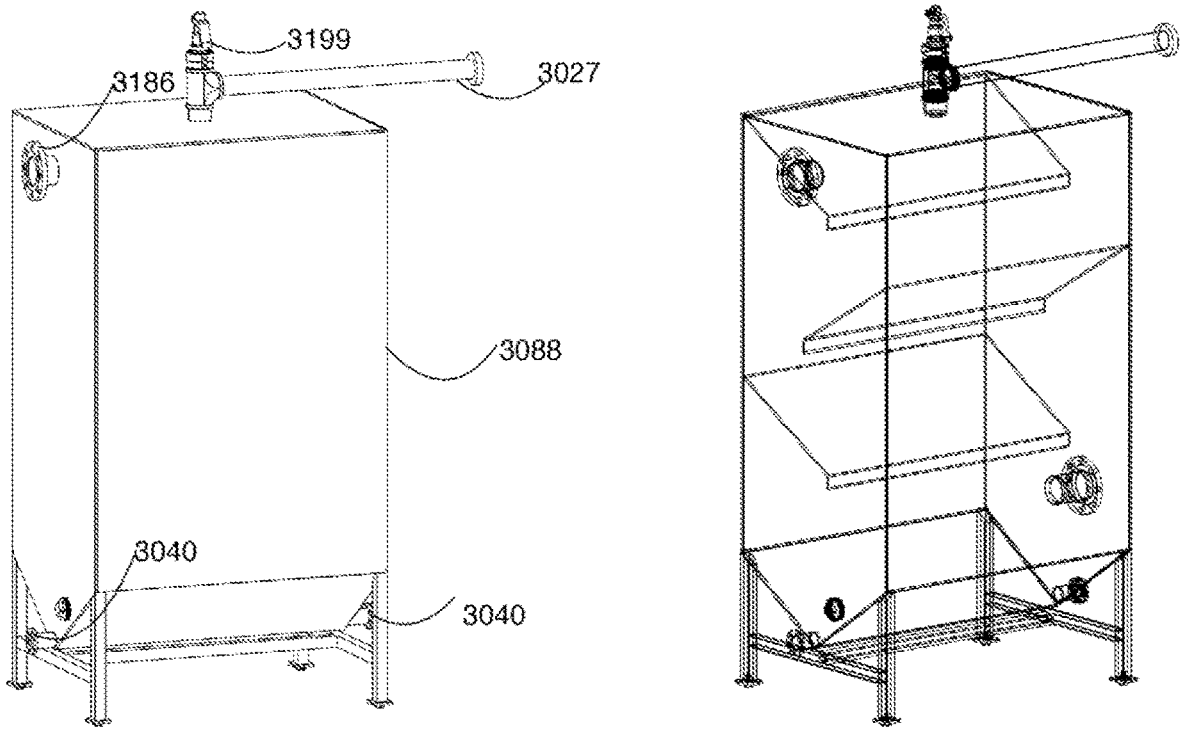
FIG. 58 is a perspective and x-ray view which shows the cooler.
Figure 59:
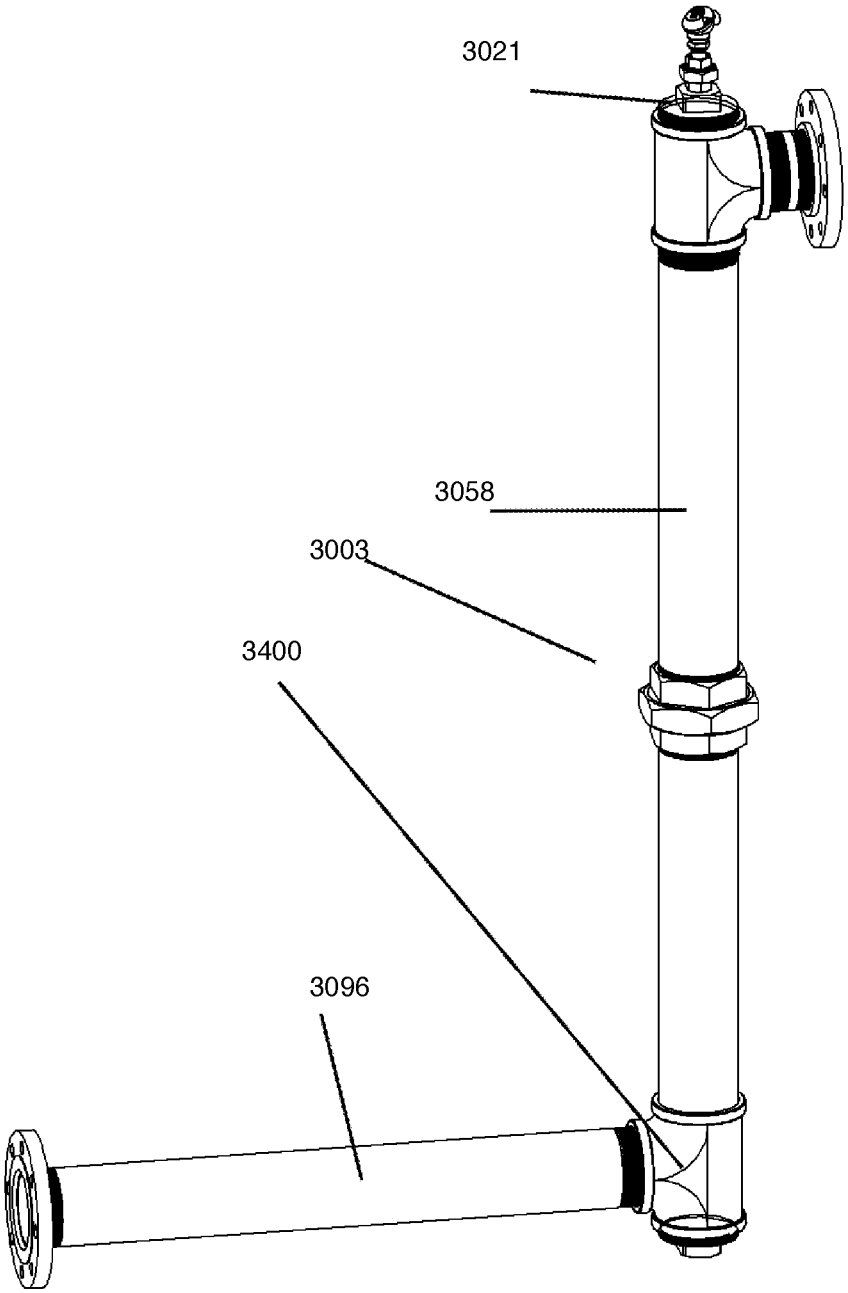
FIG. 59 is a perspective view which shows the rectilinear cyclonic cooler transition assembly.
Figure 60:
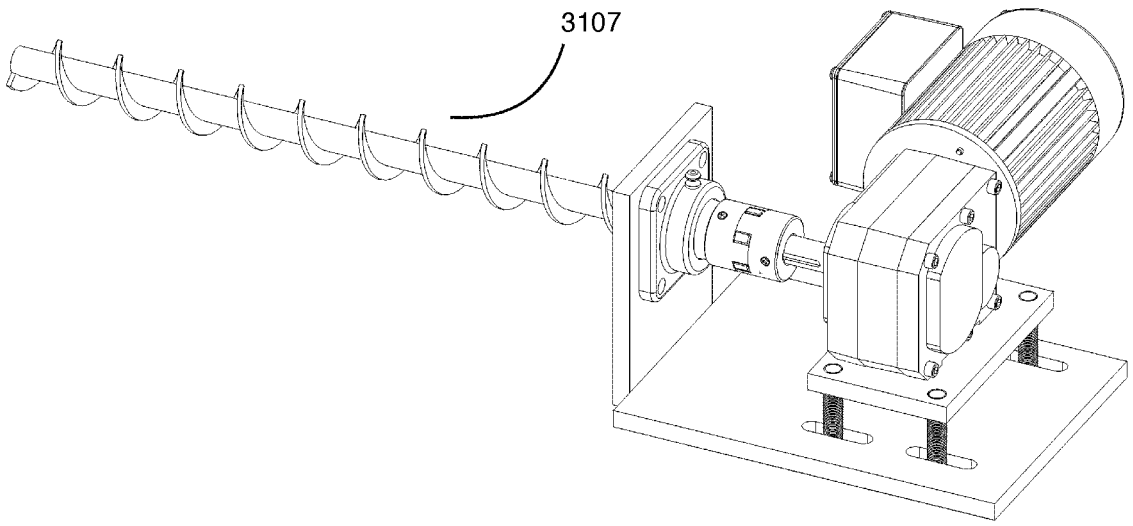
FIG. 60 is a perspective view which shows the auger removal assembly.
Figure 61:
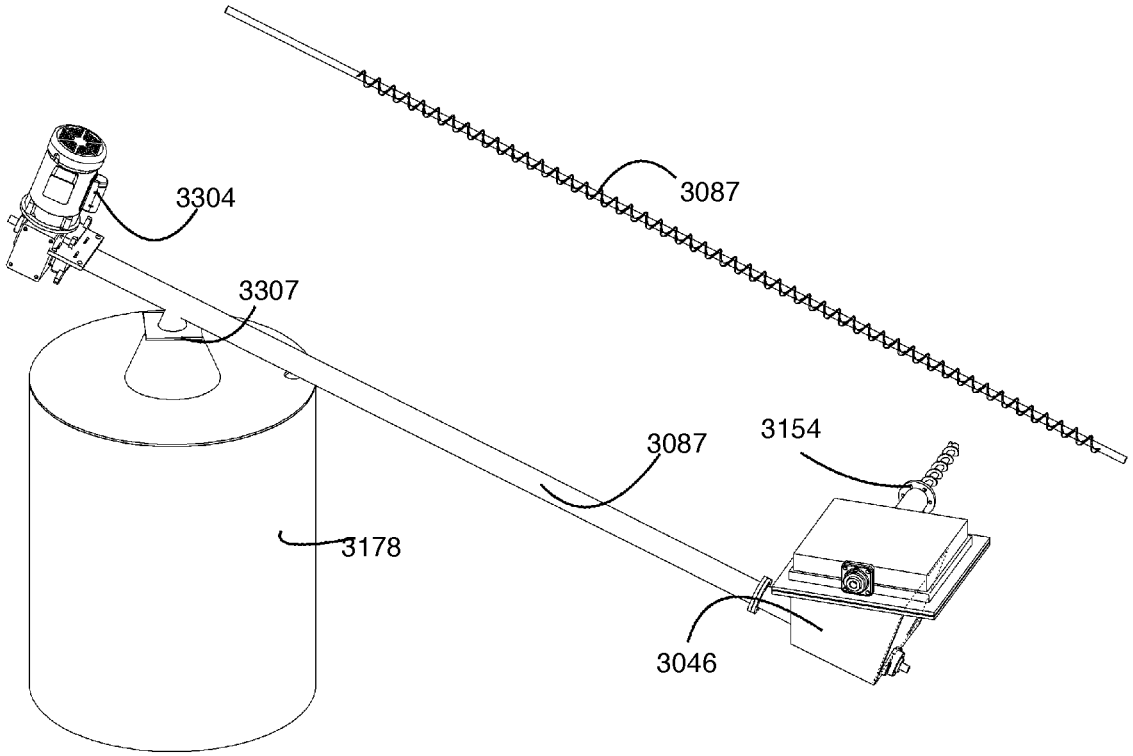
FIG. 61 is a exploded view which shows the auger collecting assembly.
Figure 62:
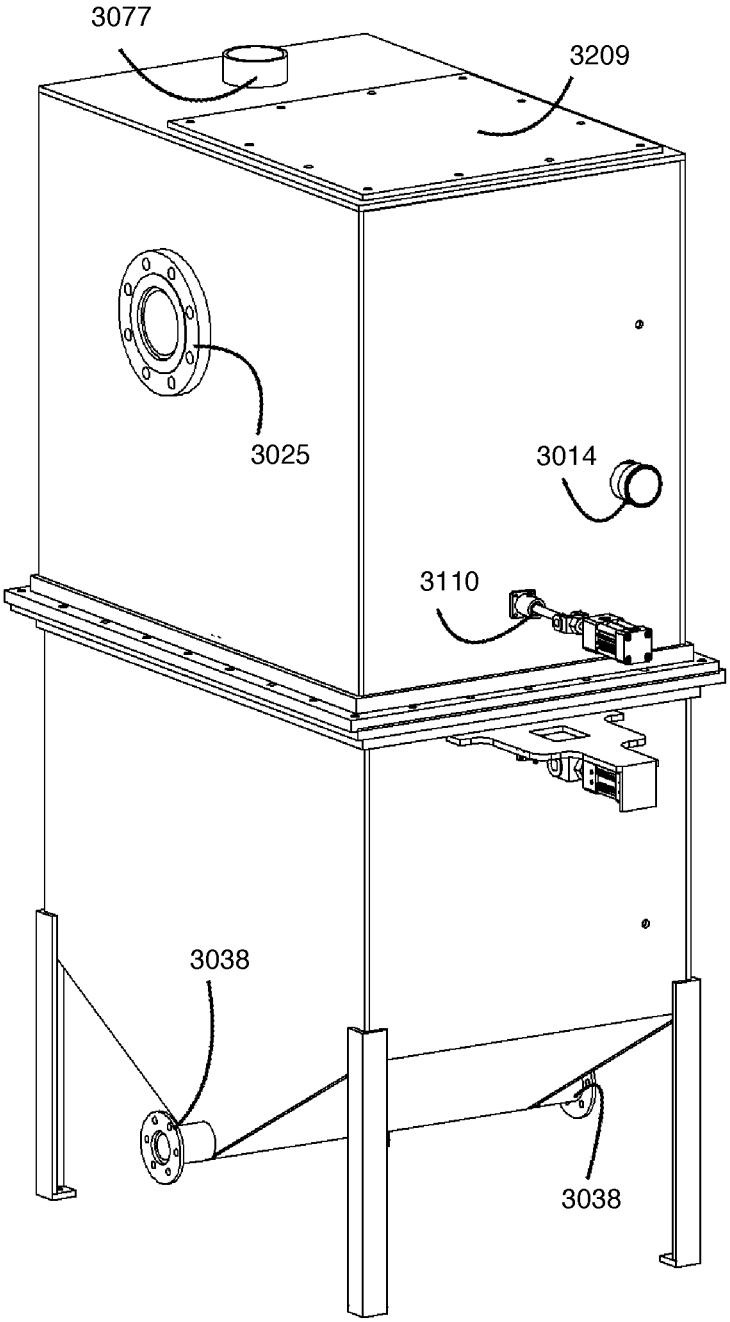
FIG. 62 is a perspective view which shows the outside of the packed bed filter.
Figure 63:
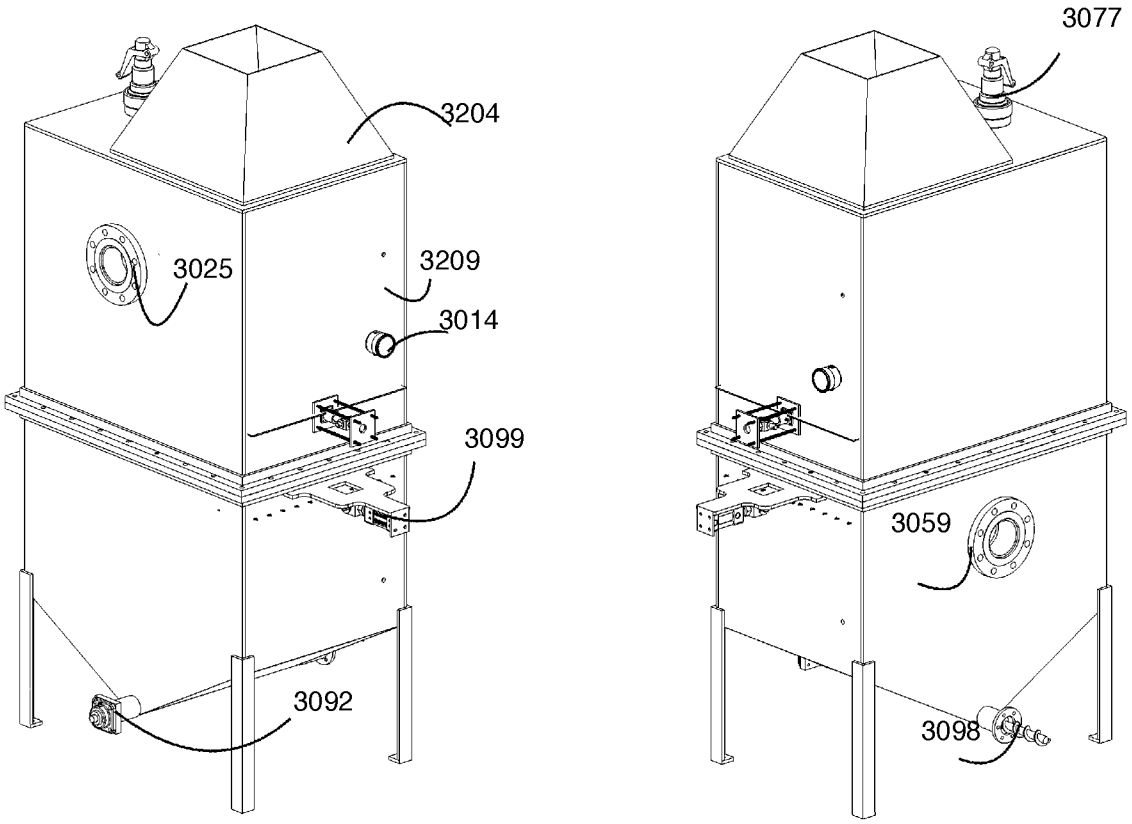
FIG. 63 is a perspective view which shows the outside of the packed bed filter.
Figure 64:
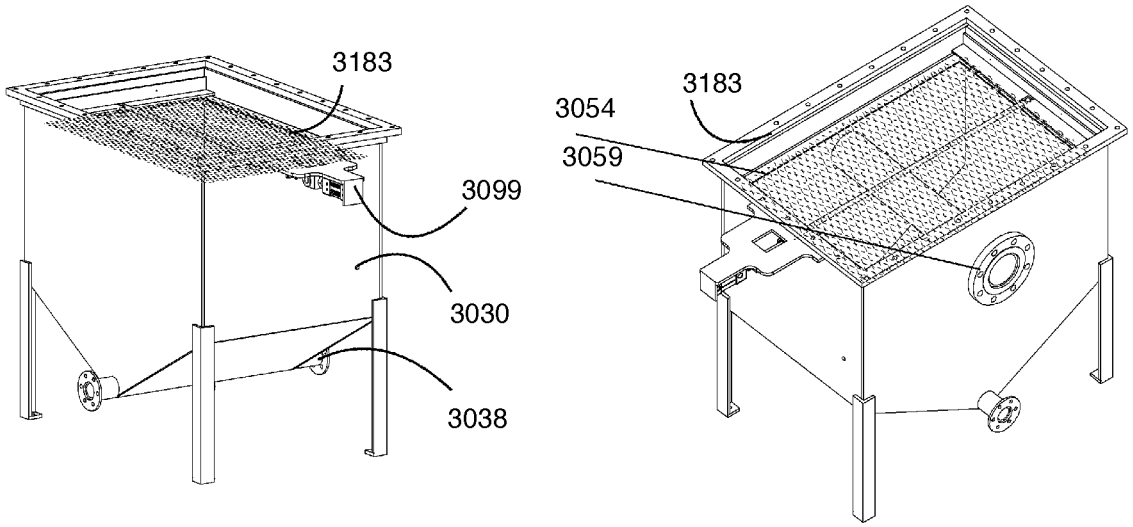
FIG. 64 is a perspective view which shows the bottom portion of the packed bed filter with scissoring mechanism visible.
Figure 65:
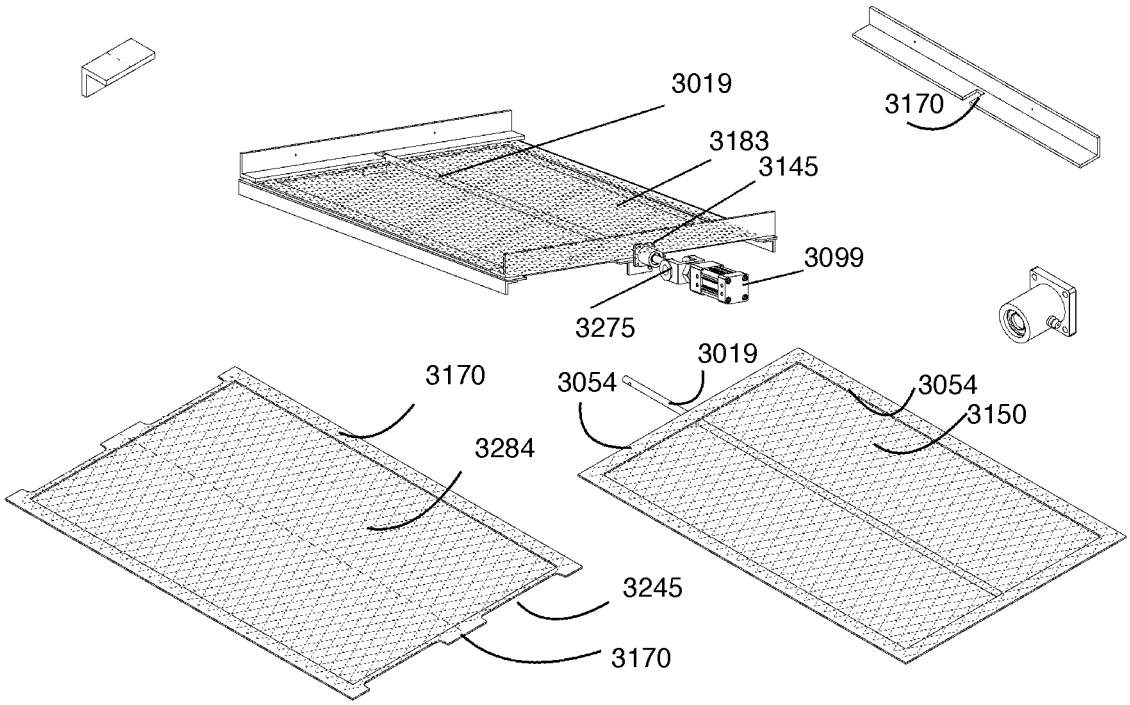
FIG. 65 is a perspective view which shows the bottom portion of the packed bed filter with auger system.
Figure 66:
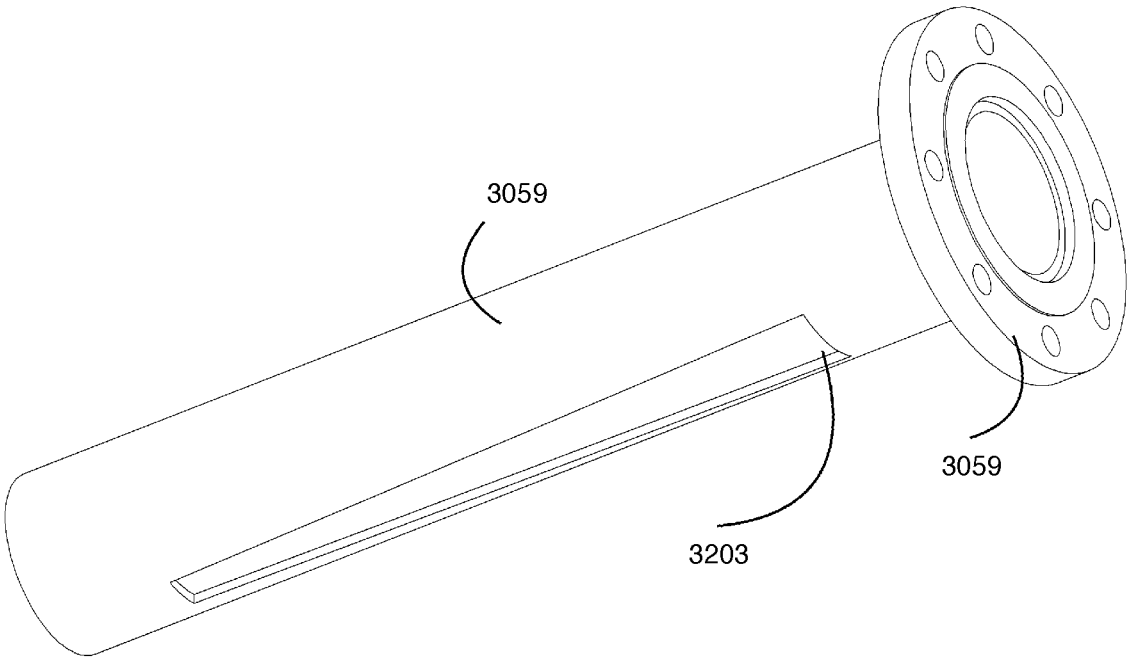
FIG. 66 is a perspective view which shows the inlet pipe into the packed bed filter.
Figure 67:
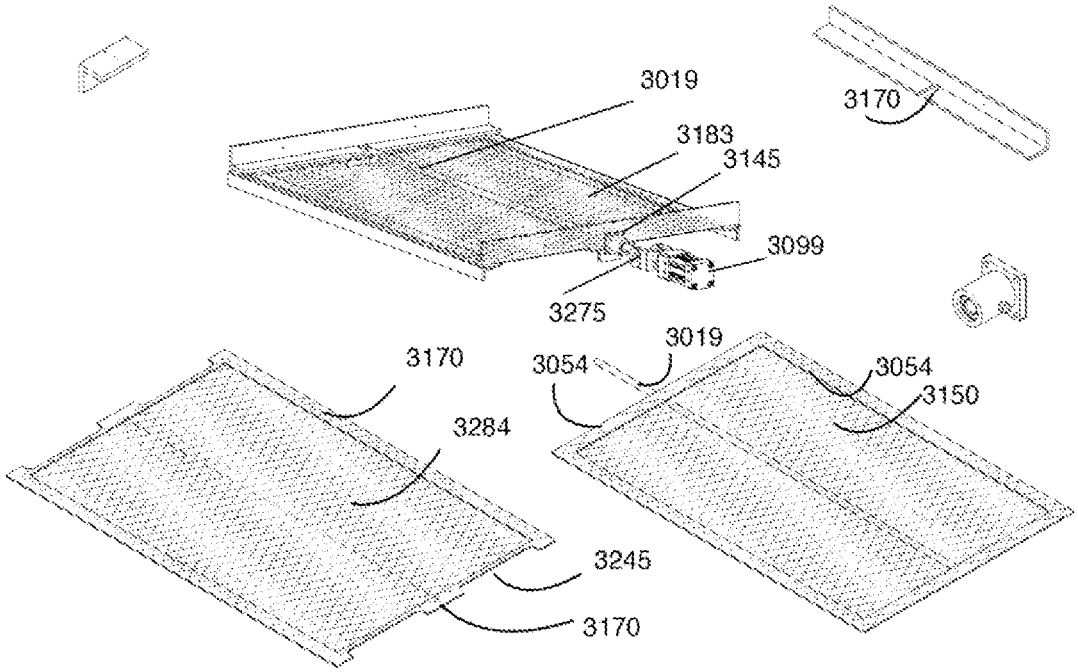
FIG. 67 is a perspective view which shows the actuator grate actuator assembly in the packed bed filter.
Figure 68:
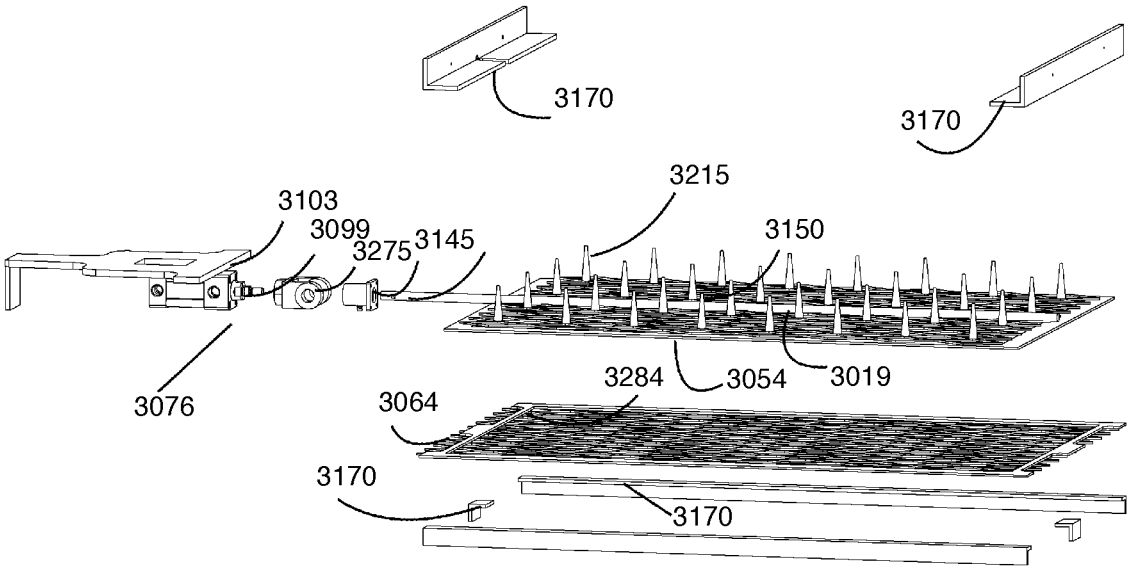
FIG. 68 is a exploded view which shows actuator grate assembly 3277 in the packed bed filter.
Figure 69:
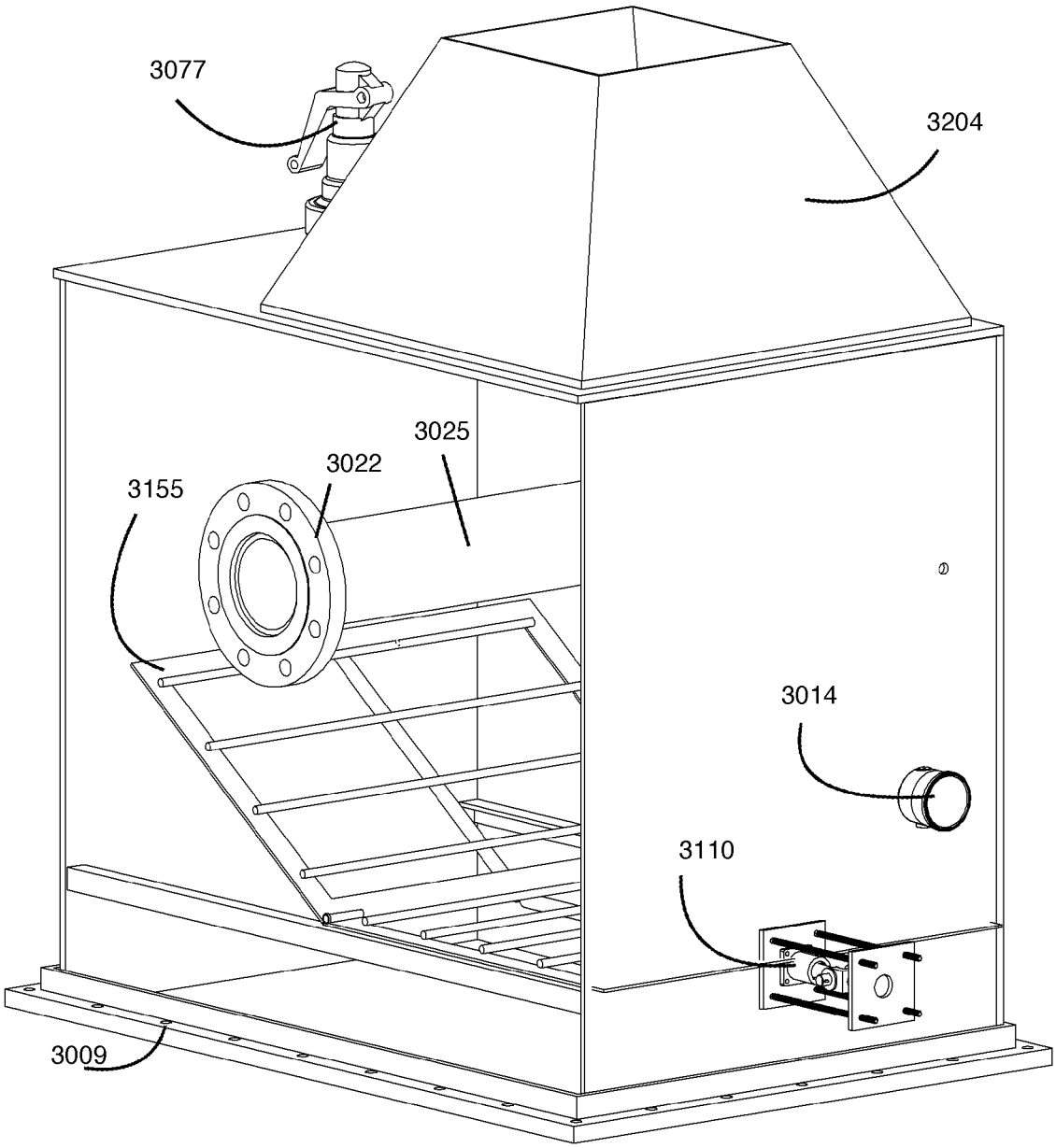
FIG. 69 is a perspective view which shows outside of the packed bed filter top portion housing.
Figure 70:
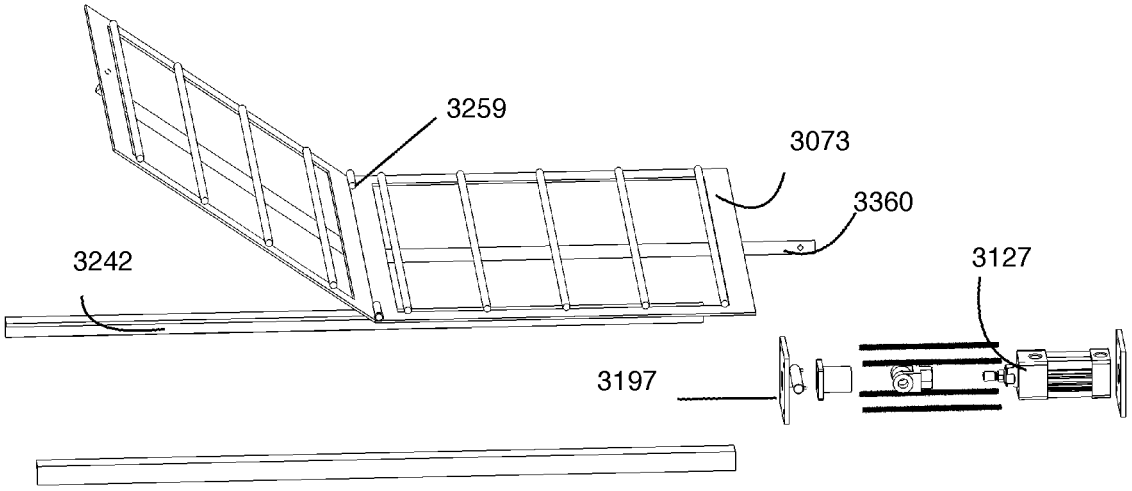
FIG. 70 is a exploded view which shows the flexible rake and actuator in the packed bed filter.
Figure 71:
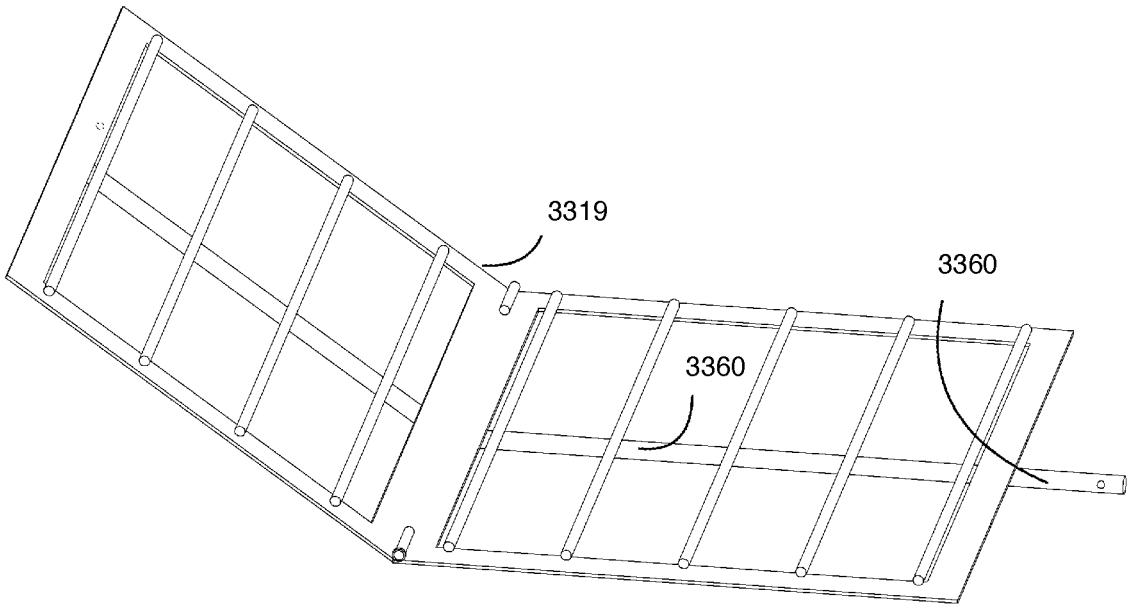
FIG. 71 is a perspective view which shows the flexible rake in the packed bed filter.
Figure 72:
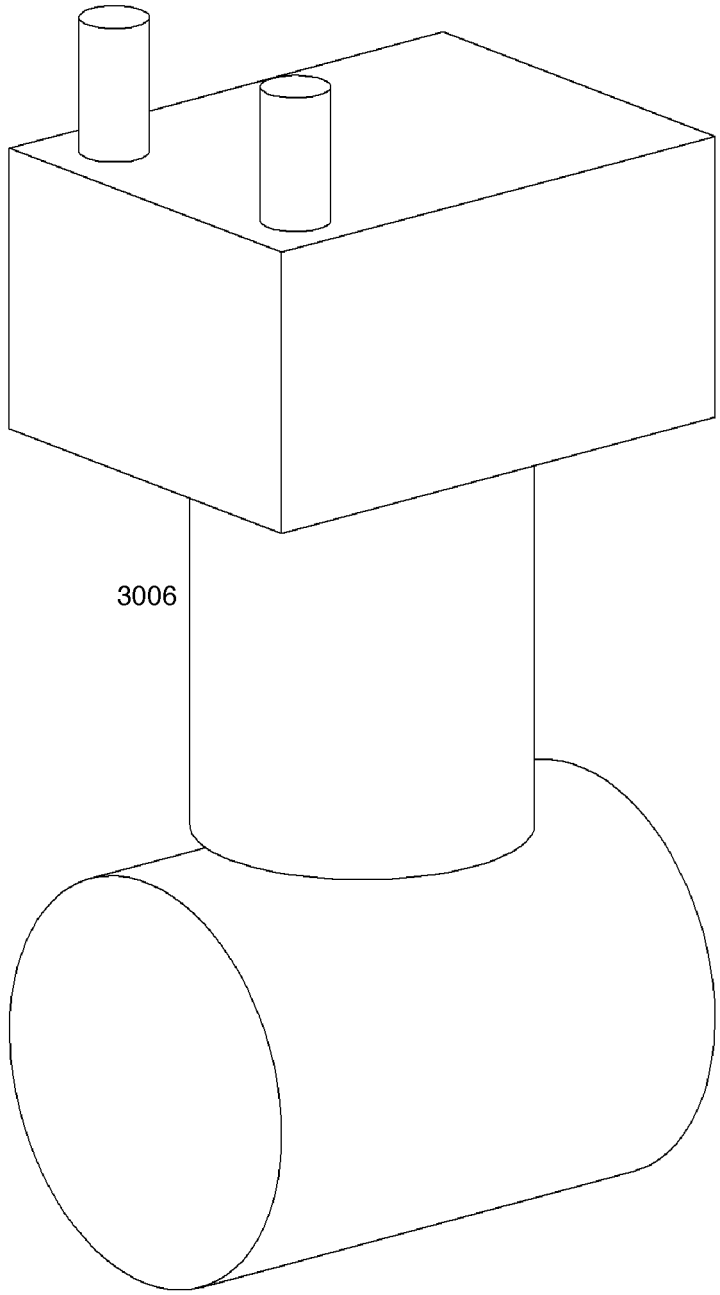
FIG. 72 is a perspective view which shows a differential pressure assembly that may be used, in some embodiments, to measure pressure across regions of the gasifier, packed bed filter and/or chiller.
Figure 73:
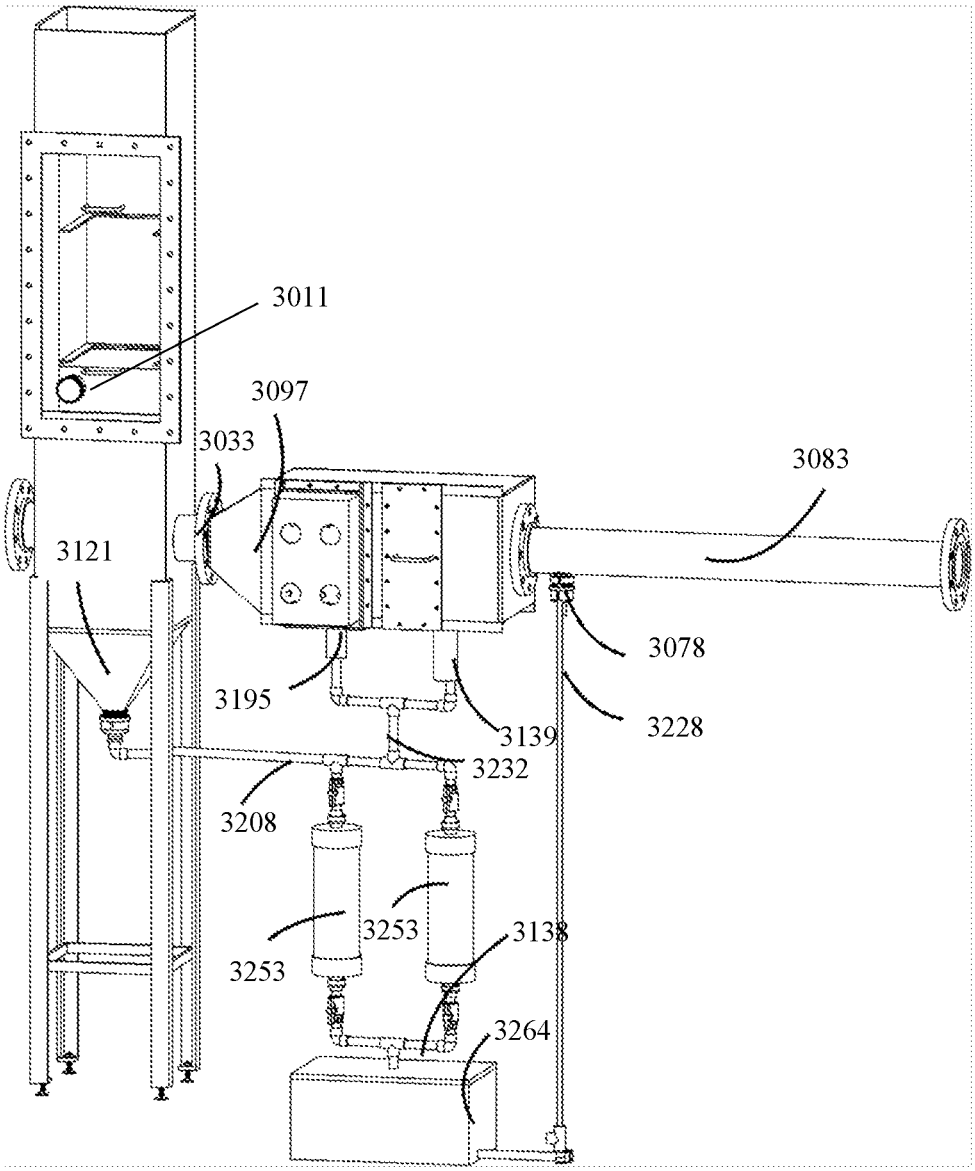
FIG. 73 is a perspective view which shows the chiller and mist elimination system arrangement.
Figure 74:
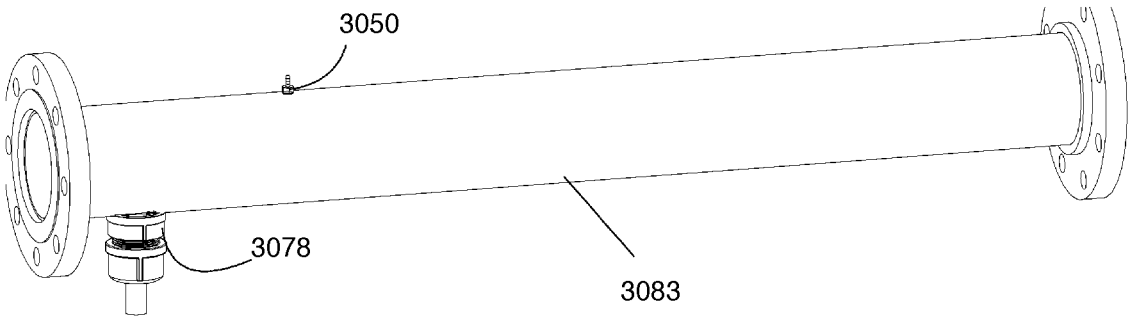
FIG. 74 is a perspective view which shows the chiller/packed bed filter connection assembly.
Figure 75:
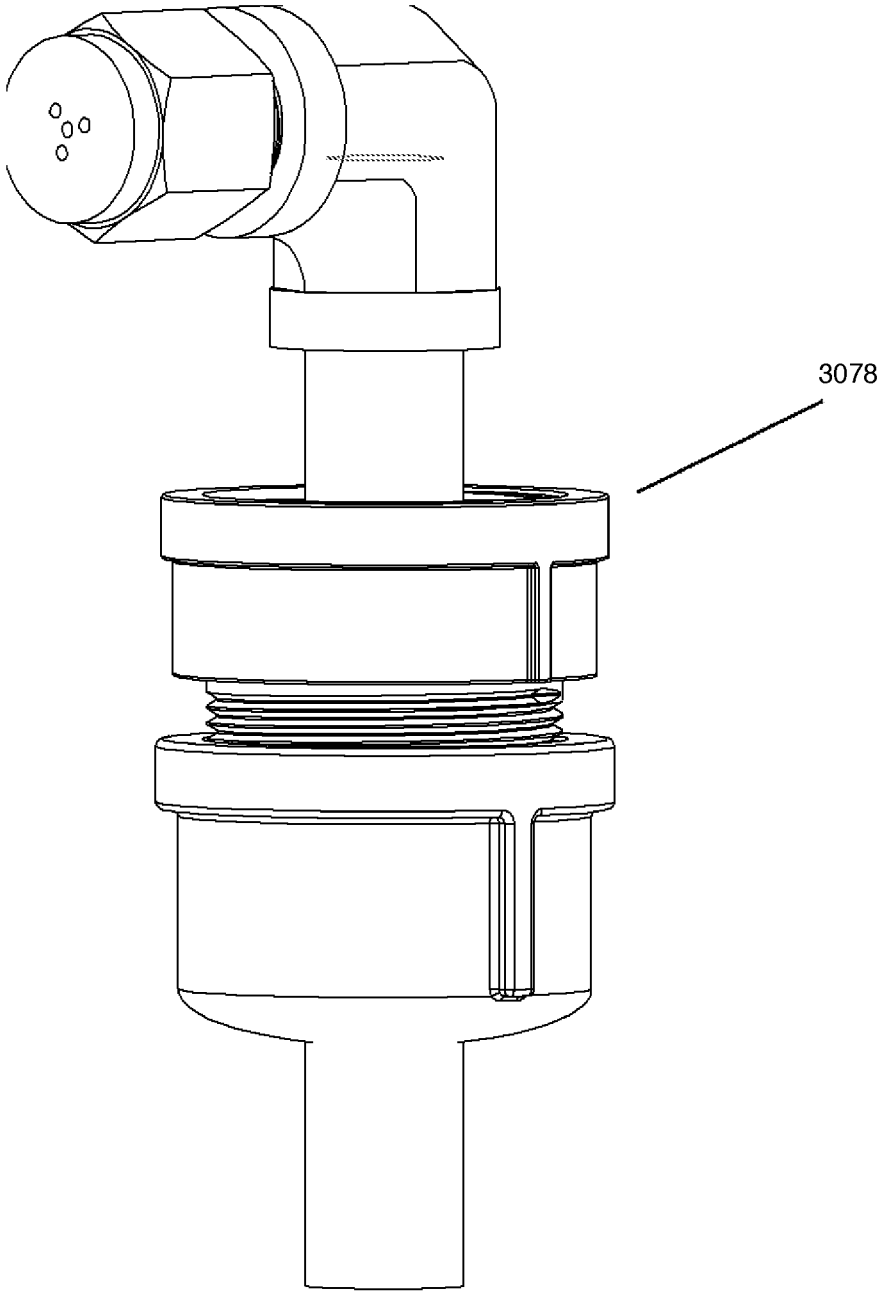
FIG. 75 is a perspective view which shows the water nozzle for the water scrubber.
Figure 76:
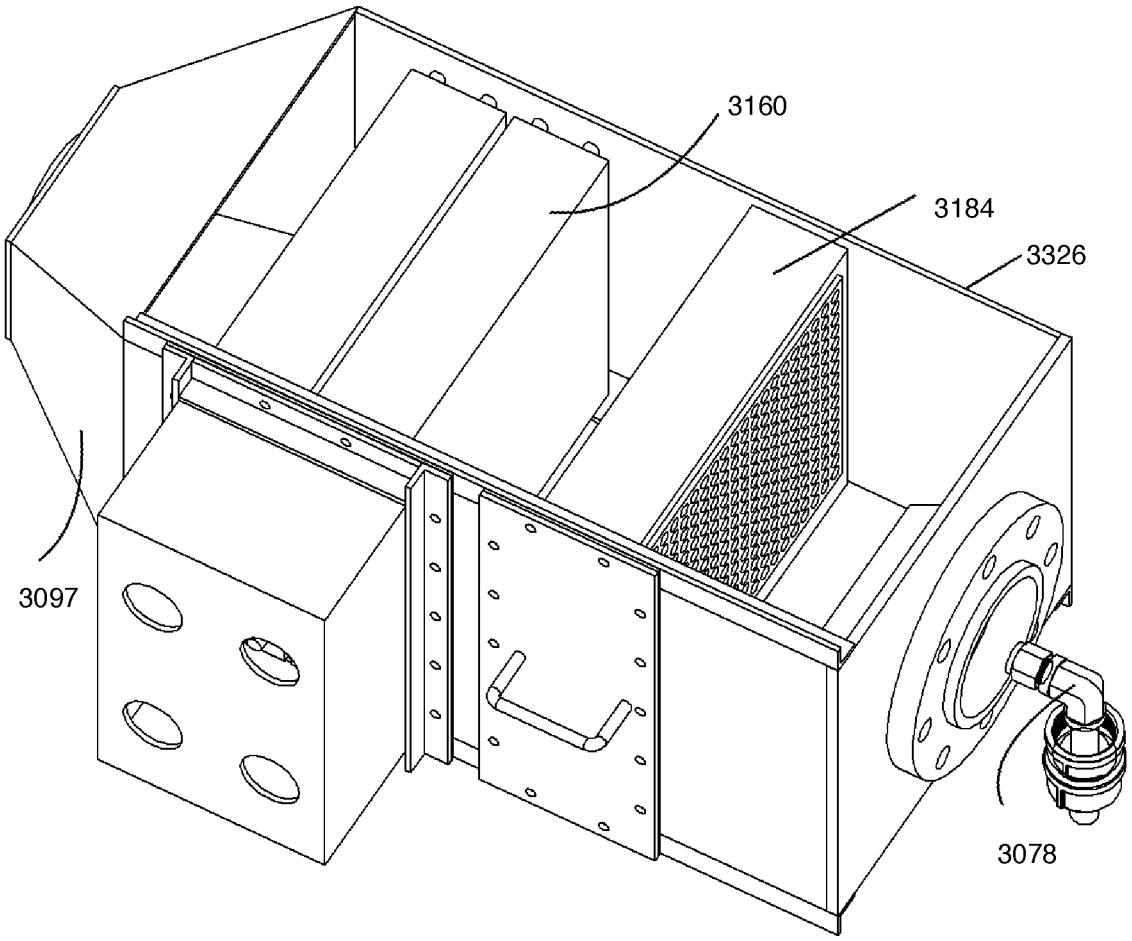
FIG. 76 is a perspective view which shows the chiller with top removed so that the mesh impingement pad and hydrophilic condenser are showing.
Figure 77:
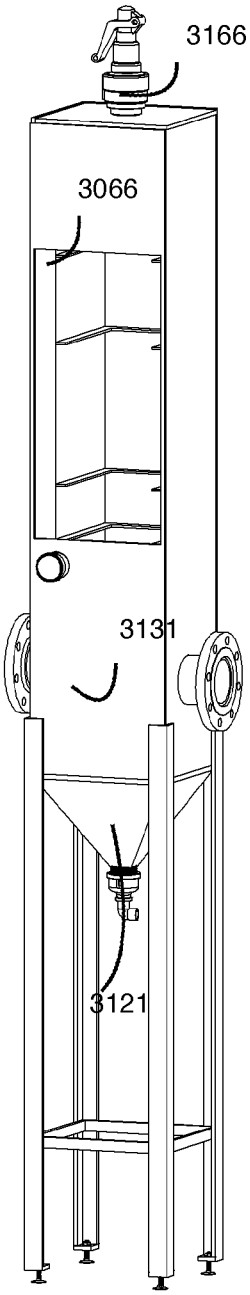
FIG. 77 is a perspective view which shows the mist elimination system.
Figure 78:
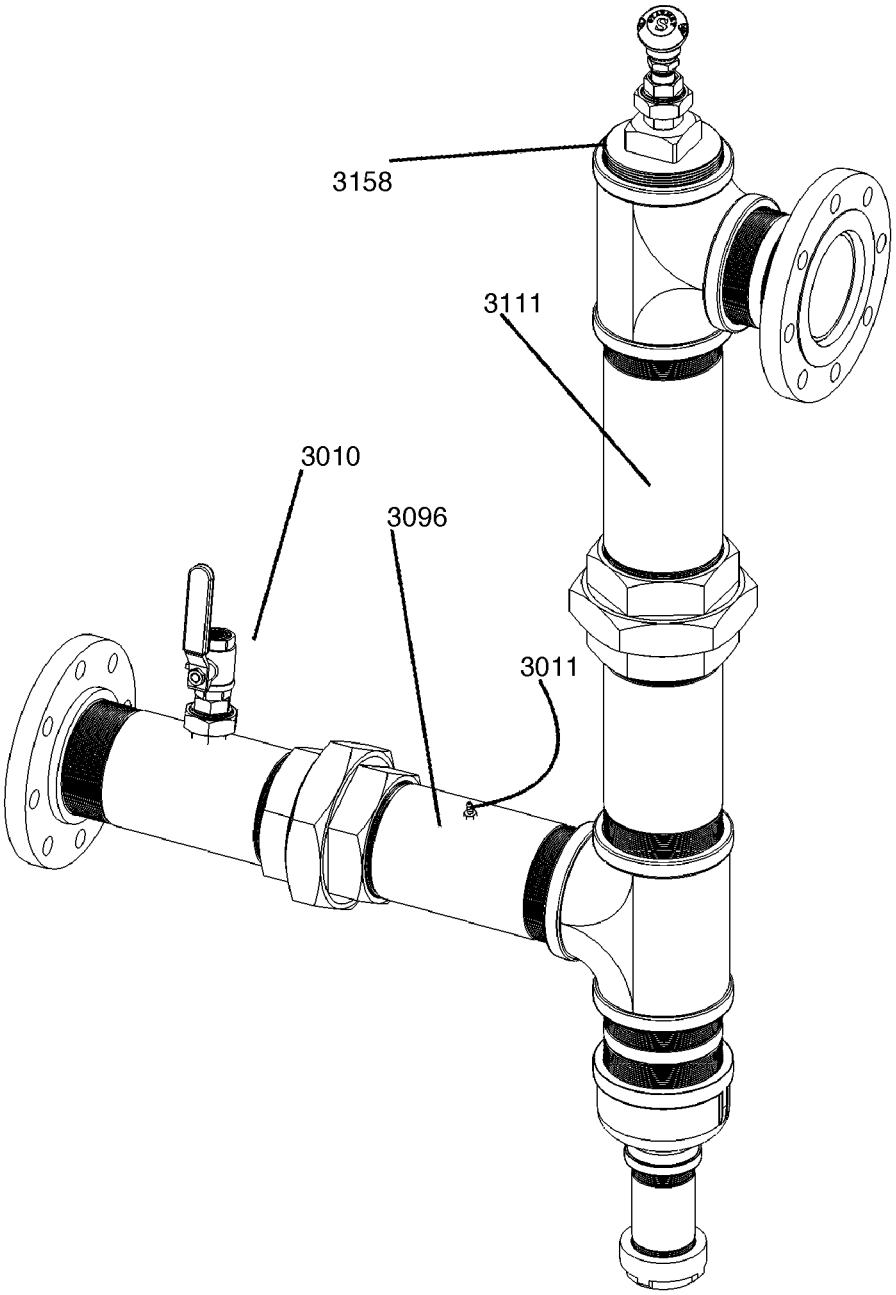
FIG. 78 is a perspective view which shows the mist to hydrophobic connection assembly.
Figure 79:
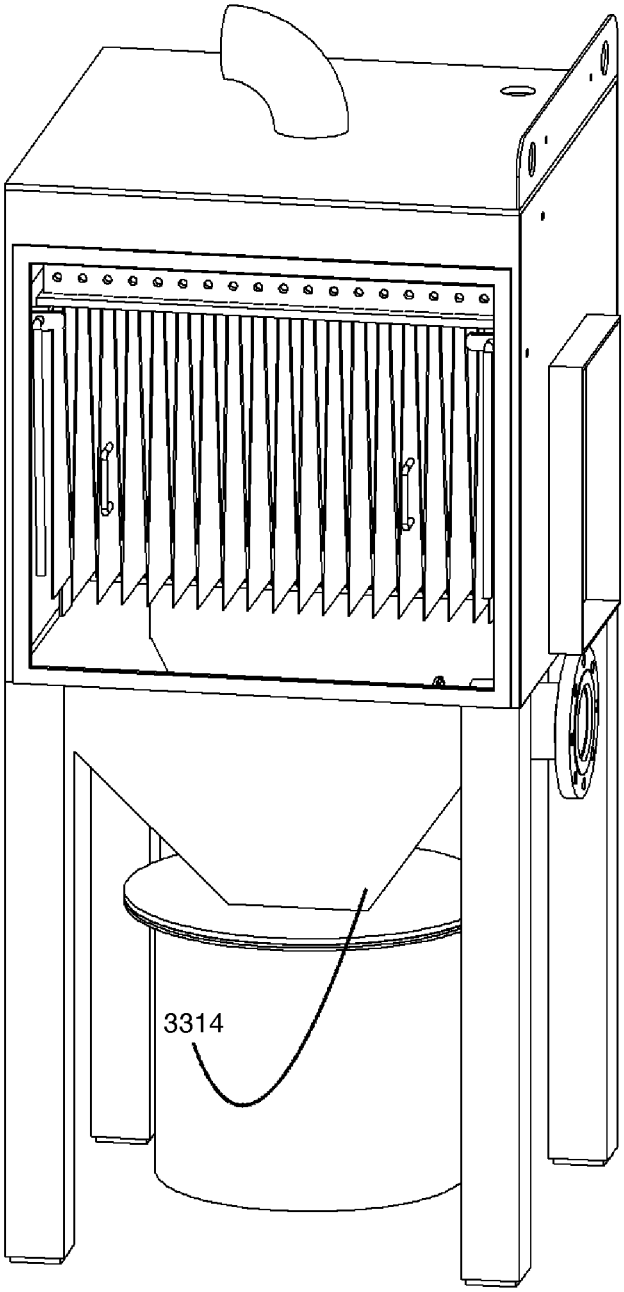
FIG. 79 is a perspective view which shows the baghouse for filtration.
Figure 80:
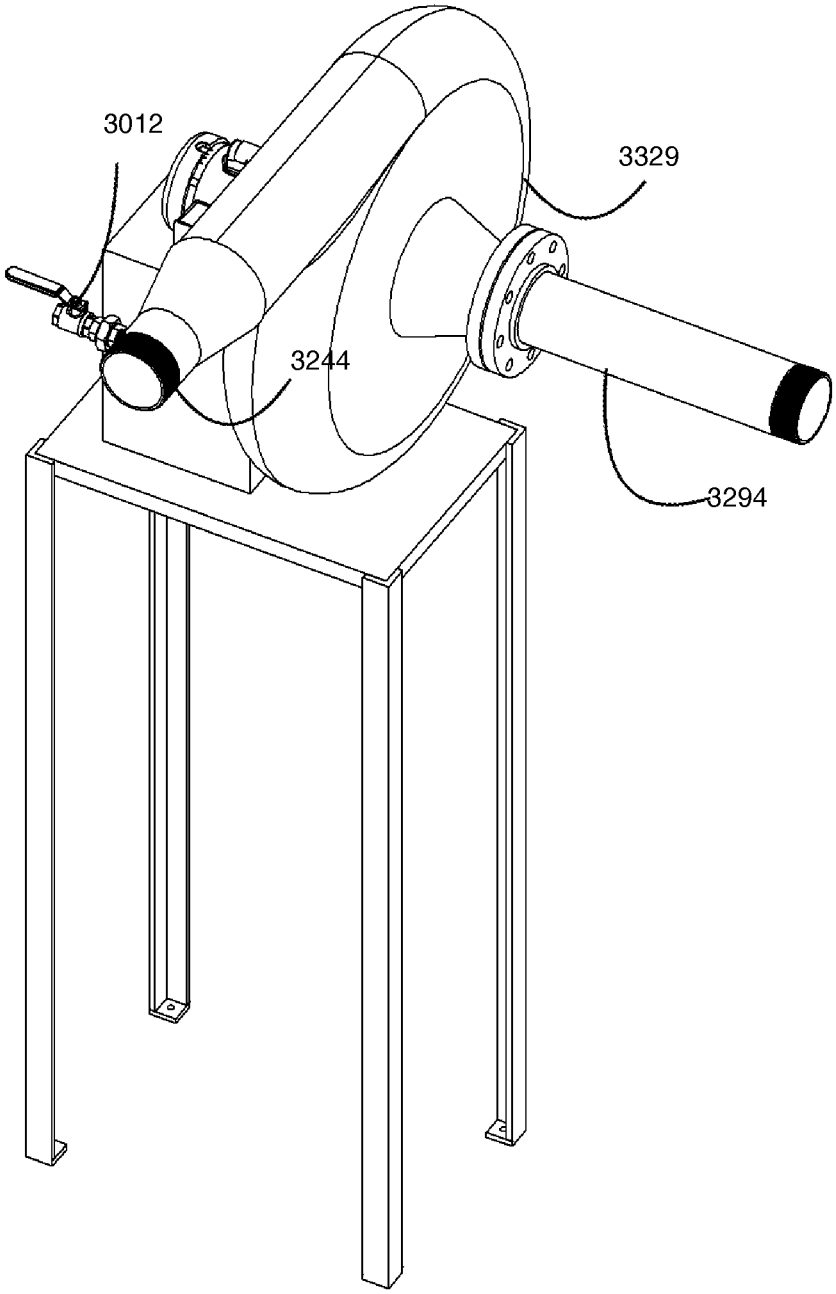
FIG. 80 is a perspective view which shows the blower assembly.
Figure 81:
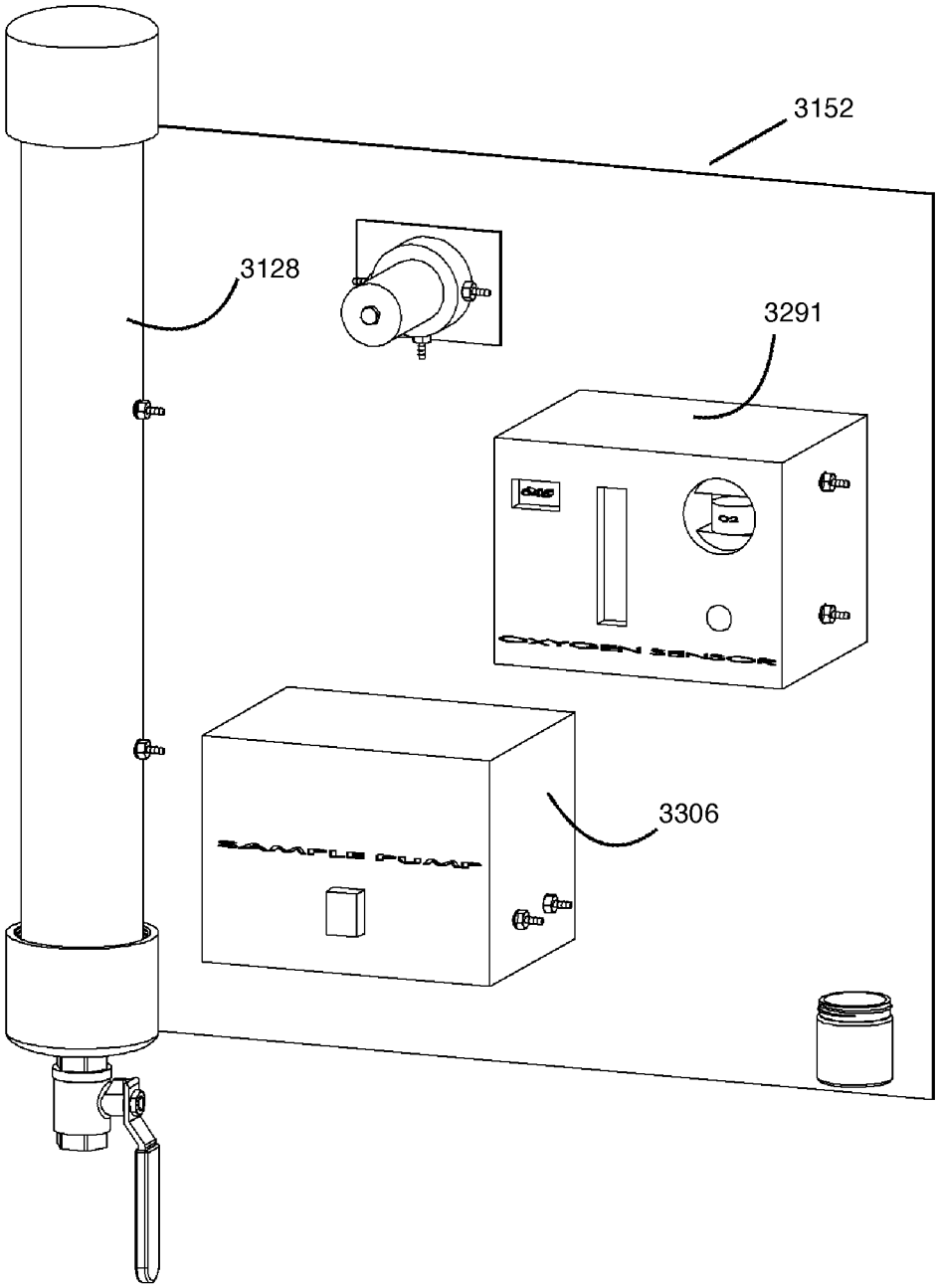
FIG. 81 is a perspective view which shows components of the oxygen sensor.
Figure 82:
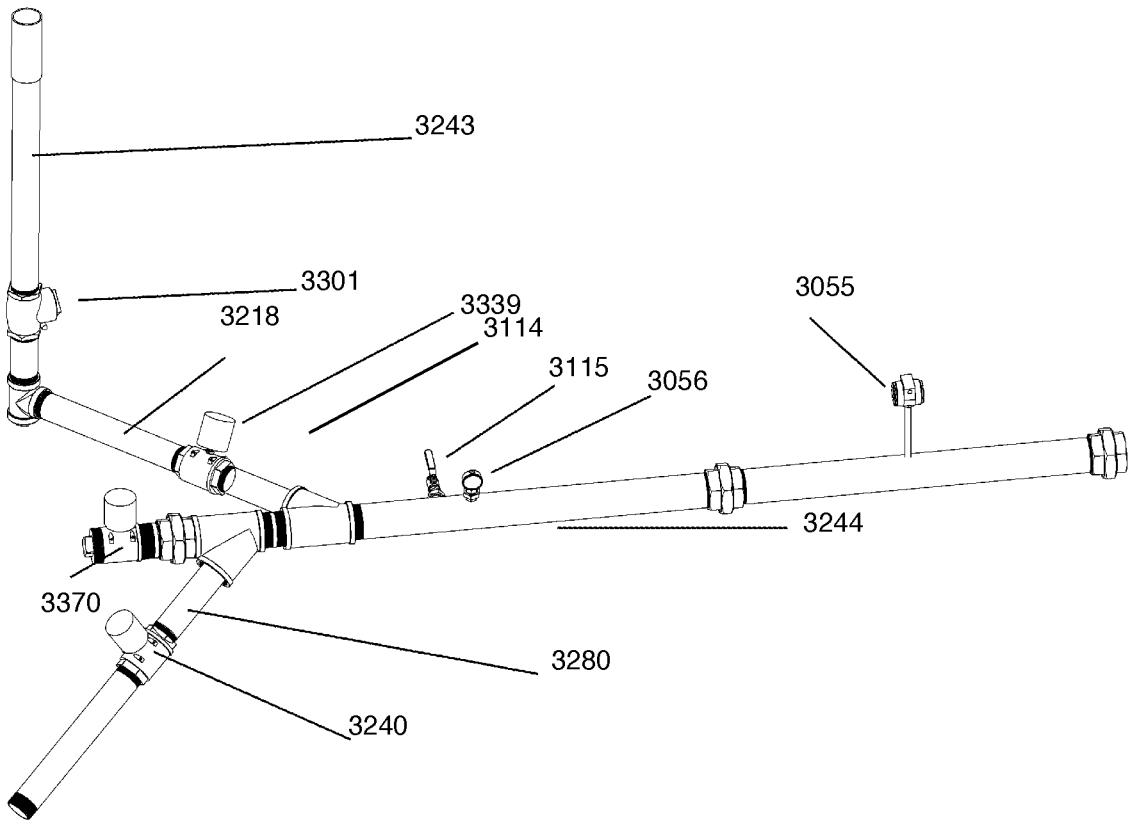
FIG. 82 is a perspective view which shows the blower exit pipe and exit pipe assembly.
Figure 83:
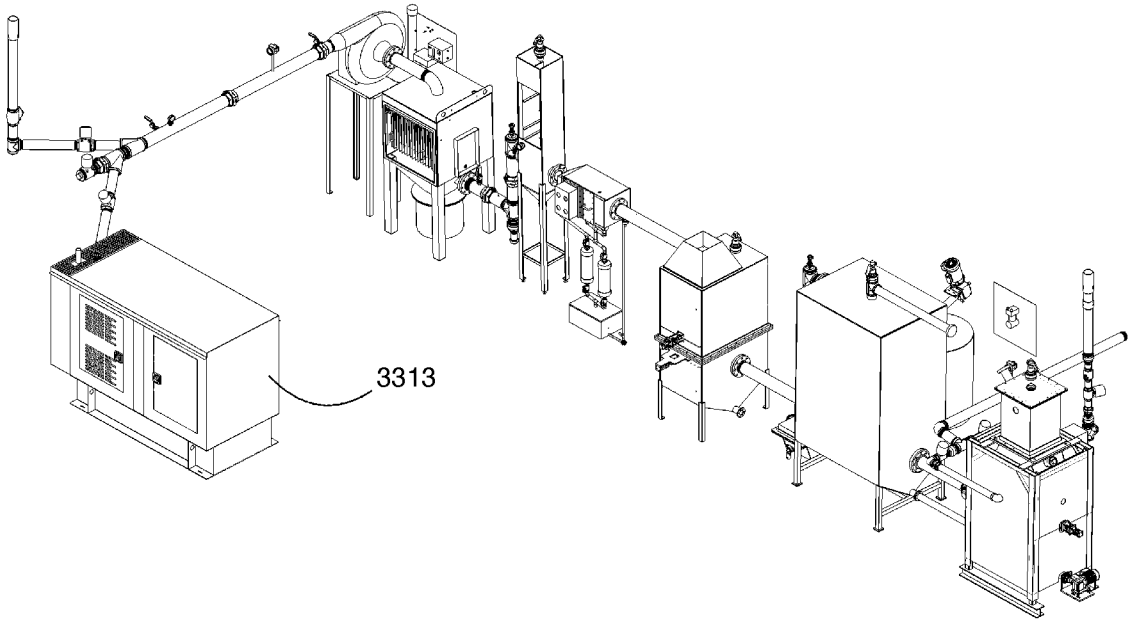
FIG. 83 is a perspective view which shows the arrangement of the biogasifier system including a generator.
Figure 84:
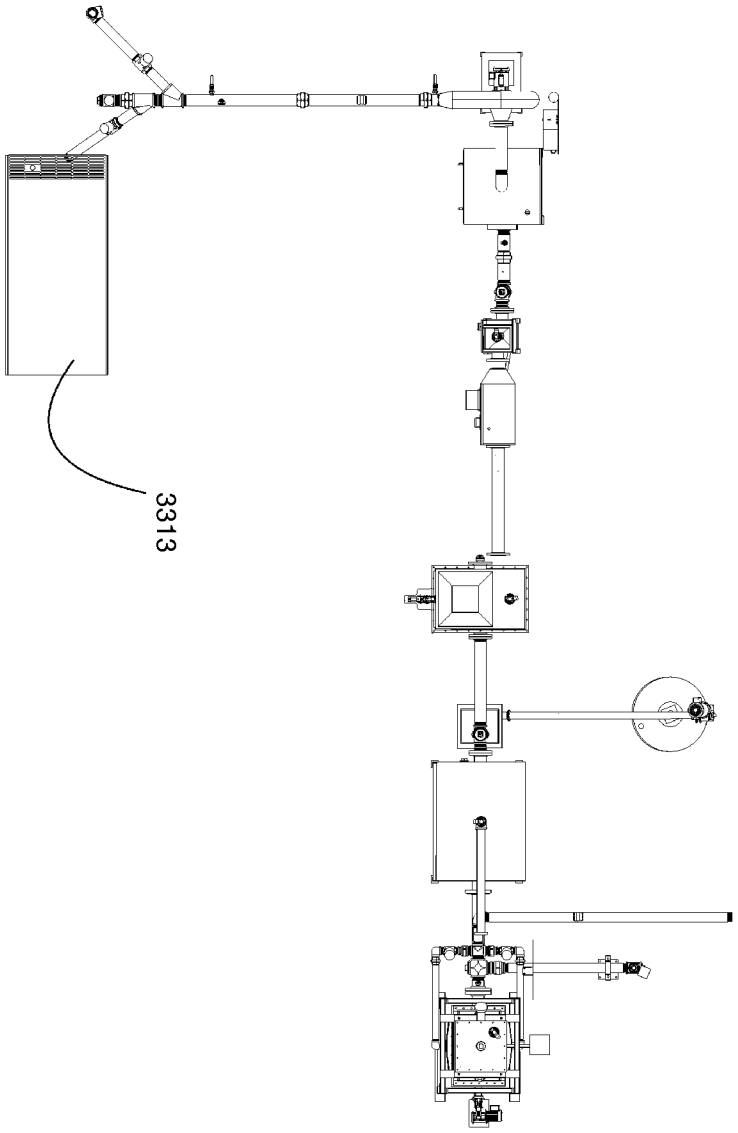
FIG. 84 is a birds eye view which shows the arrangement of the biogasifier system with a generator.
Figure 85:
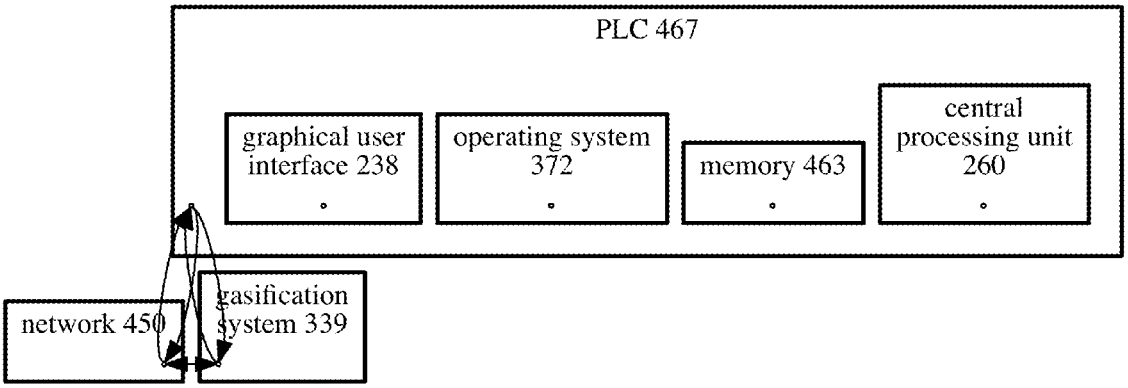
FIG. 85 is a diagram view which shows PLC computer and its components parts.
Figure 86:
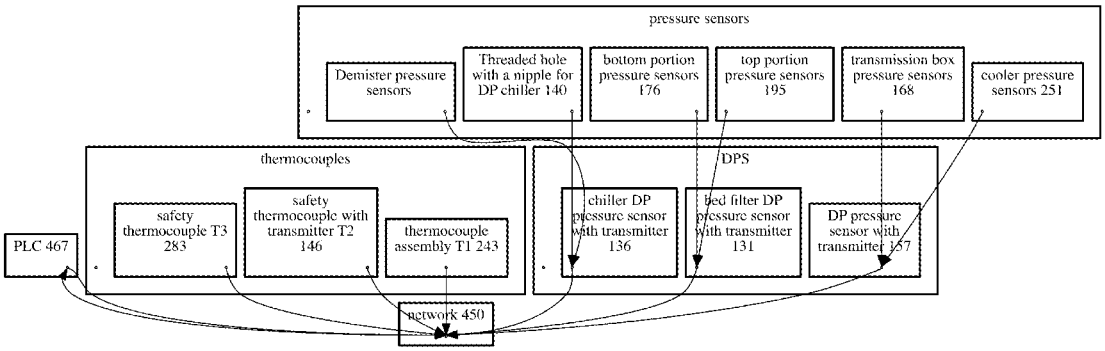
FIG. 86 is a diagram view which shows PLC computer and its inputs.
Figure 87:
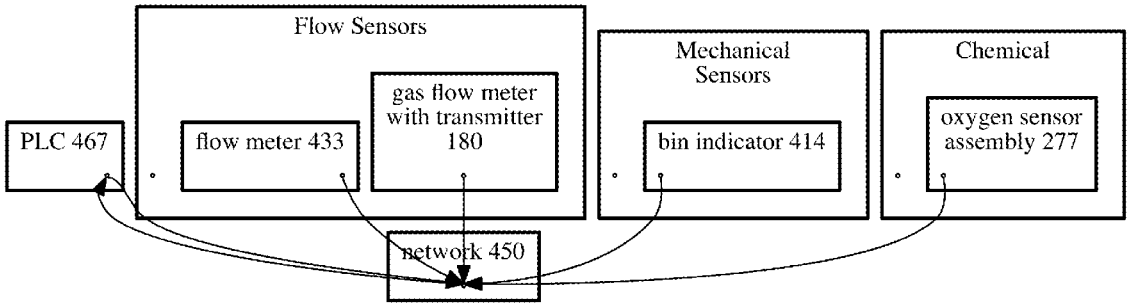
FIG. 87 is a diagram view which shows PLC computer and its inputs.
Figure 88:
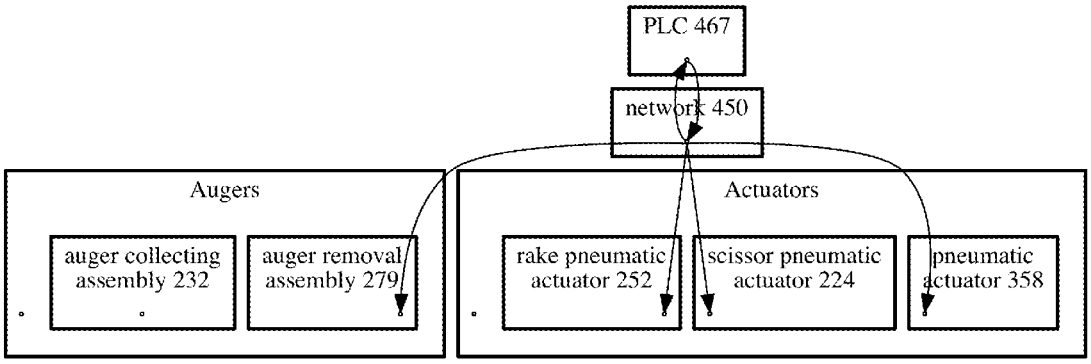
FIG. 88 is a diagram view which shows PLC computer and its output targets.
Figure 89:
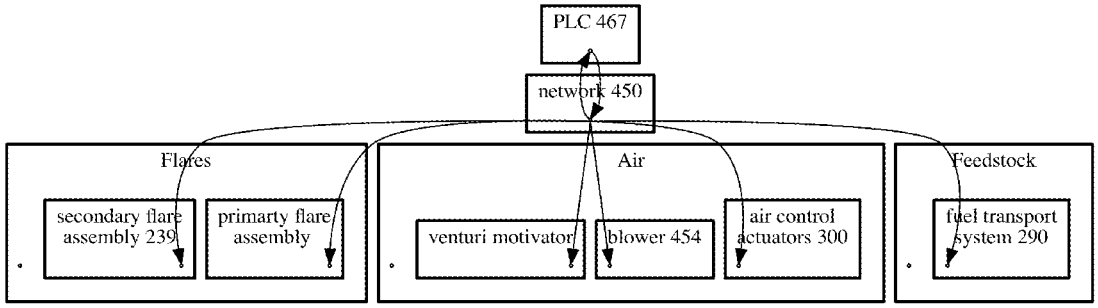
FIG. 89 is a diagram view which shows PLC computer and its output targets.

A preferred embodiment of the present invention is now described with reference to the figures, where like reference numbers indicate identical or functionally similar elements. Also in the figures, the leftmost digit of each reference number corresponds to the figure in which the reference number is first used. While specific configurations and arrangements are discussed, it should be understood that this is done for illustrative purposes only. A person of ordinary skill in the relevant art will recognize that other configurations and arrangements can be used without departing from the spirit and scope of the invention. It will be apparent to a person of ordinary skill in the relevant art that this invention can also be employed in a variety of other systems and applications.

In order to operate the instant invention, overall, fuel 3340 is first delivered to a gasifier 3320 (Step 101) (Step 1). More specifically, fuel 3340 is created and prepared for a gasifier 3320 housed within a gasifier frame 3276 (Step 201). The fuel 3340 comprises a fuel of a particular characteristics that permits energy efficient combustion within the system. In some embodiments, it is thought that examples of a fuel 3340 may include: wood, agriculture byproducts, cardboard paper, industrial byproducts, plastic, or organic waste.

Spatially, the gasifier frame 3276 is preferably positioned around the gasifier and comprises a hanging frame that allows for access to separate and remove components. The gasifier frame 3276 functions to protect the elements of the gasifier, add structure to the gasifier and afford protection from thermal expansion. In some embodiments, it is thought that if the gasifier frame 3276 is absent then other alternative for stabilizing and/or housing a gasifier 3320 may suffice. The gasifier frame 3276 preferably supports a gasifier 3320.

Spatially, the gasifier 3320 is preferably positioned within the gasifier frame 3276. The gasifier is used to move fuel from the top of the gasifier to the bottom, through the pyrolysis, combustion, and reduction zones to create syngas, tars, and particulates. It serves to employ a throat restriction that will not reduce air flow penetration ability. In some embodiments, a double throated gasifier may be used for larger designs. Further, the gasifier is insulated to reduce heat loss, improve cracking, and aid reduction conversions. Lastly, the gasifier 3320 has a linear design that allows for easier up-scaling purposes. It comprises a component that through pyrolysis, combustion, and reduction creates production gas, tars, and particulates. The gasifier is preferably shaped like a rectangle, which allows easy scalability. The gasifier 3320 preferably comprises a fuel transition box 3173, transition box/hopper modular connection elements, a hopper 3331, hearth/hopper modular connection elements, and finally a hearth assembly 3258. The modular construction of the gasifier allows for affordable and easy repairs.

After the fuel 3340 is created or prepared, the fuel 3340 enters a fuel transport system 3165 (Step 202), which comprises a system for supplying fuel to the gasifier. In some embodiments, it is thought that an example of a fuel transport system 3165 may be direct delivery of the fuel by manual means or perhaps an auger-based system and the like.

Once the fuel enters the fuel transport system 3165 it then is activated and delivers fuel 3340 to a fuel transition box 3173 (Step 203). Spatially, the fuel transition box 3173 is preferably positioned above, and attached to the top of the hopper. The fuel transition box 3173 comprises an insertion point for the fuel and a means for measuring the consumption of the fuel. In some embodiments, it is thought that if the fuel transition box 3173 is absent then a bin, or a combination of a bin and a fuel transition box 3173 may suffice in some embodiments. In some embodiments, the preferred volume of the fuel transition box is 20 liters. In other embodiments, the preferred volume of the fuel transition box can be calculated first determining the volume of the hearth, and adjusting the volume of the fuel transition box comparably larger or smaller based on the volume of the hearth. The fuel transition box 3173 preferably comprises a fuel transition box plate 3090, a fuel transition box relief valve 3041, a fuel transition box middle portion 3028, a fuel transition box bottom portion 3029, and finally a ceramic coating.

Spatially, the fuel transition box plate 3090 is preferably positioned above the fuel transition box middle portion 3028 and comprises the top portion of the fuel transition box 3173. The fuel transition box plate 3090 preferably comprises the fuel transmission inspection port 3044. Spatially, the fuel transmission inspection port 3044 is preferably positioned within the fuel transition box plate 3090. The fuel transmission inspection port 3044 comprises an aperture that allows one to see if the fuel level sensor is working correctly, or to check on the general health of the system.

On top of the fuel transition box 3173, the fuel transition box relief valve 3041 comprises a means for venting the fuel transition box 3173 that may occur in instances of high pressure. Within the interior of the fuel transition box, preferably there is a ceramic coating. The ceramic coating comprises a coating that prevents corrosion of the transition box at high temperatures. In some embodiments, it is thought that if the ceramic coating is absent then then it may still function, however may be less efficient.

Overall, described in a series of sub-steps below (301-304), the fuel 3340 is now inside the gasifier 3320 and it is converted to producer gas which then passes through the gasifier 3320. (Step 102). The first step of this is passing through the transition box (Step 301) which begins by the fuel 3340 entering through a feeder pipe hole 3246, within a fuel transition box middle portion 3028 (Step 401).

Spatially, the fuel transition box middle portion 3028 is preferably positioned above the box modular connection elements and below the fuel transition box plate 3090. The fuel transition box middle portion 3028 comprises the middle portion of the fuel transition box 3173 that additionally may comprise a feeder pipe hole 3246. Spatially, the feeder pipe hole 3246 is preferably positioned within the fuel transition box middle portion 3028 and is a means to have fuel enter into the transition box. In some embodiments, it is thought that if the feeder pipe hole 3246 is absent than the fuel may be fed by an auger, or perhaps an air tight dual gate feed hopper. Above the fuel transition box middle portion is the fuel transition box plate 3090.

Next, past the middle portion, the fuel drops into the fuel transition box bottom portion 3029 (Step 406) and then through the transition box/hopper modular connection elements 3002 (Step 407). Spatially, the fuel transition box bottom portion 3029 is preferably positioned above the hopper 3331 and below the fuel transition box middle portion 3028. Spatially, the transition box/hopper modular connection elements 3002 are preferably positioned between the fuel transition box 3173 and the hopper 3331. The transition box/hopper modular connection elements 3002 comprises a way to be able to remove the transition box to work on the system. In some embodiments, it is thought that an example of transition box/hopper modular connection elements may include a ceramic gasket and flange and the like. In some embodiments, it is thought that if the transition box/hopper modular connection elements 3002 is absent then a fixed welded structure may connect the transition box and the hopper. In some embodiments the transition box/hopper modular connection elements 3002 may additionally comprise a means for attachment to the gasifier frame 3276.

After the fuel passes through the transition box/hopper modular connection elements 3002, it then passes through the hopper 3331 (Step 302). The hopper comprises a structure that houses the pyrolisis zone where moisture is removed and the fuel detection system that monitors fuel levels. Spatially, the hopper is preferably positioned above the hearth and below the transmission box. The hopper is preferably shaped outwardly sloping which prevents bridging of feed stock. The volume of the hopper can be calculated by maintaining the ratio of the volume of the hopper as compared to volume of hearth size.

In some embodiments, it is thought that if the hopper is absent then the Hearth Assembly 3258 and/or transition box may be one piece that feeds fuel into the hearth. The hopper has many purposes which are as follows: First, the purpose of the hopper is to house the pyrolisis zone where moisture is removed. Next, it serves to prevent bridging of briquettes. Further, the hopper serves to houses the fuel detection system to monitor fuel levels. The hopper has an alternative embodiment, wherein the hopper comprises baffles for fuel management. The hopper preferably comprises hopper top portion, hopper middle portion, hopper bottom portion, and finally hopper interior walls. The fuel first enters the hopper through a hopper top portion 3217 (Step 501), which is preferably positioned above the hopper middle portion 3171 and below fuel transition box bottom portion 3029. Next, the fuel 3340 passes through a hopper middle portion 3171 (Step 502). Spatially, the hopper middle portion 3171 is preferably positioned above the hopper bottom portion 3169 and below the hopper top portion 3217. The hopper middle portion 3171 preferably comprises a fuel level detection system 3080 and in some embodiments, a hopper inspection port 3148.

The hopper middle portion 3171 has an alternative embodiment herein termed the 'with shield' embodiment. The 'with shield' embodiment is one where the rotation of the fuel level sensor is protected by a shield so that it sensing is ideally indicated only by the level of the fuel below it. The shield further functions to evenly disperse the fuel as it enter it enters the hopper.

The hopper inspection port 3148 comprises a means for inspecting the combustion zone and top portions of the castable refractory 3198. This allows safety and efficiency examinations of the system. The fuel level detection system 3080 allows detection of the fuel level within the hopper. Preferably, this comprises a fuel level sensor 3289. Preferably, the physical detection system means is mechanical because optic, weight and timing mechanisms have been shown to be less effective (though other and these technologies may work, in some embodiments). In some embodiments, it is thought that an example of a fuel level detection system 3080 could be laser sensors or perhaps infrared sensors and the like (although experimentally optic, weight and timing mechanisms have been shown to be less effective).

Next, within the hopper middle portion 3171, a fuel level detection system 3080, such as a fuel level sensor 3289 provides a feedback regulation of fuel level (Step 503). If the fuel level detection system 3080 determines fuel is low (Step 504) then fuel 3340 would then be input back into the fuel transition box 3173 as in (Step 401). If the fuel level detection system 3080 determines that fuel level is sufficient (Step 505), then the fuel 3340 passes through a hopper bottom portion 3169, where pyrolysis may occur in the pyrolysis zone 3273 (Step 506).

Spatially, the fuel level sensor 3289 is preferably positioned extending into the hopper middle portion 3171 and extending outside the gasifier 3320. It comprises a mechanically actuated device that rotates in order to check whether or not the fuel is consumed and acts as a sensor and is operably connected to the PLC 3342. The fuel level sensor 3289 preferably comprises the fuel level sensor interior portion 3062 and the fuel level sensor exterior portion 3063. The fuel level sensor interior portion 3062 comprises the part of the fuel level sensor 3289 that is inside the hopper and the fuel level sensor exterior portion 3063 comprises the part of the fuel level sensor 3289 that is outside the hopper. The fuel level sensor exterior portion 3063 preferably comprises the fuel level sensor exterior housing 3061, which, in turn, comprises the fuel level sensor transmitter 3105 and the fuel level sensor motor 3207. The fuel level sensor transmitter 3105 comprises a means for communicating with the PLC 3342 for feedback regulation of the fuel level.

As the fuel 3340 passes through into hopper bottom portion 3169 pyrolysis may occur in a pyrolysis zone 3273 (Step 506). Spatially, the hopper bottom portion 3169 is preferably positioned above the hearth assembly 3258 and below the hopper middle portion 3171. The hopper bottom portion 3169 comprises the lower portion of the hopper where pyrolyisis largely occurs and has a pyrolysis zone 3273 and a preheating zone 3263. The preheating zone 3263 comprises a region that removes moisture and the pyrolysis zone 3273 comprises a region where there is little oxygen and volatiles are removed from the fuel 3340. Spatially, the pyrolysis zone is preferably positioned within the hopper bottom portion. In addition, on the interior of the hopper 3331 are hopper interior walls 3172 mainly thought to be coated with phosphate alumina or ceramic however, it is thought that in alternative embodiments that the coating for the hopper interior walls 3172 may be absent. The interior walls, on the inside surface of the hopper comprises a unique outwardly sloping shape and are surrounded by the pyrolysis zone.

Next the fuel 3340 passes through hearth/hopper modular connection elements 3016 (Step 507). The hearth/hopper modular connection elements 3016 comprises the connection elements that operably connect to the hopper to the hearth assembly 3258. One goal of the hearth/hopper modular connection elements 3016 is to be able to remove the hopper component in order to work/manage the system. In some embodiments, it is thought that an example of hearth/hopper modular connection elements may include a ceramic gasket and flange and the like. In some embodiments, it is thought that if the hearth/hopper modular connection elements 3016 are absent then a fixed welded structure may connect the Hearth Assembly 3258 and the hopper 3331. In some embodiments, the hearth/hopper modular connection elements may additionally comprise a means for attaching to the gasifier frame 3276.

Next the fuel 3340 passes into a hearth assembly 3258. Overall, as described in substeps 601-606, this is the region where the fuel is combusted then converted into the producer gas and the producer gas exits the hearth assembly 3258 (Step 303). The hearth assembly 3258 comprises the functional components of the hearth responsible for the gasification and transport of the fuel. Spatially, the hearth assembly 3258 is preferably positioned below the hopper. In some embodiments, the preferred volume of the hearth assembly 3258 is dynamic and can be calculated by maintaining a ratio of volume between the Hearth Assembly 3258 as compared to volume of hearth, overall. The hearth assembly 3258 preferably comprises a castable refractory 3198, a ceramic flange 3265, and finally an ash module assembly 3206.

The first portion of the hearth assembly 3258 that the fuel enters is the hearth. Here it enters the hearth combustion zone 3251 of the castable refractory 3198 where the fuel 3340 hearth residence time is determined by physical impedance with a grate assembly 3277 located below it within the ash module assembly 3206 and the hearth throat 3281 (Step 601). The castable refractory, also known as the throat of the gasifier comprises primary the component where combustion occurs and preferably has a rectilinear shape. The castable refractory has been carefully constructed to completely cover any steel exposed to high temperatures. The castable refractory 3198 is preferably positioned below the hopper 3331, and within the hearth assembly 3258 and comprises a hearth outside surface 3141, a hearth interior region 3159, and finally an air injection system 3191.

In order to combust the fuel and create producer gas for energy, air is pulled in through an air injection system 3191 mediated by the blower 3329 (Step 602). Spatially, the air injection system is preferably positioned outside the hearth. The air injection system 3191 comprises the components that mediate airflow into the castable refractory 3198 that can be regulated so as to affect the combustion. Some embodiments may gather data on the air flow. The air injection system 3191 preferably comprises an air intake pipe 3250, an intake flow/inlet coupling 3322, and finally flow inlet pipes. The air injection system 3191 has an alternative embodiment herein termed the 'oxygen delivery system' embodiment. This embodiment comprises to provide air to the hearth via injection of oxygen rather than air from the air injection system.

Air is pulled in and passes through an air intake pipe 3250 and may pass one or more flow meter 3308 (Step 701). Spatially, the air intake pipe 3250 is preferably positioned before the intake flow/inlet coupling 3081 and comprises main pipe through which air flow enters in the castable refractory 3198 for combustion. In some embodiments, the air intake pipe 3250 preferably comprises the flow meter 3308, a sensor that allows measurement of the air flow of the air injection system operably connected to the PLC 3342. One goal of the air intake pipe is to mediate air flow for combustion.

As air continues on, it passes through one or more air control actuators 3175 within an (Step 702) These air control actuators operably connect to the PLC 3342 and are used in concert with one or more air flow meters to control the output of the gasifier. The intake flow/inlet coupling 3081 houses the air control assembly 3189. Spatially, the intake flow/inlet coupling 3081 is preferably positioned after the air intake pipe 3250 and before the air control assembly 3189. It allows the splitting of the air into the two air control assemblies. The air control assembly 3189 is preferably positioned after the air intake pipe 3250 and comprises the components that can control airflow and operably connect the manifold and the air intake pipe 3250. The air control assembly 3189 preferably comprises the air control actuators 3175. The air control actuators 3175 comprise devices that can be manipulated in order to control the rate of air flow into a manifold and operably communicate with the PLC 3342. Spatially, the air control actuators are preferably positioned after the air intake pipe.

Continuing, air passes through one or more flow inlet pipes (Step 703). The flow inlet pipes comprises a set of pipes that operably connect the air injection system to one or more manifolds. They operably attach to the manifold removal part 3180 and have a preferred angle of 20 degrees, which slope to the manifold and prevents water accumulation.

Next, air passes through one or more air inlet removable manifold 3079 (Step 704). Spatially, the air inlet removable manifold 3079 is preferably positioned outside the hearth outside surface 3141 and comprises a detachable component that allows air injection to be distributed through one or more air ferrules 3297. It is preferably shaped like a rectangle however, it is thought that in alternative embodiments that it may also be shaped like a triangle. The air inlet removable manifold 3079 functions to both 1) have an easily removable component that comes apart at flange and that 2) allows the manifold to be easily cleaned. The air inlet removable manifold 3079 preferably comprises a manifold inside region 3140, a manifold connection flange 3095, and finally a manifold removal part 3180.

Spatially, the manifold inside region 3140 is preferably positioned surrounding the air ferrules 3297 and attaches to the hearth outside surface 3141. The manifold inside region 3140 comprises portion of the manifold that is connected to the castable refractory 3198. The manifold inside region is preferably shaped like a rectangle, however may be other shapes in other embodiments. The manifold connection flange 3095 is preferably positioned between the manifold inside region 3140 and the manifold removal part 3180. It comprises the connection element that allows modularity of the manifold. The manifold removal part 3180 is attached to the air injection system 3191 and comprises part of the manifold that allows interconnection from the castable refractory 3198. Spatially, the manifold removal part is preferably positioned opposing the manifold inside region and outside the hearth.

Continuing, air passes through one or more air ferrules 3297 (Step 705). Spatially, the air ferrules 3297 are preferably positioned within the hearth interior region 3159 and entering the hearth inside cavity 3188. The air ferrules 3297 are mainly thought to be composed of ceramic however, it is thought that in alternative embodiments that the air ferrules 3297 may also be composed of silica and alumina and the like. The air ferrules 3297 comprise conduits that connect the manifold system into the hearth inside cavity 3188 for combustion. They are flanged (termed a location collar) to prevent movement during high temperatures. These location collars comprise a structural entity preventing sliding or dislocation of one or more air ferrules because of the heat and connect to the hearth outside surface 3141. Spatially, The location collar is preferably positioned on the exterior of the hearth and on the distal portion of the location collar.

The hearth outside surface 3141 comprises the outside part of the hearth that connects to one or more manifolds and may be encased in ceramic. The hearth outside surface 3141 surrounds the hearth interior region 3159 and when cast makes the castable refractory 3198. This region preferably comprises air ferrules, inconel anchors, an ignition port 3279, a ceramic insulation board 3116, and finally a hearth inside cavity 3188 where combustion occurs. The hearth outside surface is mainly thought to be composed of stainless steel, however in other embodiments may be composed of other materials.

Spatially, the inconel anchors 3256 are preferably positioned within the hearth interior region 3159 and surrounding the combustion zone 3251. The inconel anchors 3256 comprises objects that stabilize the ceramic when casting the hearth. The inconel anchors 3256 are preferably shaped like 'Y' however, it is thought that in alternative embodiments that it may also be shaped like a 'W' or alternatively like a 'T'.

Similar to the air ferrules, the ignition port 3279 spans the hearth interior region 3159. The ignition port 3279 is preferably shaped like cylinder or tube. Spatially, the ignition port is preferably positioned within the hearth interior region at even distances from side to side. The ignition port is mainly thought to be composed of ceramic and functions to both 1) allow the placing of a thermocouple into the hearth and to 2) allow one to measure pressure differentials with one or more sensors. It comprises an aperture through the hearth interior region 3159 which allows the placing of a thermocouple into the hearth. Also in the hearth is the ceramic insulation board 3116. The ceramic insulation fiber board is cast into the hearth interior region 3159 surrounding the hearth inside cavity 3188 and within the hearth outer wall. It prevents high temperatures from exiting the castable refractory 3198. After casting of the refractory a refractory coating is applied to the hearth inside surface 3163. Preferably, this is a phosphate bonded alumina coating set through baking that provides high abrasion and corrosive resistance and anti-slagging characteristics.

Next, the air passes into the hearth combustion zone 3251 (Step 706) within the hearth inside cavity 3188. Spatially, the hearth inside cavity 3188 is preferably positioned adjacent to the hearth interior region 3159 and comprises the region of the hearth wherein fuel reactions mainly occur. The hearth inside cavity 3188 preferably comprises a hearth combustion zone 3251, a hearth throat 3281, a reduction zone 3271, and finally a hearth inside surface 3163. The hearth combustion zone 3251 is preferably positioned above the reduction zone 3271, the hearth throat, and within the hearth inside cavity. It comprises the region of the hearth inside cavity 3188 that creates CO2, steam, ash and carbon from the fuel 3340. Preferably, the hearth combustion zone 3251 comprises an entry angle surface 3201 that narrows towards the throat. The combustion zone is mainly thought to be composed of silica and alumina and is preferably shaped as a rectangle or liner, however may be composed of other materials and have other shapes in other embodiments.

As the fuel reacts, the blower 3329 pulls the fuel combustion components 3089 through the carbon bed within the hearth throat 3281 and then reduction zone 3271 (Step 604). Spatially, the hearth throat 3281 is preferably positioned above the reduction zone 3271 and below the hearth combustion zone 3251. The hearth throat 3281 enhances the mixing of the combustion gases by its shape and preferably has a reducer angle of 36.53 degrees. The hearth throat 3281 preferably comprises a hearth throat midline 3174, a central surface 3257, an entry residence region 3151, and finally a gas compression region 3153. The entry residence region 3151 forces fuel to stay in the proximity so that it can be combusted.

Spatially, the hearth throat midline 3174 is preferably positioned below the entry angle surface 3201 and above the exit angle surface 3221 and comprises the midline center of the hearth throat 3281. Spatially, the entry angle surface 3201 is preferably positioned below the ferrules and above the central surface 3257 and comprises the portion of the hearth throat 3281 that slopes towards the central surface 3257. Spatially, the exit angle surface 3221 is preferably positioned below the ferrules and above the midline. The exit angle surface 3221 comprises the portion of the hearth throat 3281 that slopes away from the central surface 3257. Spatially, the central surface 3257 is preferably positioned below the entry angle surface 3201 and above the exit angle surface 3221 and comprises the portion of the hearth throat 3281 that has the smallest aperture breadth and is closest to the midline.

The gas compression region 3153 forces gases to interact with each other and increase the velocity of the gases when pulled. The reduction zone 3271 within the hearth inside cavity 3188 comprises a region of the castable refractory 3198 where gas is pulled through a hot bed of carbon which acts as a catalyst/reactant, in order to make CO and H2 from CO2 and H2O. The reduction zone 3271 comprises an exit angle surface 3221 which opens towards the ash module assembly 3206. The reduction zone is preferably positioned near the air inlets, within the hearth inside surface, and below the hearth throat.

The hearth inside surface 3163 is the lining of the interior surface of the refractory wherein combustion and reduction take place is preferably coated with phosphate alumina. The hearth inside surface 3163 functions to both 1) prevent bridging and 2) allows smooth flow of fuel to the combustion zone. Spatially, the hearth inside surface is preferably positioned surrounding the internal cavity of the hearth.

As the reduction zone creates producer gas via available carbon (Step 605), next, the producer gas passes through the ceramic flange 3265 and into the ash module assembly 3206 (Step 606). Overall, as detailed in steps 801-806, the producer gas then passes through the ash module assembly 3206 (Step 304) and out of the gasifier. Spatially, the ash module assembly 3206 is preferably positioned below the castable refractory 3198 and functions to both 1) keep the interstitial spacing in the carbon open to gas flow, 2) increase the surface area of available carbon 3) collect the producer gas and 4) increase the residence time of the fuel in the combustion zone. The ash module assembly 3206 particularly enhances the function of the gasifier by having a particulate separator built into the architecture of the gas outlet in the ash module. The ash module assembly preferably comprises a grate and shaker assembly 3104, an actuator shaker assembly 3185, a gas collection assembly 3130, and finally a stainless steel box with flange 3049.

Within ash module assembly 3206 the producer gas first passes through char and ash stacked on top of the grate assembly 3277 (Step 801). Spatially, the grate and shaker assembly 3104 is preferably positioned above the gas collection assembly 3130 and in the top of the ash module assembly 3206. The grate and shaker assembly comprises a combination of components that make the grate and the actuator assembly for regularly shaking the grate. The grate and shaker assembly 3104 comprises the grate assembly 3277 and actuator shaker assembly 3350. Spatially, the grate assembly 3277 is preferably positioned at the top of the ash module and near the reduction zone. The grate assembly comprises a component designed to level the bed to prevent bridging and modulate the differential pressure inside the gasifier. In some embodiments, its purpose is to form a platform in order to increase residence time. In turn, the grate assembly 3277 preferably comprises angle irons, plates, grate rod separators, and finally grate rods.

The angle iron is preferably positioned on the lateral sides of the grate assembly 3277 and form the support structures that creates channels and support for the grate rods. One goal of the angle iron is to support one or more grate slat. The angle iron preferably comprises plates. These are separating structures between rods of the grate assembly 3277. Spatially, the grate rods 3310 are preferably positioned in between the plates grate rod separator. The grate rods 3310 comprises the individual rods within the assembly that can move independently with the grate shaker. They form a grate that is actuated back and forth that allows the carbon to be continually exposed for increased surface area.

The grate and shaker assembly is connected in part with the actuator shaker assembly 3350 via the rods that connect the angle iron 3351 to the actuator rods. The actuator shaker assembly comprises a pneumatic means to move the rods of the ash module assembly. In some embodiments, it is thought that the actuator shaker assembly 3350 may shake not only the grate assembly 3277 but other parts of the system overall. In other embodiments, an example of an actuator shaker assembly could be a cam mechanism or a rotating mechanism, or perhaps an hydraulic means to otherwise move the grate and the like.

The PLC 3342 signal is received to a pneumatic actuator 3233 within the actuator shaker assembly 3350 (Step 901) and then moves the actuating components operably connected to the grate assembly 3277 (Step 902). The actuator shaker assembly preferably comprises a pneumatic actuator 3233, clevis, bushing plate with bearing 3094, linear bearing, actuator mounting, an aperture pipe with flange 3109, and finally a split pipe support bushing the end of the actuator rods.

Spatially, the pneumatic actuator 3233 is preferably positioned at apical end of the actuator shaker assembly. The pneumatic actuator 3233 comprises the physical mechanisms which initiate actuation. The pneumatic actuator 3233 is regulated by the PLC 3342 which controls the method, speed or impact of actuation. This allows actuation changes by different parameters input from other parts of the system such as pressure, speed or other variables, these are preferably controlled by the PLC.

The bushing plate with bearing 3094 preferably comprises 1) a shaker interface rod, which connects to the actuator, 2) a joining pipe 3317 which connects the shaker interface rod with the actuator rod and finally 3) actuator rod and disks. The shaker interface rod 3182 comprises a component that joins the cylinder with the actuator rod. The shaker interface rod 3182 preferably comprises the actuator disk and the actuator disk aperture.

The actuator disk interacts with the grate slat via an actuator disk aperture around one or more grate slat. The joining pipe 3317 is joins the cylinder with the actuator rod. The actuator rod and disks preferably comprises the rod hole connector 3222 and the actuator pipe hole connector 3072. The actuator pipe hole connector 3072 joins the cylinder withe the actuator rod. The linear bearing comprises a bearing designed to provide free motion in one direction and the actuator mounting comprises a support for the actuator.

Next, producer gas and ash pass into the gas collection assembly 3130 (Step 803). The gas collection assembly 3130 is preferably positioned below the actuator shaker assembly 3350 and above the outlet pipes of the auger removal assembly 3154. The gas collection assembly 3130 comprises the components that collect and further transport the gas through the system. The gas collection assembly 3130 functions to both 1) allow the gas to drop particulate and to 2) allow the capture of a significant amount of potentially downstream particulates early in the process, allowing an easier later filtering process. The gas collection assembly 3130 preferably comprises the V shield with support 3176 and the gas collection pipe 3211.

The V shield with support 3176 is preferably positioned surrounding the gas collection pipe 3211 and within the gas collection assembly 3130. The V shield with support 3176 comprises a v-shaped structure that prevents particulates from entering the gas collection pipe 3211. The gas collection pipe 3211 is preferably positioned under the V shield with support 3176 and comprises a pipe with an opening on the top covered by a metal stainless steel shield allowing the ash to efficiently fall to the ash removal collection point. The gas collection pipe 3211 minimizes the entrainment of ash in the gas aiding in keeping equipment downstream clean. The gas collection pipe 3211 preferably comprises the gas exit aperture 3236 and the gas pipe flange 3255. The gas exit aperture 3236 is preferably positioned on the dorsal surface of the gas collection pipe 3211 and under the v-shield. It comprises an aperture facing up that collects the gas for further transport down the system and allows gas to enter the gas collection pipe 3211. The gas pipe flange 3255 is preferably positioned on the interior surface of the gas collection assembly 3130 and comprises the connection means that binds the gas collection pipe 3211 to the ash module and transports it to the Se rectilinear cyclonic cooler 3088. Much of this process occurs within the housing of the ash module, herein termed the stainless steel box with flange 3049. It is preferably positioned surrounding the ash module 3334.

Next the producer gas exits the gasifier and enters into the flare assembly (Step 103), where it enters the thermocouple assembly T1 3118 of the flare exit pipe assembly 3120 (Step 1001). The primary flare assembly 3149 comprises a gas transport and measurement system in between the cyclone cooler and the gasifier. The primary flare assembly 3149 functions to vent off the low quality gas when the temperature is below a threshold that may contaminate the filtration system. In some embodiments, it is thought that an example of a primary flare assembly 3149 may include a thermal oxidizer and the like. The primary flare assembly is mainly thought to be composed of steel, however may be composed of other materials in other embodiments. The primary flare assembly 3149 preferably comprises a flare exit pipe assembly 3120, a flare horizontal bottom pipe 3069, a bottom/vertical pipe assembly 3053, and finally a flare vertical pipe 3196.

Next, producer gas exiting the ash module assembly 3206 enters the thermocouple assembly T1 3118 of the flare exit pipe assembly 3120 (Step 1001). The flare exit pipe assembly 3120 comprises components that mediate transit of the producer gas to the primary flare assembly 3149 or the cooler. In addition, the flare exit pipe assembly 3120 preferably comprises the thermocouple assembly T1 3118 where the producer gas enters. The thermocouple assembly T1 3118 is preferably positioned outside the ash module 3334 and comprises components that house the means for measuring the temperature in the primary flare assembly 3149. The thermocouple assembly T1 3118 preferably comprises a coupling 3322, a thermocouple with shield 3352, and finally a PLC transmitter 3252. The coupling 3322 is preferably positioned after the thermocouple and comprises pipe components that vent the gas either to the flare or cooler. The thermocouple with shield 3352 is preferably positioned within the coupling 3322 and comprises a sensor that reads the temperature of the gas for safety and automated control. Spatially, the PLC transmitter 3252 is preferably positioned adjacent to the thermocouple assembly T1 3118 and comprises a transmitter that monitors the thermocouple data.

Next the thermocouple with shield 3352 detects whether the producer gas is within the flare venting temperature (Step 1002). If the producer gas is below the flare venting temperature, then the producer gas is directed via the coupling 3322 directing the gas to the flare horizontal bottom pipe 3069. Spatially, the flare horizontal bottom pipe 3069 is preferably positioned after the thermocouple assembly T1 3118 and before the flare vertical pipe 3196. It comprises a pipe that leads to the flare from the thermocouple.

Next the producer gas passes through the bottom/vertical pipe assembly 3053. Spatially, the bottom/vertical pipe assembly 3053 is preferably positioned before the vertical pipe and after the thermocouple assembly T1 3118. It comprises a coupling that connects the bottom and vertical pipes of the flare. Next, the producer gas passes into a flare vertical pipe 3196. The flare vertical pipe 3196 comprises a component that leads to the flare tip. It comprises a valve assembly, a venturi motivator, and finally a flare end with ignition component.

Next, the producer gas passes through an open valve assembly 3269. The valve assembly comprises the components that allow control of the gas to the flare tip. It preferably comprises an automatic valve (and in some embodiments, a manual valve). In some embodiments, a goal of the valve assembly is to vent off bad gas when temperature is below 400. Next producer gas flow is aided by a venturi motivator. The venturi motivator comprises component that uses injected air to create movement gas towards the flare tip. In some embodiments, it is thought that if the venturi motivator is absent then a fan may suffice for creating gas movement. In some embodiments, it is thought that an example of venturi motivator may include a fan and the like. Finally, if vented, the producer gas enters a flare end with ignition component 3045 and is ignited. The flare end with ignition component comprises a region of mixing air and gas and igniting them with a pilot powered by a constant fuel stream. (secondary fuel to ensure combustion).

If the producer gas is above the flare venting temperature, then the primary flare valve shuts, the venturi valve shuts, the secondary flare valve 3370 opens, then the blower starts. Subsequently, producer gas passes through the thermocouple assembly and pipe and into the rectilinear cyclonic cooler 3088 (Step 1005).

Overall, as described in sub-steps 1301-1312, next, the producer gas passes through a rectilinear cyclonic cooler 3088 (Step 104). The first step of this is that the producer gas enters through the cooler inside pipe 3223 and enters the cooler bottom region 3187 through the gas entry aperture 3225 (Step 1301). Spatially, the rectilinear cyclonic cooler 3088 is preferably positioned after the primary flare assembly 3149 and before the renewable packed bed filter 3093. The rectilinear cyclonic cooler 3088 comprises a structure that allow the gases to be cooled through conduction and convection and removes particulates through cyclonic action. The rectilinear cyclonic cooler 3088 allows the particles to drop out of the gas because of the architecture of baffles built inside the cooler. In some embodiments, it also serves to decrease the entrance temperature approaching 500 C to an exit temperature reaching 130 C. Lastly, the rectilinear cyclonic cooler 3088 serves to create a cyclone for particulate capture and also acts a cooler simultaneously. The rectilinear cyclonic cooler's shape is uniquely scalable and allows thorough cyclonic cleaning action with no moving parts. The rectilinear cyclonic cooler 3088 preferably comprises a cooler bottom region 3187, baffles, a cooler inspection port 3144, and finally a cooler gas exit pipe 3186.

The cooler bottom region 3187 comprises part of the cooler responsible for catching and removing particulates. It preferably comprises the cooler inside pipe 3223 and the in and out cooler auger components 3040. The cooler inside pipe 3223 has a preferred radius of 4 inches and in some embodiments may also have a maximum radius of 20 inches and in other embodiments, may determined by basing it on the volume of gas that is being processed. The cooler inside pipe 3223 allows the gases to enter the cooler and preferably comprises the gas entry aperture 3225. The gas entry aperture 3225 is preferably positioned within the cooler bottom region 3187 and facing downward and comprises a port for gas entering the cooler. The in and out cooler auger components 3040 comprises one or more pipes that house the auger for removing particulates from the cooler. They allow continuous use of the system via an auger, however, in some embodiments, it is thought that if the in and out cooler auger components 3040 is absent then the in and out cooler auger components 3040 may be cleaned manually.

Next, producer gas encounters one or more baffles 3327 (Step 1302). Spatially, the baffles 3327 are preferably positioned within the rectilinear cyclonic cooler 3088 and are attached to the interior walls of the rectilinear cyclonic cooler 3088. The baffles 3327 comprises a series of alternating opposing structures that force the gas to create a cyclone like effect causing the gas to drop particles. The baffles are mainly thought to be composed of steel, but may use other materials in alternative embodiments. In some embodiments, the baffles 3327 have a preferred width of 24 inches and a preferred length of 48 inches. In some embodiments, the length of the baffles can be determined as being proportional to size of the entire unit. In some embodiments, the width of the baffles can be determined by that which is long enough to overlap the edge of an adjacent opposite baffle, and proportional to size of the entire unit. In some embodiments, the baffles 3327 has a preferred angle of slump of 60 degrees but in other embodiments, this may range from a minimum of 60 degrees to a maximum angle of slump of 75 degrees. In other embodiments, the preferred angle of slump can be calculated by that angle that is steep enough to prevent accumulation of particulates that can be removed gravity and/or cyclonic force. The baffles 3327 preferably comprises a cyclone generating bottom surface 3042, a particulate shedding top surface 3047, and finally a corbel 3335.

The baffles 3327 create a cyclonic flow when the producer gas encounters the cyclone generating bottom surface 3042 and the corbel 3335 of one or more baffles 3327 (Step 1303). The cyclone generating bottom surface 3042 comprises the surface that impedes the gas flow and helps to create the cyclonic action with the corbel 3335. The cyclonic flow induces particulates to separate from the producer gas and potentially land on a particulate shedding top surface 3047 (Step 1304). The particulate shedding top surface 3047 comprises the surface of the baffle wherein particulates fall towards the bottom based on the degree of slump. The particulate shedding top surface is mainly thought to be composed of steel, however in other embodiments may be composed of other materials. Spatially, a corbel 3335 is preferably positioned on the edge of the baffle, oriented vertically. The corbel 3335 comprises a mechanism to create the cyclonic motion of the gas and has a preferred height of 2 inches and in some embodiments may also have a maximum height of 6 inches. In some embodiments, the height of the corbel is proportional to the cooler box size.

In some embodiments, the particulates may land on the bottom of the cooler (Step 1305). When this occurs the particulates may be removed by the auger removal assembly 3154 (Step 1306). The auger removal assembly 3154 comprises augers used singularly or in combination with multiple components of the gasifier system. The auger removal assembly 3154 preferably comprises a packed bed filter auger 3168 and a cooler auger and/or ash module auger 3129.

Briefly, the waste removal system is discussed below: In some embodiments, the auger removal assembly removes particulates from ash module, and/or particulates from the cooler and/or from the packed bed filter arrive at the bottom of their respective systems (Step 1401). The auger removal assembly 3154 may remove the debris to an auger collecting assembly 3107 (Step 1402).

The auger collecting assembly 3107 comprises an auger based system for collecting waste from different components of the system. The auger collecting assembly 3107 preferably comprises a waste collect barrel 3353, an upward auger pipe and screw 3087, a motor drive 3304, a knife valve 3307, and finally an soot transition box with bearings.

The auger collecting assembly 3107 collects the waste from auger removal assembly when they arrive in the soot transition box with bearings 3046. The soot transition box with bearings 3046 comprises a collection area for waste from multiple components of the system. One goal of the soot transition box with bearings 3046 is to transition the removal of waste to the waste barrel(s). In some embodiments, the preferred depth is 18 inches, the preferred width is 20 inches, and the preferred height is 20 inches. However, in some embodiments, the volume of the soot transition box with bearings is established by a ratio relative to the size of the gasifier.

The upward auger pipe and screw 3087 removes the debris from the soot transition box with bearings 3046 (Step 1403). The motor drive 3304 comprises a mechanism to mediate the function of the auger. In some embodiments the motor drive 3304 may be operably connected to a PLC. The upward auger pipe and screw 3087 comprises components that allows a distance of transport of waste from the soot transition box to the waste collect barrel. In some embodiments, the preferred angle elevation of the upward auger pipe and screw is 22 degrees and the angle elevation can be determined by the angle necessary to reach from the bottom of the soot transition box to the top of the waste barrel. In some embodiments, the preferred length of the upward auger pipe and screw is 10 feet and can be calculated by the length that is necessary to reach from the bottom of the soot transition box to the top of the waste barrel and that which allows enough distance away from gasifier to allow for convenient removal.

From the upward auger pipe and screw 3087, ash is deposited into a waste collect barrel 3353 and then sealed by a knife valve 3307 (Step 1404). The knife valve 3307 comprises means to allow for continuous operation by forming an airtight seal when changing waste barrels.

Continuing the process of gas production, the producer gas then flows into the top portion of the rectilinear cyclonic cooler 3088 (Step 1305). If the pressure of the producer gas is above a certain threshold (Step 1306). Then, the producer gas is vented via a cooler safety valve 3199 (Step 1307). Next, a producer gas pressure differential is measured between the rectilinear cyclonic cooler 3088 and the fuel transition box (Step 1308) as part of a pressure-based feedback system 3060. The pressure-based feedback system 3060 comprises a feedback based monitoring system that allows both sensing of gas flow related variables and actuation of one or more components to attempt the maintenance of a gas flow homeostatic rate. The pressure-based feedback system 3060 aims to monitor blockages and preferably comprises the cooler-hearth differential pressure assembly.

The cooler-hearth differential pressure assembly comprises a means to monitor the pressure difference between the transition box and the cyclonic cooler. It functions to 1) enable consistent gas flow and also to 2) activate the grate shaker when the grate becomes restricted through a feedback loop operated by the PLC 3342. In some embodiments, it is thought that if the cooler-hearth differential pressure assembly is absent then then a timer might be used to operate the grate shaker. The cooler-hearth differential pressure assembly preferably comprises a transition box differential pressure assembly 3005, a differential pressure sensor with transmitter, and finally a cooler differential pressure assembly 3027.

In order to measure the pressure differential, the producer gas induces action of one or more pressure sensors within the cooler differential pressure assembly 3027 creates a cooler pressure signal 3143 (Step 1501). The cooler differential pressure assembly 3027 comprises components for pressure monitoring and relief of gases within the cooler. The cooler differential pressure assembly 3027 preferably comprises cooler pressure sensors, a cooler pipe with flange and gasket 3039, and finally a cooler safety valve 3199. The cooler pressure sensors 3126 comprises one or more sensor that allows the pressure levels to be detected. In some embodiments, it is thought that an example of cooler pressure sensors may include a wafer sensors and the like. In some embodiments, it is thought that if the cooler pressure sensors 3126 are absent then it may still work, but may prevent feedback control of the grate shaking within the ash module 3334.

In some embodiments, holding the pressure sensor is the cooler pipe with flange and gasket 3039. The cooler pipe with flange and gasket comprises a mechanism to hold one or more pressure sensors. The cooler pipe with flange and gasket is mainly thought to be composed of steel, however in other embodiments may be composed of other materials. In some embodiments, the cooler pipe with flange and gasket 3039 has a preferred length of 24 inches but in other embodiments, may range from a minimum of 10 inches to a maximum length of 36 inches. In some embodiments, the preferred length can be calculated by estimating the length necessary to decrease the temperature that would allow the sensor to function. In some embodiments, there is a cooler safety valve 3199 that comprises a valve that allows venting from deflagration. It further has a preferred valve opening threshold of 5 psi and a preferred diameter of 3 inches. In some embodiments, the diameter of the cooler safety valve is established as a ratio dependent on the size of the vessel.

In order to compare the pressure with the fuel transition box, the pressure within the transition box creates a transition box pressure signal 3048 via the transition box differential pressure assembly 3005 (Step 1502). The transition box differential pressure assembly 3005 comprises components for pressure monitoring and relief of gases within the transition box. The transition box differential pressure assembly 3005 preferably comprises transition box pressure sensors, a pipe with flange and gasket 3086, and finally a transition safety valve 3125.

The transition box pressure sensors 3043 comprises the sensor that allows the pressure levels to be detected. In some embodiments, it is thought that an example of transition box pressure sensors may include a wafer and the like. In some embodiments, it is thought that if the transition box pressure sensors 3043 is absent then it may work, but would prevent feedback control of the grate shaking within the ash module 3334.

Similar to the cooler pipe with flange and gasket 3039, the transition box has a pipe with flange and gasket 3086. It has a preferred length of 24 inches but in other embodiments, may range from a minimum of 10 inches to a maximum length of 36 inches. In some embodiments, the preferred length can be calculated by the length necessary to decrease the temperature allowing the sensor to function. In some embodiments, the pipe with flange and gasket 3086 has a preferred angle of 45 degrees but in other embodiments, may range from a minimum of 45 degrees to a maximum angle of 60 degrees. In some embodiments, the preferred angle can be calculated by the degrees necessary to establish runoff and particulates to slide off.

In addition, their is a transition safety valve 3125 preferably positioned atop the transition box. The transition safety valve 3125 comprises a valve that allows venting from deflagration and in some embodiments, the transition safety valve 3125 has a preferred valve opening threshold of 5 psi. In some embodiments, the valve opening threshold can be determined by the effective amount necessary to prevent buildup of pressure within the gasifier.

Next, the cooler pressure signal 3143 and transition box pressure signal 3048 are collected at a Differential Pressure (DP) sensor with transmitter 3032 for performing one or more feedback operations 3200 via the PLC 3342 (Step 1503). Spatially, the DP pressure sensor with transmitter 3032 is preferably positioned outside the gasifier 3320 and cooler. The DP pressure sensor with transmitter 3032 comprises a mechanism to evaluate the pressure differences between the cyclonic cooler and transition box, and transmit sensor data to the PLC 3342.

Next, producer gas passes into the cooler gas exit pipe 3186 via the gas exit aperture 3236 (Step 1309). Spatially, the cooler gas exit pipe 3186 is preferably positioned in the top portion of the cooler. The cooler gas exit pipe 3186 comprises a component used for allowing the gases to exit the cooler. It has a preferred radius of 4 inches and in some embodiments may also have a maximum radius of 20 inches. In some embodiments, the preferred radius is the maximum effective radius for the volume of gas that is being processed. The cooler gas exit pipe 3186 preferably comprises the cooler gas exit aperture 3122. The cooler gas exit aperture 3122 comprises a port for gas exiting the cooler. Spatially, the cooler gas exit aperture 3122 is preferably positioned on the cooler gas exit pipe 3186 and in the top portion of the cooler.

Next, producer gas passes into the rectilinear cyclonic cooler transition assembly (Step 1310; Step 105). The rectilinear cyclonic cooler transition assembly 3003 comprises a sensing, inspection and transport system for gas between the cyclonic cooler and the packed bed filter. The rectilinear cyclonic cooler transition assembly 3003 preferably comprises a transition vertical pipe with T 3058 and a transition horizontal pipe 3096.

The producer gas enters the transition vertical pipe with T 3058 (Step 1601). The transition vertical pipe with T 3058 comprises a carrier of gas from the cooler with has access ports 3400 at 90 degree junctures for cleaning and maintenance. In addition, the transition vertical pipe with T 3058 preferably comprises the safety thermocouple with transmitter T2 3021 and the thermocouple shield 3212. Next, the producer gas encounters a safety thermocouple with transmitter T2 3021 within a thermocouple shield 3212 (Step 1602). The safety thermocouple with transmitter T2 3021 comprises a sensor for measuring the temperature of gas and functions to measure the temperature of the gas coming out of the cooler who operably connects to PLC 3342. If the temperature is above a certain threshold (Step 1603). Then, the PLC 3342 will shut down the system via emergency shutdown module 3334 (Step 1604).

Next, the producer gas passes through a transition horizontal pipe 3096 into the renewable packed bed filter 3093 (Step 1605; 106). The renewable packed bed filter 3093 comprises a system to remove tars and particulate from the producer gas. The renewable packed bed filter 3093 has many purposes which are as follows: First, the purpose of the renewable packed bed filter 3093 is to have filter media collected through this system be utilized as fuel for the gasifier system thus eliminating environmental issues. Next, it serves to have a differential pressure component that is used to determine when the initial layer of filter medium becomes saturated. Next, it serves to have a means to continuously fill the filter bed. Lastly, the renewable packed bed filter 3093 serves to have a means to remove the waste, continually as to allow long durations of operation. In some embodiments, it is thought that if the renewable packed bed filter 3093 is absent than a water scrubber may be used, which would also allow continuous operation. The renewable packed bed filter is preferably shaped like a rectangle to allow the grate and rake to work properly. The renewable packed bed filter 3093 preferably comprises a top portion housing 3209, a top/bottom packed bed filter connecting flange 3009, a packed bed filter differential pressure assembly 3007, and finally a bottom packed bed filter housing box 3030.

Next, the producer gas enters through the inlet pipe aperture 3203 within the bottom packed bed filter housing box 3030 (Step 1701). The bottom packed bed filter housing box 3030 comprises the bottom portion of the housing. It holds the scissoring mechanism 3183, serves as an inlet for the gas, and serves as a collection mechanism for the auger waste removal. The bottom packed bed filter housing box 3030 preferably comprises a scissoring mechanism 3183, a flange with inlet pipe aperture 3203, and finally a filter cleanout system 3156.

After entering, the producer gas goes through the scissoring mechanism 3183 where the filter media 3296 rests upon it (Step 1702). The filter media hopper 3204 comprises a dual gated air-tight container for feeding filter media into the packed bed filter. In some embodiments, it is thought that if the filter media hopper 3204 is absent then a removable plate may be used to input the filter media. The filter media 3296 comprises a particulate chelating material that pulls the particulates/tars and allows water to pass. The filter media 3296 is mainly thought to be composed of wood, however other embodiments may be composed of: charcoal, sand, or gravel and the like.

In some embodiments, the filter media 3296 has a preferred depth of 8 inches but in other embodiments, may range from a minimum of 6 inches to a maximum depth of 12 inches. In general, the maximum depth can be calculated by estimating the value that is not to large that would result in a high differential pressure, between the top and the bottom. In general, the minimum depth can be calculated by estimating the depth that would prevent blowing out of the media, creating a hole through the media and thus, preventing filtration.

The filter media is cycled by the motion of the scissoring mechanism 3183 and the leveling rake assembly 3155 (Step 1703). The leveling rake assembly 3155 comprises a means to keep the filter media level during introduction of new filter media. The leveling rake assembly 3155 functions to 1) keep the filter media level and 2) keep the filter media from developing holes. The leveling rake assembly 3155 preferably comprises the rake actuating components 3110 and the rake actuator grate assembly 3073.

As the filter media 3296 is moved by the leveling rake assembly 3155 (Step 1801), this is performed by a rake actuator grate assembly 3073. It comprises the collected components that impart actuation of the top rake in order to keep the filter media level. The rake actuator grate assembly 3073 preferably comprises the top rake support 3242 and the top rake 3319.

The top rake 3319 comprises a grid of parallel rods connected by one central activating rod 3360 that passes through the packed bed filter box to an actuator, via a linear bearing. In some embodiments, the top rake 3319 has a preferred width of 23 inches. In some embodiments, the top rake 3319 has a preferred length of 35 inches. In some embodiments, the width of the top rake is calculated by estimating the effective width allowing it to fit within the packed bed filter. In some embodiments, the length of the top rake can be calculated by estimating the effective length allowing it to fit within the packed bed filter. The top rake 3319 preferably comprises the top rake hinges 3259 and is supported by a top rake support 3242. The top rake support 3242 comprises a support structure for the stabilization of the top rake. The top rake hinges 3259 comprise hinges at the central portion of the rake that allow for easy removal and or access to the filter media. In some embodiments, it is thought that if the top rake hinges 3259 is absent then other removal mechanisms may allow for access to the filter media.

Next, the filter media 3296 sitting atop the actuator grate assembly 3277 is moved by the rake actuating components 3110 (Step 1802). The rake actuating components 3110 comprises the assembly of components needed to effect actuation for the packed bed filter rake. The rake actuating components 3110 preferably comprises a rake pneumatic actuator 3127, rake clevis, rake actuator mounting 3146, rake linear bearing 3197, and finally a rake actuating controller 3106. The rake pneumatic actuator 3127 comprises a means for shaking the rake grate which can be controlled by the PLC. One goal of the rake pneumatic actuator 3127 is to provide feedback actuation through communication with the PLC 3342. In some embodiments, it is thought that an example of a rake pneumatic actuator 3127 may include a motor on an eccentric cam and the like.

The rake clevis 3299 comprises a connector component that imparts actuation to the leveling rake. The rake actuator mounting 3146 comprises a means for stabilizing the actuator. The rake linear bearing 3197 comprises a connector component that imparts actuation to the leveling rake. The rake actuating controller 3106 comprises a means for regulating the frequency of the actuation movement. In some embodiments, it is thought that an example of a rake actuating controller 3106 could be a timer based controller or perhaps a pressure based controller and the like.

The filter media 3296 drops through the static grate assembly 3277 (Step 1803) where the producer gas encounters the filter media that absorbs tars and particulates from the producer gas (Step 1704). In passing through the packed bed filter, the media passes through the top/bottom packed bed filter connecting flange 3009. This comprises a connection means for the top and bottom portion of the packed bed filter and allows cleaning and modularity of components.

Next, filter media drops through the scissoring mechanism 3183 (Step 1705). Spatially, the scissoring mechanism 3183 is preferably positioned directly below the actuated grate assembly. The scissoring mechanism 3183 comprises a means for renewable filtering during operation that allows continuous operation.

The scissoring mechanism 3183 has many purposes which are as follows: First, the purpose of the scissoring mechanism 3183 is to allow for renewable filtering during operation. Next, it serves to allow one to maintain continuous operation without changing filters, which may not occur with non-renewable filters. Lastly, the scissoring mechanism 3183 serves to allow for recycling of the filter media back into the gasifier to be used as fuel. In some embodiments, it is thought that if the scissoring mechanism is absent then a water scrubber may be used, which would also allow continuous operation. In other instances, if the scissoring mechanism is absent then the grate assembly of the hearth components may be effectively used to stir the media. The scissoring mechanism 3183 preferably comprises the Scissor and Grate Actuator Assembly 3017 and the scissor static grate assembly 3064.

The Scissor and Grate Actuator Assembly 3017 preferably comprises the scissor actuating components 3076 and the scissor actuator grate assembly 3054. Spatially, the Scissor and Grate Actuator Assembly 3017 is preferably positioned directly above the static grate. In some embodiments, the Scissor and Grate Actuator Assembly 3017 has a preferred area of 6^2 feet. In some embodiments, the area of the Scissor and Grate Actuator Assembly can be calculated by the effective area dependent upon the amount of gas flow desired to be processed. The Scissor and Grate Actuator Assembly 3017 comprises a means to create a scissoring effect with the static grate assembly for efficient removal and passage of contaminated filter media.

The scissor actuating components 3076 comprises the assembly of components needed to effect actuation. The scissor actuating components 3076 preferably comprises a scissor pneumatic actuator 3099, scissor clevis, scissor actuator mounting 3103, scissor linear bearing 3145, and finally a scissor actuating controller 3074.

The scissor pneumatic actuator 3099 comprises a means for shaking the scissor grate which can be controlled by the PLC. In some embodiments, it is thought that an example of a scissor pneumatic actuator 3099 may include a motor on an eccentric cam and the like. The scissor clevis 3275 comprises a connecting component that allows actuation of the scissor grate. The scissor actuator mounting 3103 comprises a means for stabilizing the actuator. The scissor linear bearing 3145 comprises a connecting component that allows actuation of the scissor grate. The scissor actuating controller 3074 comprises a means for regulating the frequency of the actuation movement in the packed bed filter. In some embodiments, it is thought that an example of a scissor actuating controller 3074 could be a timer based based controller or perhaps a pressure based controller and the like.

The scissor actuator grate assembly 3054 comprises means for actuating the scissoring effect for the scissoring mechanism. The scissor actuator grate assembly 3054 preferably comprises a scissor actuator rod attach to the grate 3019, scissor rake tines, and finally a scissor actuator grate 3150.

In some embodiments, the scissor actuator rod is attached to the grate has a preferred length of 35 inches and can be determined by the actuating grate length. The scissor actuator rod attached to the grate 3019 comprises the rod that is actuated in order to move the actuation grate. The scissor actuator rod attached to the grate is preferably shaped like a cylinder, however in other embodiments may be composed of other shapes. The scissor rake tines 3215 are preferably pointed however, it is thought that in alternative embodiments that it may also be shaped like a triangle. In some embodiments, the scissor rake tines 3215 have a preferred height of 1.5 inches but in other embodiments, may range from a minimum of 1 inches to a maximum height of 2.5 inches. In general, the preferred height can be calculated by estimating the height optimal for allowing both fluidity and agitation of the media. The scissor rake tines 3215 comprise upward projecting portions to agitate the woodchips. One goal of the scissor rake tines 3215 is to prevents build up of tars and soot and water on the filter media. The scissor actuator grate 3150 comprises the grate that is moved.

Spatially, the scissor static grate assembly 3064 is preferably positioned directly below the actuated grate assembly. The scissor static grate assembly 3064 comprises a means to create a scissoring effect with the actuating grate assembly for removal and passage of contaminated filter media. In some embodiments, the scissor static grate assembly 3064 has a preferred area of 6^2 feet and can be determined by the optimum area for the gas flow desired to be processed. Further, the scissor static grate assembly 3064 preferably comprises the scissor grate support 3170.

Spatially, the scissor grate support 3170 is preferably positioned directly above the actuated grate assembly. The 3170 comprises means for supporting the static grate. One goal of the scissor grate support 3170 is to allows chips to move down so they do not block the filtering grate from moving. The scissor grate support 3170 preferably comprises the scissor grate 3284 and the evacuation vents 3245. The scissor grate 3284 comprises a filtering mechanism composed of expanded metal that allows wood chips to fall through into the bottom packed bed filter housing box 3030. In some embodiments, a rectangular shape of the grate, enhances efficacy and allows the grate and rake to work properly. In some embodiments, the scissor grate 3284 has a preferred aperture diameter of 0.75 inches and can be calculated by the size of the woodchips that are anticipated to fall through the grate. The scissor grate is mainly thought to be composed of steel, however in other embodiments may be composed of other materials.

Next, filter media drops through the scissoring mechanism 3183 into the filter cleanout system 3156 where the filter media is removed (Step 1706). This occurs as the producer gas flows into the top portion of the renewable packed bed filter 3093 (Step 1707). If the pressure of the producer gas is above a certain threshold (Step 1708). Then, producer gas is vented via a packed bed filter relief valve 3077 (Step 1709). The packed bed filter relief valve 3077 comprises a valve that allows venting from deflagration. In some embodiments, the packed bed filter relief valve 3077 has a preferred valve opening threshold of 5 psi, which can be calculated by the effective psi that prevents buildup of pressure within the gasifier and a preferred diameter of 2 inches, which can be calculated by the effective diameter that prevents buildup of pressure within the gasifier.

In order to monitor for efficacy, the producer gas pressure differential is measured between the bottom packed bed filter housing box 3030 and the top packed bed filter housing box (Step 1710). The top portion housing 3209 comprises a reservoir which contains the filter medium, and a means by which gas can exit the vessel, a means for entry of filter media, and a means for safety monitoring. One goal of the top portion housing is to allow filter media to enter the top portion of the housing. The top portion housing 3209 preferably comprises a packed bed filter relief valve 3077, a renewable packed bed filter exit pipe 3025, a filter media hopper 3204, filter media, and finally a leveling rake assembly 3155.

The packed bed filter differential pressure assembly 3007 comprises a means to measure the differential pressure to prevent clogging by actuating grate shaker and to recognize if the media has been bypassed. The packed bed filter differential pressure assembly 3007 has many purposes which are as follows: First, the purpose of the packed bed filter differential pressure assembly 3007 is to measure the differential pressure to make sure there is not a hole of direct gas flow. Next, it serves to turns on the shaking to keep the filer active mediated by the PLC 3342. Lastly, the packed bed filter differential pressure assembly 3007 serves to allows continual operation via monitoring of pressure. The packed bed filter differential pressure assembly 3007 preferably comprises a top portion differential pressure assembly 3014, a bed filter dp pressure sensor with transmitter, and finally a bottom portion differential pressure assembly 3008.

The producer gas induces action of top portion pressure sensors 3070 within the top portion differential pressure assembly 3014 creates a top portion pressure signal 3075 (Step 1901). The top portion differential pressure assembly 3014 comprises components for pressure monitoring and relief of gases within the packed bed filter. The top portion differential pressure assembly 3014 preferably comprises the top portion pressure sensors 3070. These allow the pressure levels to be detected. In some embodiments, it is thought that an example of top portion pressure sensors could be a wafer or perhaps a manual gauge and the like.

To measure the differential pressure, producer gas induces action of bottom portion pressure sensors 3051 within the bottom portion differential pressure assembly 3008 creating a bottom portion pressure signal 3057 (Step 1902). The bottom portion differential pressure assembly 3008 comprises components for pressure monitoring and relief of gases within the cooler. The bottom portion differential pressure assembly 3008 preferably comprises the bottom portion pressure sensors 3051. These allow the pressure levels to be detected. In some embodiments, it is thought that an example of bottom portion pressure sensors could be a wafer sensor or perhaps a manual gauge and the like.

Next, the top portion pressure signal 3075 and bottom portion pressure signal 3057 are collected by a bed filter DP pressure sensor with transmitter 3006 for performing one or more feedback operations 3200 on the system (Step 1903). The bed filter DP pressure sensor with transmitter 3006 comprises a mechanism to evaluate the pressure differences between the top and bottom portions of the packed bed filter. A goal of the bed filter DP pressure sensor with transmitter 3006 is to connect and transmit data to the PLC 3342. If above a certain threshold (Step 1904). Then, the PLC 3342 mediates movement of the actuator (Step 1905).

Exiting the packed bed filter, next the producer gas flows through the through the renewable packed bed filter exit pipe 3025 and enters the chiller/packed bed filter connection assembly 3013 (Step 1711). The renewable packed bed filter exit pipe 3025 comprises pipe that mediates evacuation of the producer gas from the packed bed filter. The renewable packed bed filter exit pipe 3025 preferably comprises the renewable packed bed filter exit flange 3022 and the packed bed filter exit aperture 3065. The renewable packed bed filter exit flange 3022 comprises connecting flange of the renewable packed bed filter exit pipe 3025. The packed bed filter exit aperture 3065 comprises aperture of the renewable packed bed filter exit pipe 3025.

The chiller/packed bed filter connection assembly 3013 preferably comprises the horizontal pipe with flange 3083. Then the gas passes into the chiller (Step 107). The chiller is an auto clean spray system. In some embodiments, the chiller may be positioned vertically. In some embodiments, the chiller may be positioned horizontally. The chiller 3326 comprises a mean to capture soot and—or cleans the mesh impingement pad and additionally comprises a water scrubber 3274, a mist elimination system connector portion 3097, a mesh impingement pad 3184, and finally a hydrophilic condenser 3160.

As the producer gas continues through the horizontal pipe (Step 2001), the producer gas encounters water spray from the nozzle cone spray downstream 3078 (Step 2002). The nozzle cone spray downstream 3078 comprises the nozzle that sprays water for the producer gas and impacts the impingement pad. The horizontal pipe with flange 3083 comprises the horizontal pipe that passes the gas from the packed bed filter to the chiller 3326.

The water spray captures particulates from the gas and impacts on the mesh impingement pad 3184 and is recycled into a receiving tank 3264 (Step 2003) via a water scrubbing system. Then the water drains off of the mesh impingement pad 3184 to the bottom of the chiller 3326 (Step 2101). Then the water enters into an impingement drain pipe 3139 (Step 2102) and then the chiller drain pipe 3232 (Step 2103). The impingement drain pipe 3139 comprises a pipe from the impingement portion of the chiller 3326 and is mainly thought to be composed of steel, however in other embodiments may be composed of other materials. The chiller drain pipe 3232 comprises a pipe that collects the wastewater from either portion of the chiller 3326.

The mesh impingement pad 3184 functions to start the condensing process. The mesh impingement pad functions to both 1) allow the gas flow start the condensing process by utilizing a condenser coated with a super hydrophilic coating to prevent tars and particulate from depositing on the condenser. It further functions to capture soot. The mesh impingement pad 3184 preferably comprises the perforated impingement screen 3068. The perforated impingement screen 3068 comprises the perforated portion of the mesh impingement pad 3184 that the produce gas goes through and is thought to be mainly composed of steel, however in other embodiments may be composed of other materials.

Next, water enters into a chiller drain pipe 3232 (Step 2103). Then enters into one or more filter canister 3253 containing filter canister media 3179 (Step 2104). The filter canister 3253 comprises a filtering component for wastewater. The filter canister 3253 preferably comprises the filter canister media 3179. The filter canister media 3179 comprises the media that is used to filter particulates from the wastewater. In some embodiments, it is thought that an example of filter canister media could be woodchips or perhaps an activated charcoal and the like.

Next, water enters into a post filter drain pipe 3138 (Step 2105). The post filter drain pipe 3138 comprises a pipe from the filter canisters to the recycling tank. Next, water enters into a receiving tank 3264 (Step 2106). If the receiving tank 3264 is full (Step 2107). Then, a receiving tank overflow 3134 removes excess water (Step 2108). The receiving tank 3264 comprises a storage component for the recyclable wastewater and is thought to be mainly composed of steel, however in other embodiments may be composed of other materials. It is preferably comprises the receiving tank overflow 3134. The receiving tank overflow 3134 comprises a means for removing extra wastewater from the water scrubber 3274 system. Next, water is pumped with a recirculating pump 3228 to the nozzle cone spray downstream 3078 (Step 2109).

A similar cycle occurs as the producer gas goes past the impingement pad and encounters a condenser which is coated with a hydrophilic substance and removes water from the gas which is recycled into a reservoir (Step 2004). An additional goal of the hydrophilic condenser 3160, besides to remove water is to cool the gas.

Water drains off of the hydrophilic condenser to the bottom of the chiller 3326 (Step 2201) and enters into an condenser drain pipe 3195 (Step 2202). The condenser drain pipe 3195 comprises a pipe from the condenser portion of the chiller 3326. Then water enters into a chiller drain pipe 3232 (Step 2203) and enters into one or more filter canister 3253 containing filter canister media 3179 (Step 2204).

Next, water enters into a post filter drain pipe 3138 (Step 2205) and enters into a receiving tank 3264 (Step 2206). If the receiving tank 3264 is full (Step 2207). Then, a receiving tank overflow 3134 removes excess water (Step 2208). Next, water is pumped with a recirculating pump 3228 to the nozzle cone spray downstream 3078 (Step 2209). The recirculating pump 3228 comprises a pump for reusing the water from the chiller and mist elimination system for extracting particulates from the producer gas. One goal of the recirculating pump 3228 is to reuse the water from the condenser portion for the filtering portion.

In some embodiments, the water recycling system is termed the water scrubber 3274. It preferably comprises a safety valve to return pump 3082, a threaded connection with nipple 3050, a nozzle cone spray downstream 3078, a recirculating pump 3228, a filter canister 3253, a receiving tank 3264, a chiller drain pipe 3232, an impingement drain pipe 3139, a condenser drain pipe 3195, a mist elimination system drain pipe 3208, and finally a post filter drain pipe 3138.

Next, the producer gas goes through the chiller connector portion into the mist elimination system 3131 (Step 2005; Step 108). In some embodiments, the mist elimination system 3131 removes the water that did not condense out through the chiller and has a two stage impingement system. In some embodiments, the mist elimination system uses two methods for removing the water, entrainment and vanes or chevrons. The mist elimination system 3131 preferably comprises a mist elimination system connector pipe with flange 3033, a chevron pad stage 3231, a mesh pad stage 3278, a channel for gas without water 3066, a mist wastewater assembly 3121, a mist elimination system relief valve 3166, and finally an outlet pipe with flange 3123.

As the producer gas enters the mist elimination system 3131 the producer gas flows through the chevron pad stage 3231 (Step 2301). Next, water is condensed onto the chevron pad, and drains through the mist wastewater assembly 3121 and reused for the chiller 3326 (Step 2302). The mist wastewater assembly 3121 functions to combine the waste water from the chiller for treatment, and preferably comprises the capturing water bottle 3147. The capturing water bottle 3147 comprises the portion of the mist elimination system that captures and collects the wastewater and passes it on to the water scrubber 3274 system.

Similar to the procedures in the chiller, water drains from the capturing water bottle 3147 into the mist elimination system drain pipe 3208 (Step 2401). The mist elimination system drain pipe 3208 comprises a pipe from the mist elimination system to the water recycling system. Then water enters into one or more filter canister 3253 containing filter canister media 3179 (Step 2402) and a post filter drain pipe 3138 (Step 2403). Next, water enters into a receiving tank 3264 (Step 2404). If the receiving tank 3264 is full (Step 2405), then a receiving tank overflow 3134 removes excess water (Step 2406). Then water is pumped with a recirculating pump 3228 to the nozzle cone spray downstream 3078 (Step 2407).

After the chevron pad stage the producer gas passes through the mesh pad stage 3278 (Step 2303). A goal of the mesh pad stage 3278 is to pull out any remaining smaller droplets. Next the producer gas exits through the channel for gas without water 3066 into the outlet pipe with flange 3123 (Step 2304). The channel for gas without water 3066 comprises the channel that connects at the top of the mist elimination system and passes the produce gas out of the component. Spatially, the outlet pipe with flange 3123 is preferably positioned at the top of the mist elimination system.

Next, producer gas passes into the mist to hydrophobic connection assembly system 3020 (Step 109). The mist to hydrophobic connection assembly 3020 preferably comprises a transition horizontal pipe 3096, a "T" connection, and finally a transition vertical pipe 3111. The producer gas flows through the transition horizontal pipe 3096 (Step 2501) where the temperature is measured with a safety thermocouple T3 3158 (Step 2502).

Next, producer gas flows through the transition vertical pipe 3111 (Step 2503), then through the transition connection 3354 (Step 2504) comprising the trap 3341 and the Horizontal pipe to hydrophobic polishing filter 3314. The horizontal pipe to hydrophobic polishing filter comprises a pipe that passes the producer gas in to the bag house. The Horizontal pipe to hydrophobic polishing filter 3314 preferably comprises the coupling with valve for pump/oxygen sensor 3291 and the threaded hole with a nipple for Differential Pressure Chiller 3326.

DP is then measured from the chiller pipe DP to this DP (Step 2505) and the producer gas flows through the horizontal pipe to hydrophobic polishing filter 3314 (Step 2507; Step 110). The hydrophobic polishing filter 3314 functions to allow the filter to self-clean using a shaker and continuously run with minimal maintenance. The pressured is assayed by the Chiller Differential Pressure Sensor Assembly 3034, which preferably comprises a Chiller Differential Pressure Sensor with Transmitter 3011, a threaded connection with nipple 3050, and finally a threaded hole with a nipple for Differential Pressure Chiller 3326. In some embodiments, the Chiller Differential Pressure Sensor Assembly comprises a means to measure the differential pressure to prevent clogging by the actuating grate shaker allowing the recognition of whether the media has been bypassed. The threaded connection with nipple 3050 is preferably positioned on the horizontal pipe with flange 3083 operably communicates with the Chiller Differential Pressure Sensor with Transmitter 3011. In tandem, the threaded hole with a nipple for Differential Pressure Chiller 3326 preferably positioned within the mist to hydrophobic connection assembly system 3020 communicates pressure to the Chiller Differential Pressure Sensor with Transmitter 3011 as part of the Chiller Differential Pressure Sensor Assembly 3034. The Chiller Differential Pressure Sensor with Transmitter 3011 operably communicates to the PLC 3342 for control-related feedback. In some embodiments, there may be a mist elimination system relief valve 3166 which comprises a means for venting the mist elimination system 3131 in instances of high pressure.

Next, producer gas passes through the blower assembly 3249 (Step 111). The blower assembly 3249 functions to provide suction to the system, is controlled by the PLC, and preferably comprises an oxygen sensor assembly 3152, a blower 3329, and finally a blower exit pipe 3244. The blower 3329 comprises a means to produce suction for the system that allows the producer gas to traverse from the gasifier to the engine. The blower 3329 preferably comprises the blower inlet 3294 and the blower outlet 3283. The blower inlet 3294 comprises the inlet pipe or means to the blower 3329. The blower outlet 3283 comprises the outlet pipe or means from the blower 3329.

Next, producer gas flow into the blower 3329 inlet and the blower outlet 3283 (Step 2601) and through the blower exit pipe 3244 (Step 2602). The blower exit pipe 3244 comprises the pipe from the blower to the engine and outlet. The blower exit pipe 3244 also preferably comprises a gas flow meter with transmitter 3055, a coupling with valve for oxygen sensor/pump, a pressure gauge for gas delivery 3056, and finally a sampling port with valve 3115.

Next, producer gas oxygen concentration may be measured via a coupling with valve for oxygen sensor assembly 3152 (Step 2701). A goal of the oxygen sensor assembly 3152 is to measures difference between inlet and outlet for safety reasons. The oxygen sensor assembly 3152 preferably comprises a p trap water collector 3128, a sample pump 3306, an oxygen sensor 3291, and finally a recirculating hose 3230. The sample pump 3306 comprises a means to pull the gas from the system to be analyzed for O2. The recirculating hose 3230 comprises a means to return the O2 sampled gas back into the system. If the O2 concentration is above a certain threshold (from 3-5%) (Step 2702). Then, a shutdown module 3334 may be activated.

Next, producer gas flow rate is examined with a gas flow meter with transmitter 3055 (Step 2704) to see how much gas is being produced. Then, the producer gas pressure may be measured via a pressure gauge for gas delivery 3056 (Step 2705). This is to measure if adequate pressure is obtained for an engine to run. In addition, the producer gas may be evaluated by a sampling port with valve 3115 (Step 2706) to measure quality to gas.

Next, producer gas flow into the exit pipe assembly 3219 (Step 112) which preferably comprises a secondary flare assembly 3114, an engine pipe 1 3280, and finally a generator 3313. If there is overflow of producer gas (Step 113) then the flare burns off the excess gas. If someone wants to use the producer gas for an engine (Step 114), then the producer gas is directed to the engine pipe 1 3280 (Step 115).

The engine pipe 1 3280 preferably comprises an engine valve one 3240. If the temperature at the thermocouple assembly is above threshold (Step 116). Then, a flare valve is opened (Step 117) and opens gas to the flare, wherein producer gas flows to the secondary flare assembly 3114 through the horizontal portion 3218 (Step 118).

The secondary flare assembly 3114 preferably comprises a horizontal portion 3218, a vertical portion 3243, and finally an ignition system 3248. The horizontal portion 3218 preferably comprises the valve 3339 that may be operably connected to the PLC 3342. The vertical portion 3243 preferably comprises a swing valve 3301 that may be operably connected to the PLC 3342. When vented the producer gas is flared with an ignition system 3248 (Step 120). If the temperature at thermocouple assembly is below threshold (Step 121). Then, the secondary flare valve is closed (Step 122) while the primary flare burns the gas.

Finally one may use the use the producer gas for energy (Step 123) by opening the engine valve 3339 to an engine (Step 124). In other embodiments, there may be a generator.

Important to the operation of the system is a PLC 3342 computer 3318. The computer 3318 comprises a general purpose device that can be programmed to carry out a finite set of arithmetic or logical operations. In some embodiments, it is thought that examples of a computer 3318 may include: programmable logic controllers, desktop computers, laptops, notebooks, a palmtop, a tablet, smartphones, or smartbooks. The computer 3318 preferably comprises a central processing unit 3135, a memory 3338, an operating system 3247, and a graphical user interface 3113.

The central processing unit 3135 comprises hardware within a computer that carries out the instructions of a computer program by performing the basic arithmetical, logical, and input/output operations of the system. The memory 3338 comprises the physical devices used to store programs (sequences of instructions) or data (e.g. program state information) on a temporary or permanent basis for use in a computer or other digital electronic device. A module 3334 comprises a block of instructions hosted on memory 3338 executed by the central processing unit 3135 which perform one or more series of functions.

The operating system 3247 comprises a collection of software that manages computer hardware resources and provides common services for computer programs. The graphical user interface 3113 comprises a type of user interface that allows users to interact with electronic devices through graphical icons and visual indicators such as secondary notation, as opposed to text-based interfaces, typed command labels or text navigation.

A network 3325 comprises a communications network that allows computers sensors and controllers to exchange data. In some embodiments, it is thought that examples of a network 3325 may include: a personal area network, a wireless personal area network, a near-me area network, a local area network, a wireless local area network, a wireless mesh network, a wireless metropolitan area network, a wireless wide area network, a cellular network, a home area network, a storage area network, a campus area network, a backbone area network, a metropolitan area network, a wide area network, an enterprise private network, a virtual private network, an intranet, an extranet, an internetwork, an internet, near field communications, wired communication, or a mobile telephone network.

Preferably the PLC 3342 includes sensor modules 3268 that comprise one or more modules that process sensor related information and may operably communicate with one or more controller modules 3216, shut down modules 3355, and timer modules 3286. The sensor modules 3268 preferably comprises flare sensor modules, mechanical sensor modules, chemical sensor modules, differential pressure sensor modules, and finally thermocouple sensor modules. The PLC 3342 comprises a digital computer (with components such as processor and readable memory as well known in the art), as used for automation of typically industrial electromechanical processes. The PLC 3342 has many purposes which are as follows: First, the purpose of the PLC 3342 is to monitor air and gas flows. Further, in some embodiments, it serves to control the fuel flow, air/gas flow by using equivalence ratios. Further, in some embodiments, it serves to mediate the hearth grate shaker using PID controls. Further, in some embodiments, it serves to control fan speed. Further, in some embodiments, it serves to controls the packed bed filter, shaker, and hopper. Further, in some embodiments, it serves to control the temperature inside of the gasifier and downstream. Further, in some embodiments, it serves to monitor temperatures, pressures (as well as differential pressure), and oxygen levels. Further, in some embodiments, the connected display serves as an to easy to read medium, making this system easy to operate. Further, in some embodiments, it serves to be remotely viewed and operated from a desktop computer or mobile device. Further, in some embodiments, the PLC 3342 serves to enable safety, incur lower maintenance costs and encourage efficiency. The PLC 3342 preferably comprises alarms, battery back-up, touchscreen, and finally producer gasification control modules.

The flare sensor modules 3192 comprises one or more modules that preferably communicate flare status to flares within the system (for example, to receive inputs from the primary and secondary flares). The mechanical sensor modules 3108 comprises one or more modules that preferably communicate mechanical data from the system (for example, to receive inputs from the fuel level sensor). The chemical sensor modules 3136 comprises one or more modules that preferably communicate chemical data from the system (for example to receive inputs from the oxygen sensor). The differential pressure sensor modules 3031 comprises one or more modules that preferably communicate pressure data from the system (for example to receive differential sensor inputs from the gasifier and the packed bed filter). The thermocouple sensor modules 3091 comprises one or more modules that preferably communicate temperature data from the system (may receive differential sensor inputs from the gasifier and the pack bed filter, for example).

Preferably the PLC 3342 also includes controller modules 3216. The controller modules 3216 comprises one or more modules that effect actions on the system and may operably communicate with sensor modules 3268, shut down modules 3355, and timer modules 3286. The controller modules 3216 preferably comprises auger controller modules, actuator controller modules, flare controller modules, air controller modules, and finally feedstock controller modules.

The auger controller modules 3117 comprises one or more modules that control the action of one or more auger (for example, to control the auger collection assembly and auger removal assembly. The actuator controller modules 3084 comprises one or more modules that control the action of one or more actuator. for example, to control the pneumatic actuator 3233, scissor pneumatic actuator 3099 and rake pneumatic actuator 3127.

The flare controller modules 3112 comprises one or more modules that control the action of one or more flare (for example, to control the primary and secondary flares). The air controller modules 3137 comprises one or more modules that control the action of air-related systems (for example, to control the blower and air injection system 3191). The feedstock controller modules 3067 comprises one or more modules that control the action of feedstock for gasification fuel (for example, to control the fuel transport system 3165).

Preferably the PLC 3342 also includes shutdown modules 3241. These comprises one or more modules that implement shutdown procedures for the system and may operably communicate with controller modules 3216, sensor modules 3268, and timer modules 3286. Preferably the PLC 3342 also includes timer modules 3286. These comprise one or more modules that may implement timing related procedures system and may operably communicate with controller modules 3216, sensor modules 3268, and shutdown modules 3241.

What is claimed is:

1. An apparatus for biogasification which comprises the following units:

a. a chiller/renewable packed bed filter connection assembly;

b. a gasifier wherein the gasifier further comprises a renewable packed bed filter, a rectilinear cyclonic cooler wherein the rectilinear cyclonic cooler is operably connected to the output of the gasifier and a rectilinear cyclonic cooler transition assembly wherein the rectilinear cyclonic cooler transition assembly operably connects the rectilinear cyclonic cooler to the chiller/renewable packed bed filter connection assembly wherein the renewable packed bed filter is the operable connection between the chiller and the rectilinear cyclonic cooler and is operably connected to the output of the rectilinear cyclonic cooler transition assembly and the input of the chiller/renewable packed bed filter connection assembly wherein the gasifier further comprises:

i. a fuel transport system;

ii. a gasifier frame wherein the gasifier frame further comprises the gasifier and;

c. a primary flare assembly wherein the gasifier is operably connected to the input of the primary flare assembly and wherein the primary flare assembly further comprises a thermocouple assembly T1 which further comprises:

i. a coupling;

ii. a thermocouple with shield; and iii. a PLC Transmitter:

d. a pressure-based feedback system wherein the pressure-based feedback system further comprises a cooler-hearth differential pressure assembly that is operably connected to the output of the rectilinear cyclonic cooler;

e. an integrated auger system wherein the integrated auger system further comprises:

i. an auger collecting assembly wherein the auger collecting assembly further comprises:

1. A motor drive;

2. A waste collect barrel;

3. An upward auger pipe and screw;

4. A knife valve; and 5. a soot transition box with bearings wherein the soot transition box with bearings further comprises a collection area for waste from multiple components of the system;

ii. an auger removal assembly wherein the auger removal assembly further comprises:

1. A renewable packed bed filter auger; and
2. a cooler/ash module auger f. a chiller wherein the chiller is operably connected to the rectilinear cyclonic cooler and wherein the chiller further comprises:

i. a mesh impingement pad;
ii. a hydrophilic condenser;
iii. a mist elimination system connector portion; and
iv. a Water Scrubber;

g. a mist elimination system wherein the mist elimination system is operably connected to the output of the chiller via a mist elimination system connector portion;

h. a mist to hydrophobic connection assembly wherein the input of the mist to hydrophobic connection system is operably connected to the output of the mist elimination system;

i. a chiller differential pressure sensor assembly wherein the chiller differential pressure sensor assembly further comprises:

i. a demister pressure sensor;
ii. a chiller differential pressure sensor with transmitter wherein the chiller differential pressure sensor with transmitter is a mechanism to evaluate the pressure differences between the cyclonic cooler and transition box, and transmit sensor data to the PLC and is positioned outside the gasifer and rectilinear cyclonic cooler; and a Threaded Connection with Nipple which is positioned within the mist to hydrophobic connection assembly j. a single blower assembly which further comprises a blower wherein the blower is positioned after the input of the blower assembly located in such a position as to create a partial vacuum throughout the above mentioned units and wherein the output of the mist to hydrophobic connection assembly is upstream from the input of the blower assembly;

k. an exit pipe assembly wherein the input of the exit pipe assembly is operable connected to the output of the blower assembly;

l. a PLC computer; and m. a tar and particulate sampling system.

2. The apparatus of claim 1 wherein the renewable packed bed filter further comprises:

a. a renewable packed bed filter differential pressure assembly;
b. a top/bottom packed connecting flange;
c. a bottom renewable packed bed filter housing box wherein the bottom renewable packed bed filter housing box further comprises a scissoring mechanism, a flange with inlet pipe aperture, and finally a filter cleanout system; and
d. a top portion housing.

3. The apparatus of claim 1 wherein the gasifier is shaped like a rectangle and further comprises:

a. a hearth assembly wherein the hearth assembly further comprises:

i. a castable refractory;
ii. a ceramic flange; and
iii. an ash module assembly;

b. a fuel transmission box wherein the fuel transmission box further comprises:

i. a fuel transmission box bottom portion;
ii. a fuel transmission box plate;
iii. a fuel transmission box middle portion;
iv. a ceramic coating; and
v. a Fuel Transmission Box Relief Valve;

c. a transmission box/hopper modular connection elements;
d. a hearth/hopper modular connection elements; and
e. a hopper wherein the hopper is positioned above the hearth assembly and below the transmission box and the hopper further comprises:

i. a hopper middle portion wherein the hopper middle portion further comprises:

1. A fuel level detection system where said fuel level detection system further comprises a bin indicator and wherein the fuel level detection system is operably located within the hopper;

ii. a hopper bottom portion wherein the hopper bottom portion further comprises:

2. A pyrolysis zone; and
3. a preheating zone;

iii. a hopper interior walls; and
iv. a hopper top portion.

4. The apparatus of claim 1 wherein the mist elimination system further comprises:

a. a mesh pad stage;
b. a baffle chamber;
c. a chevron pad stage;
d. a mist wastewater assembly;
e. a demister relief valve;
f. a demister connector pipe with flange;
g. a channel for gas without water; and
h. an outlet pipe with flange.

5. The apparatus of claim 4 wherein the mist to hydrophobic connection assembly further comprises:

a. a transition connection wherein the transition connection further comprises:

i. a Trap;
ii. a horizontal pipe to hydrophobic polishing filter wherein the horizontal pipe to hydrophobic polishing filter further comprises:

1. A threaded hole with a nipple for differential pressure chiller; and
2. a coupling with valve for pump/oxygen sensor;

b. a Transition Vertical Pipe;
c. a Transition Horizontal Pipe.

6. The apparatus of claim 1 wherein the rectilinear cyclonic cooler further comprises:

a. a cooler gas exit pipe where the cooler gas exit pipe further comprises a cooler gas exit aperture;
b. a cooler inspection port;
c. one or more baffles wherein said baffles have an angle of slump ranging from 65-70 degrees; and
d. a Cooler Bottom Region wherein the cooler bottom region is operably responsible for catching and removing particulates.

7. The apparatus of claim 6 wherein the rectilinear cyclonic cooler transition assembly further comprises:

a. a transition horizontal pipe; and
b. a transition vertical pipe with t wherein the transition vertical pipe with t further comprises:

i. a safety thermocouple with transmitter T2; and
ii. a thermocouple shield.

8. The apparatus of claim 1 wherein the Primary Flare Assembly further comprises:

a. a Flare Vertical Pipe wherein the Flare Vertical Pipe further comprises:

i. a Flare End With Ignition Component;
ii. a Valve Assembly;
b. a Bottom/Vertical Pipe T Assembly;
c. a flare horizontal bottom pipe; and
d. a flare exit pipe assembly.

9. The apparatus of claim 8 wherein flare vertical pipe further comprises a venturi motivator.

10. The apparatus of claim 8 wherein the thermocouple assembly T1 is located within the flare exit pipe assembly.

11. The apparatus of claim 1 wherein the cooler-hearth differential pressure assembly further comprises:
a. a cooler differential pressure assembly;
b. a differential pressure sensor with transmitter; and
c. a transmission box differential pressure assembly.

12. The apparatus of claim 1 wherein the blower assembly further comprises:
a. a blower exit pipe wherein the blower exit pipe is operably connected to the blower; and
b. an oxygen sensor assembly.

13. The apparatus of claim 12 wherein
a. the blower exit pipe further comprises:
i. a pressure gauge for gas delivery;
ii. a coupling with valve for oxygen sensor/pump;
iii. a gas flow meter with transmitter; and
iv. a sampling port with valve;
b. and the blower further comprises:
i. a blower outlet; and
ii. a blower inlet;
c. And the oxygen sensor further comprises:
i. a recirculating hose;
ii. a sample pump;
iii. an oxygen sensor; and
iv. a p trap water collector.

14. The apparatus of claim 1 wherein the exit pipe assembly further comprises:
a. a generator;
b. an Engine Pipe 1;
c. a secondary flare assembly wherein the secondary flare assembly further comprises:
i. an ignition system;
ii. a horizontal portion; and
iii. a vertical portion.

15. The apparatus of claim 1 wherein the PLC computer further comprises:
a. one or more alarms;
b. a producer gas control modules wherein the producer gas control modules further comprises:
i. a primary flare module;
ii. a feedstock module;
iii. a auger gasifier module;
iv. a briquetter module;
v. a differential pressure cooler module;
vi. a renewable packed bed filter top actuator module;
vii. a thermocouple 1 module;
viii. an Auger Pack Bed Filter Module;
ix. a blower module;
x. a thermocouple 3 module;
xi. a pack bed filter bottom actuator module;
xii. an auger cooler module;
xiii. a pneumatic actuator module;
xiv. a bin indicator module;
xv. an air control assembly module;
xvi. a pressure modules;
xvii. an engine valve module;
xviii. a safety module;
xix. a secondary flare module;
xx. a differential pressure gasifier module;
xxi. an oxygen sensor module;
xxii. a temperature modules; and
xxiii. a thermocouple 2 module;
c. a touchscreen; and
d. a battery backup.

* * * * *